US011753798B2

(12) United States Patent
Fukuda et al.

(10) Patent No.: US 11,753,798 B2
(45) Date of Patent: Sep. 12, 2023

(54) HYDRAULIC SYSTEM FOR WORKING MACHINE

(71) Applicant: KUBOTA CORPORATION, Osaka (JP)

(72) Inventors: Yuji Fukuda, Sakai (JP); Ryota Hamamoto, Sakai (JP); Jun Tomita, Sakai (JP); Yuya Konishi, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 17/840,680

(22) Filed: Jun. 15, 2022

(65) Prior Publication Data

US 2023/0092677 A1 Mar. 23, 2023

(30) Foreign Application Priority Data

Sep. 17, 2021 (JP) ..... 2021-152394

(51) Int. Cl.

| | |
|---|---|
| ***E02F 9/22*** | (2006.01) |
| ***F15B 21/0427*** | (2019.01) |
| ***F15B 21/08*** | (2006.01) |
| ***E02F 9/20*** | (2006.01) |

(52) U.S. Cl.

CPC ..... *E02F 9/2225* (2013.01); *E02F 9/2083* (2013.01); *E02F 9/2246* (2013.01); *E02F 9/2278* (2013.01); *F15B 21/0427* (2019.01); *F15B 21/082* (2013.01)

(58) Field of Classification Search

CPC ..... E02F 9/2083; E02F 9/2278; E02F 9/2235; F15B 21/0427; F15B 21/082; F15B 2211/355; F15B 2211/36; F15B 2211/6316

See application file for complete search history.

(56) References Cited

U.S. PATENT DOCUMENTS

| | | | | |
|---|---|---|---|---|
| 9,316,310 | B2 * | 4/2016 | Kinugawa | F16H 61/468 |
| 10,316,493 | B2 * | 6/2019 | Fukuda | E02F 9/2246 |
| 10,435,867 | B2 * | 10/2019 | Fukuda | E02F 9/2253 |
| 10,920,881 | B2 * | 2/2021 | Fukuda | E02F 9/226 |
| 2015/0292184 | A1 * | 10/2015 | Kondo | F15B 13/0426 91/518 |
| 2016/0230370 | A1 * | 8/2016 | Fukuda | F16H 61/4008 |
| 2016/0304071 | A1 * | 10/2016 | Fukuda | A01B 1/00 |

(Continued)

FOREIGN PATENT DOCUMENTS

JP 6866278 B2 4/2021

*Primary Examiner* — Thomas E Lazo

(74) *Attorney, Agent, or Firm* — KEATING AND BENNETT, LLP

(57) ABSTRACT

In a hydraulic system for a working machine, a controller is configured or programmed to increase an output-port pressure of one activation valve for one hydraulic device and an output-port pressure of another activation valve for another hydraulic device to a normal pressure higher than a preloading pressure from a state where the output-port pressure of the one activation valve is equal to the preloading pressure and the output-port pressure of the other activation valve is lower than the preloading pressure, by causing the output-port pressure of the one activation valve to be lower than the preloading pressure and increasing the output-port pressure of the other activation valve to the normal pressure.

20 Claims, 19 Drawing Sheets

(56) References Cited

U.S. PATENT DOCUMENTS

| | | | | |
|---|---|---|---|---|
| 2017/0107695 | A1* | 4/2017 | Fukuda | E02F 9/2228 |
| 2020/0002922 | A1* | 1/2020 | Fukuda | E02F 9/2253 |
| 2020/0208376 | A1* | 7/2020 | Fukuda | E02F 9/2275 |
| 2022/0049466 | A1* | 2/2022 | Fukuda | E02F 9/2253 |
| 2023/0092677 | A1* | 3/2023 | Fukuda | E02F 9/2253 60/422 |

* cited by examiner

HYDRAULIC SYSTEM FOR WORKING MACHINE

CROSS REFERENCE TO RELATED APPLICATIONS

This application claims the benefit of priority to Japanese Patent Application No. 2021-152394 filed on Sep. 17, 2021. The entire contents of this application are hereby incorporated herein by reference.

BACKGROUND OF THE INVENTION

1. Field of the Invention

The present invention relates to a hydraulic system for a working machine such as a skid-steer loader, a compact track loader, or a backhoe.

2. Description of the Related Art

Japanese Patent No. 6866278 discloses a technique for warming up a hydraulic circuit of a working machine. A hydraulic system for the working machine disclosed in Japanese Patent No. 6866278 includes a hydraulic pump that delivers hydraulic fluid, a first hydraulic device to be activated by the hydraulic fluid, a second hydraulic device to be activated by the hydraulic fluid separately from the first hydraulic device, a first activation valve that controls the hydraulic fluid to be supplied to the first hydraulic device, a second activation valve that controls the hydraulic fluid to be supplied to the second hydraulic device, a first fluid passage that connects the first activation valve and the first hydraulic device, a second fluid passage that connects the second activation valve and the second hydraulic device, a third fluid passage that connects the first fluid passage and the second fluid passage, and a discharge fluid passage for discharging the hydraulic fluid in one of the first fluid passage and the second fluid passage. The first hydraulic device is a brake mechanism that performs braking of a traveling device and release of the braking of the traveling device in accordance with the pressure of the hydraulic fluid supplied from the first fluid passage. The second hydraulic device is a transmission mechanism that changes the speed of the traveling device in accordance with the pressure of the hydraulic fluid supplied from the second fluid passage. Japanese Patent No. 6866278 discloses a technique for warming up a hydraulic circuit in the hydraulic system.

SUMMARY OF THE INVENTION

In the hydraulic system disclosed in Japanese Patent No. 6866278, output ports of the two hydraulic valves are connected to each other. One of the two hydraulic valves is controlled to be in a position for outputting an input from the hydraulic pump, and the other hydraulic valve is controlled to be in a position for connecting the output port thereof and a tank port, thereby warming up a secondary circuit of the hydraulic valves. In the hydraulic system, if the two hydraulic valves are simultaneously switched in response to a transition from a warm-up mode for warming up the hydraulic circuit to a normal mode for normal operation, it may be difficult to correctly control the pressure of the entire hydraulic circuit.

Preferred embodiments of the present invention provide hydraulic systems for working machines that each provides an appropriate transition from a warm-up mode for warming up a hydraulic circuit to a normal mode for normal operation.

Preferred embodiments of the present invention may include the technical features described as follows.

A hydraulic system for a working machine according to an aspect of a preferred embodiment of the present invention includes a hydraulic pump to deliver hydraulic fluid, a first hydraulic device to be activated by the hydraulic fluid, a second hydraulic device to be activated by the hydraulic fluid separately from the first hydraulic device, a first activation valve to control the hydraulic fluid to be supplied to the first hydraulic device, a second activation valve to control the hydraulic fluid to be supplied to the second hydraulic device, a first fluid passage connecting the first activation valve and the first hydraulic device, a second fluid passage connecting the second activation valve and the second hydraulic device, a third fluid passage connecting the first fluid passage and the second fluid passage, a first discharge fluid passage connectable to the first fluid passage to discharge the hydraulic fluid, a second discharge fluid passage connectable to the second fluid passage to discharge the hydraulic fluid, and a controller to control operation of the first activation valve and operation of the second activation valve. The controller is configured or programmed to set an output-port pressure of one activation valve to a preloading pressure having a predetermined value, and set an output-port pressure of the other activation valve to a pressure lower than the preloading pressure to discharge the hydraulic fluid in any one of the first fluid passage and the second fluid passage to the first discharge fluid passage or the second discharge fluid passage, the one activation valve being one of the first activation valve and the second activation valve, the output-port pressure of the one activation valve being a pressure of the hydraulic fluid at an output port of the one activation valve, the other activation valve being the other of the first activation valve and the second activation valve, and the output-port pressure of the other activation valve being a pressure of the hydraulic fluid at an output port of the other activation valve. The controller is configured or programmed to increase at least either one of the output-port pressure of the one activation valve or the output-port pressure of the other activation valve to a normal pressure higher than the preloading pressure from a state where the one activation valve is controlled such that the output-port pressure thereof is equal to the preloading pressure and the other activation valve is controlled such that the output-port pressure thereof is lower than the preloading pressure, by performing control on the one activation valve such that the output-port pressure of the one activation valve becomes lower than the preloading pressure and performing control on the other activation valve such that the output-port pressure of the other activation valve is increased to the normal pressure.

In an aspect of a preferred embodiment of the present invention, the controller may be configured or programmed to perform control on the one activation valve such that the output-port pressure of the one activation valve becomes lower than the preloading pressure, and perform control on the other activation valve such that the output-port pressure of the other activation valve is increased to the normal pressure, the control on the one activation valve and the control on the other activation valve being performed simultaneously.

In an aspect of a preferred embodiment of the present invention, the controller may be configured or programmed to perform control on the other activation valve such that the output-port pressure of the other activation valve is increased to the normal pressure after a first predetermined time elapses after the controller performs control on the one activation valve such that the output-port pressure of the one activation valve becomes lower than the preloading pressure.

In an aspect of a preferred embodiment of the present invention, the controller may be configured or programmed to perform control on the one activation valve such that the output-port pressure of the one activation valve is increased to the normal pressure after a second predetermined time elapses after the controller performs control on the other activation valve such that the output-port pressure of the other activation valve is increased to the normal pressure.

In an aspect of a preferred embodiment of the present invention, the controller may be configured or programmed to, in response to performing control on the one activation valve such that the output-port pressure of the one activation valve becomes lower than the preloading pressure, perform control such that an amount of the hydraulic fluid delivered from the hydraulic pump increases to increase a pressure of the hydraulic fluid to be applied to the first activation valve and the second activation valve.

In an aspect of a preferred embodiment of the present invention, the controller may be configured or programmed to increase a rotational speed of a prime mover to increase the amount of the hydraulic fluid delivered from the hydraulic pump, the prime mover being operable to drive the hydraulic pump.

In an aspect of a preferred embodiment of the present invention, the third fluid passage may include a throttle.

In an aspect of a preferred embodiment of the present invention, the hydraulic system for a working machine may further include a first bypass fluid passage connected to the third fluid passage in parallel with the third fluid passage. The first bypass fluid passage may include a first check valve to allow a flow of the hydraulic fluid from the second fluid passage toward the first fluid passage and prevent a flow of the hydraulic fluid from the first fluid passage toward the second fluid passage.

In an aspect of a preferred embodiment of the present invention, the hydraulic system for a working machine may further include a second bypass fluid passage connected to the first fluid passage between the first activation valve and the third fluid passage in parallel with the first fluid passage. The second bypass fluid passage may include a second check valve to allow a flow of the hydraulic fluid from a node between the first fluid passage and the third fluid passage toward the first activation valve and prevent a flow of the hydraulic fluid from the first activation valve toward the node between the first fluid passage and the third fluid passage.

In an aspect of a preferred embodiment of the present invention, the third fluid passage may include a third check valve to allow a flow of the hydraulic fluid from the second fluid passage toward the first fluid passage and prevent a flow of the hydraulic fluid from the first fluid passage toward the second fluid passage.

The above and other elements, features, steps, characteristics and advantages of the present invention will become more apparent from the following detailed description of the preferred embodiments with reference to the attached drawings.

BRIEF DESCRIPTION OF THE DRAWINGS

A more complete appreciation of preferred embodiments of the present invention and many of the attendant advantages thereof will be readily obtained as the same becomes better understood by reference to the following detailed description when considered in connection with the accompanying drawings described below.

DETAILED DESCRIPTION OF THE PREFERRED EMBODIMENTS

Figure 1:
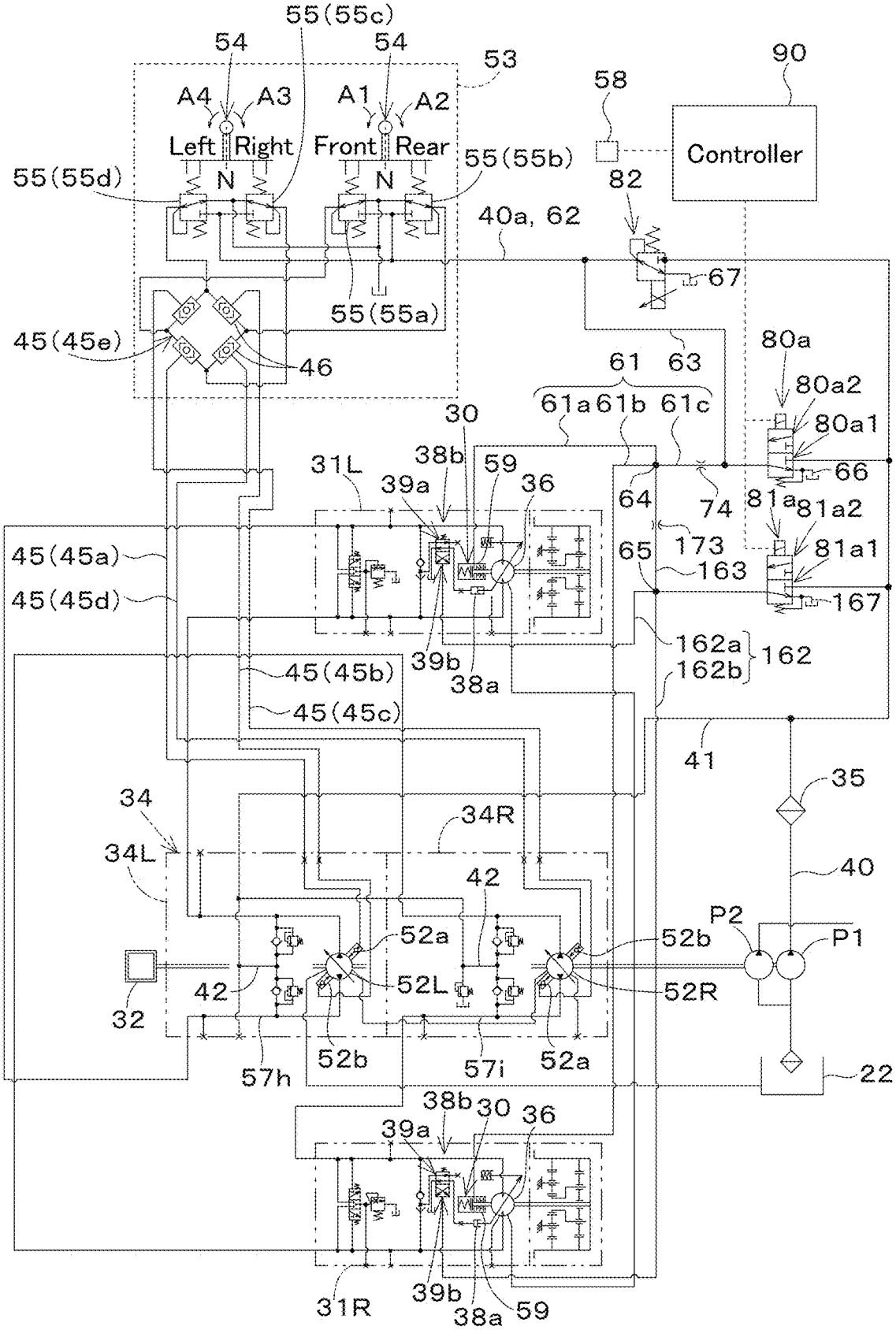
FIG. 1 is a diagram illustrating a hydraulic system (hydraulic fluid passage) for a traveling system of a working machine according to a first preferred embodiment of the present invention.

The preferred embodiments will now be described with reference to the accompanying drawings, wherein like reference numerals designate corresponding or identical elements throughout the various drawings. The drawings are to be viewed in an orientation in which the reference numerals are viewed correctly.

Preferred embodiments of the present invention will be described hereinafter with reference to the drawings as appropriate.

First Preferred Embodiment

A first preferred embodiment of the present invention will be described hereinafter with reference to the drawings.

Figure 18:
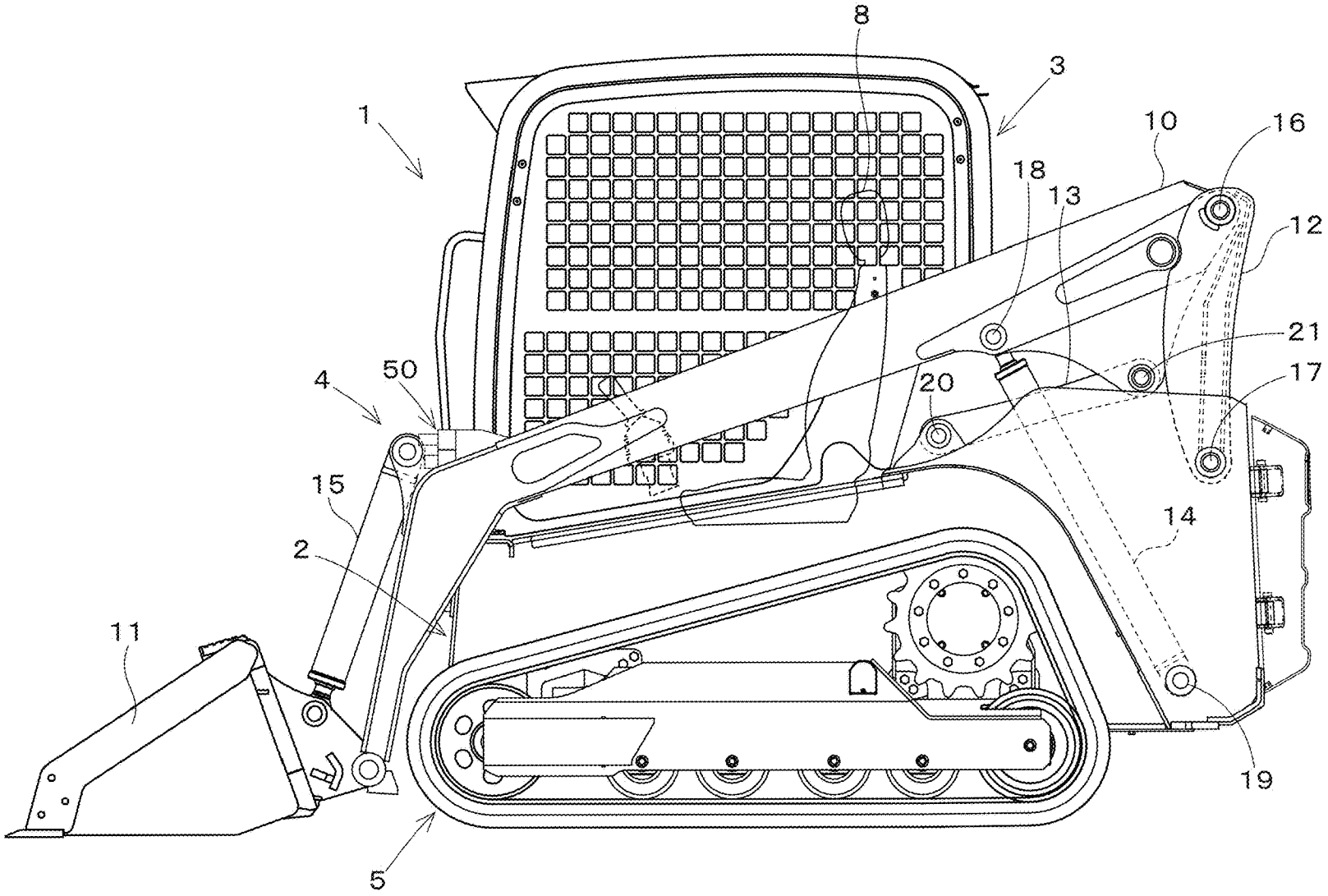
FIG. 18 is a side view of a track loader, which is an example of the working machine according to the first to third preferred embodiments of the present invention.

FIG. 18 is a side view of a working machine 1 according to the first preferred embodiment of the present invention. FIG. 18 illustrates a compact track loader as an example of the working machine 1. However, the working machine 1 according to this preferred embodiment is not limited to a compact track loader and may be any other type of loader working machine such as a skid-steer loader, for example. The working machine 1 according to this preferred embodiment may be a working machine other than a loader working machine.

Figure 19:
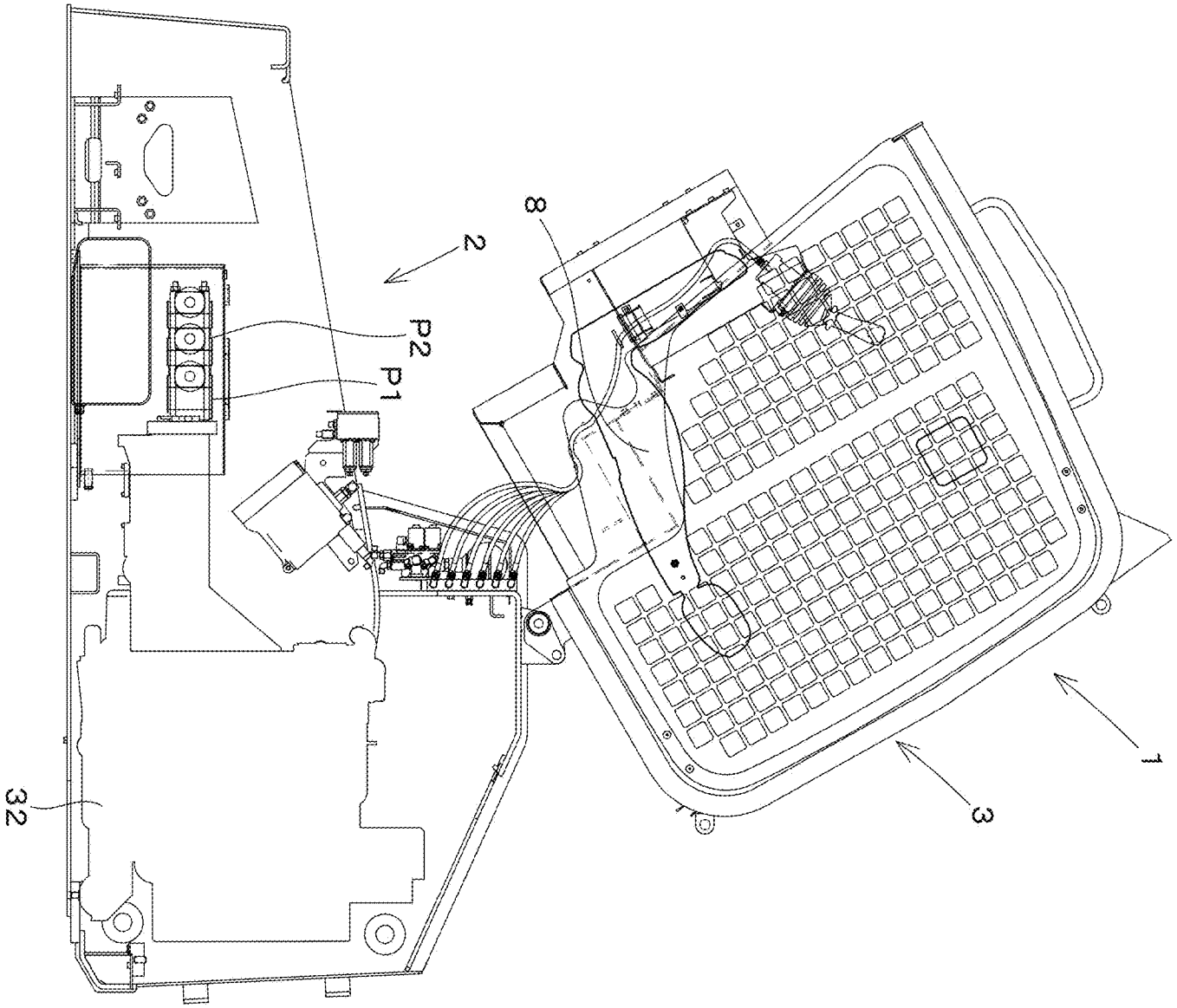
FIG. 19 is a side view of a portion of the track loader when a cabin is raised according to the first to third preferred embodiments of the present invention.

As illustrated in FIGS. 18 and 19, the working machine 1 includes a machine body 2, a cabin 3, a working device 4, and at least one traveling device 5.

In this preferred embodiment, a direction ahead of a driver seated on an operator's seat 8 of the working machine 1 (a direction on the left side in FIG. 18) is defined as a front or forward direction, a direction behind the driver (a direction on the right side in FIG. 18) is defined as a rear or rearward direction, a direction to the left of the driver (a direction closer to the viewer in FIG. 18) is defined as a left direction, and a direction to the right of the driver (a direction farther away from the viewer in FIG. 18) is defined as a right direction.

A horizontal direction that is a direction orthogonal to the front-rear direction is defined as a machine-body width direction. A direction to the right or left of the machine body 2 from the center of the machine body 2 is defined as a machine-body outward direction. In other words, the machine-body outward direction corresponds to the machine-body width direction and is a direction away from the machine body 2. A direction opposite to the machine-body outward direction is defined as a machine-body inward direction. In other words, the machine-body inward direction corresponds to the machine-body width direction and is a direction approaching the machine body 2.

The cabin 3 is mounted on the machine body 2. The cabin 3 is provided with the operator's seat 8. The working device 4 is attached to the machine body 2. The traveling device 5 is disposed in either outer portion of the machine body 2. The machine body 2 includes a prime mover 32 in a rear portion thereof.

The working device 4 includes a pair of booms 10, a working tool 11, a pair of lift links 12, a pair of control links 13, a pair of boom cylinders 14, and a pair of bucket cylinders 15. One of the pair of booms 10 is disposed on the right side of the cabin 3 so as to be swingable up and down, and the other of the pair of booms 10 is disposed on the left side of the cabin 3 so as to be swingable up and down. The working tool 11 is a bucket, for example. The bucket 11 is disposed at distal ends (front ends) of the booms 10 so as to be swingable up and down.

As illustrated in FIG. 18, one of the pair of lift links 12, one of the pair of control links 13, one of the pair of boom cylinders 14, and one of the pair of bucket cylinders 15 are disposed on the left side of the cabin 3 so as to correspond to the boom 10 disposed on the left side of the cabin 3. Although not illustrated in FIG. 18, the other of the pair of lift link 12, the other of the pair of control link 13, the other of the pair of boom cylinder 14, and the other of the pair of bucket cylinder 15 are disposed on the right side of the cabin 3 so as to correspond to the boom 10 disposed on the right side of the cabin 3.

The boom 10, the lift link 12, the control link 13, the boom cylinder 14, and the bucket cylinder 15 disposed on the left side of the cabin 3 will be described hereinafter.

The lift link 12 and the control link 13 support a base portion (rear portion) of the boom 10 so as to make the boom 10 swingable up and down. The boom cylinder 14 extends or contracts to raise or lower the boom 10. The bucket cylinder 15 extends or contracts to swing the bucket 11.

The lift link 12 is disposed upright at the rear portion of the base portion of the boom 10. An upper portion (first end) of the lift link 12 is pivotally supported by the rear portion of the base portion of the boom 10 through a first pivot shaft 16 so as to be rotatable about a lateral axis defined by the first pivot shaft 16. A lower portion (second end) of the lift link 12 is pivotally supported by a rear portion of the machine body 2 through a second pivot shaft 17 so as to be rotatable about a lateral axis defined by the second pivot shaft 17. The second pivot shaft 17 is disposed below the first pivot shaft 16.

An upper portion of the boom cylinder 14 is pivotally supported through a third pivot shaft 18 so as to be rotatable about a lateral axis defined by the third pivot shaft 18. The third pivot shaft 18 is disposed at a front portion of the base portion of the boom 10. A lower portion of the boom cylinder 14 is pivotally supported through a fourth pivot shaft 19 so as to be rotatable about a lateral axis defined by the fourth pivot shaft 19. The fourth pivot shaft 19 is disposed near a lower portion of the rear portion of the machine body 2 and below the third pivot shaft 18.

The control link 13 is disposed in front of the lift link 12. The control link 13 has a first end that is pivotally supported through a fifth pivot shaft 20 so as to be rotatable about a lateral axis defined by the fifth pivot shaft 20. The fifth pivot shaft 20 is disposed in the machine body 2 at a position in front of the lift link 12. The control link 13 has a second end that is pivotally supported through a sixth pivot shaft 21 so as to be rotatable about a lateral axis defined by the sixth pivot shaft 21. The sixth pivot shaft 21 is disposed in a portion of the boom 10 in front of the second pivot shaft 17 and above the second pivot shaft 17.

In response to extension or contraction of the boom cylinder 14, the lift link 12 and the control link 13 allow the boom 10 to swing up or down around the first pivot shaft 16 while supporting the base portion of the boom 10. As a result, the distal end of the boom 10 is raised or lowered. As the boom 10 swings up and down, the control link 13 swings up and down around the fifth pivot shaft 20. As the control link 13 swings up and down, the lift link 12 swings back and forth around the second pivot shaft 17. The bucket cylinder 15 is arranged near the front portion of the boom 10. The bucket cylinder 15 extends or contracts to swing the bucket 11.

While the configuration of the boom 10, the lift link 12, the control link 13, the boom cylinder 14, and the bucket cylinder 15 disposed on the left side of the cabin 3 has been described, the boom 10, the lift link 12, the control link 13, the boom cylinder 14, and the bucket cylinder 15 disposed on the right side of the cabin 3 also have a configuration similar to that described above.

A connection member 50 is disposed in the front portion of the boom 10 disposed on the left side of the cabin 3. The connection member 50 is a device that connects a hydraulic device included in an auxiliary attachment to a first pipe member such as a pipe in the boom 10. Specifically, the connection member 50 has a first end connectable to the first pipe member, and a second end connectable to a second pipe member connected to the hydraulic device of the auxiliary attachment. With this configuration, hydraulic fluid flowing through the first pipe member passes through the second pipe member and is supplied to the hydraulic device.

In place of the bucket 11, another working tool 11 is attachable to the front portions of the booms 10. Examples of the other working tool 11 include attachments (auxiliary attachments) such as a hydraulic crusher, a hydraulic breaker, an angle broom, an earth auger, a pallet fork, a sweeper, a mower, and a snow blower.

In this preferred embodiment, the traveling devices 5 on the left and right sides of the machine body 2 are each implemented as a crawler (or semi-crawler) traveling device 5. A wheeled traveling device 5 having at least one front wheel and at least one rear wheel may be used.

Next, a hydraulic system for the working machine 1 according to this preferred embodiment will be described. The hydraulic system for the working machine 1 includes a hydraulic system for a traveling system and a hydraulic system for a working system.

FIG. 1 illustrates a hydraulic system (hydraulic fluid passage) for the traveling system of the working machine 1. As illustrated in FIG. 1, the hydraulic system for the traveling system is a system for driving the traveling devices 5, and includes the prime mover 32, a first hydraulic pump (hydraulic pump) P1, a first traveling motor mechanism 31L, a second traveling motor mechanism 31R, and a travel drive mechanism 34.

The prime mover 32 includes an electric motor, an engine (internal combustion engine), and the like. In this preferred embodiment, the prime mover 32 is an engine. The first hydraulic pump P1 is a pump to be driven by the power of the prime mover 32 and includes a fixed-displacement gear pump. The first hydraulic pump P1 is capable of delivering hydraulic fluid stored in a tank (hydraulic fluid tank) 22. A delivery fluid passage 40 through which the hydraulic fluid delivered from the first hydraulic pump P1 flows is extended from the first hydraulic pump P1.

The delivery fluid passage 40 is provided with a filter 35 in an intermediate portion thereof. The delivery fluid passage 40 is branched into a plurality of branches. A first charge fluid passage 41 is connected to the delivery fluid passage 40. The first charge fluid passage 41 leads to the travel drive mechanism 34. The hydraulic fluid delivered from the first hydraulic pump P1 and to be used for control may be referred to as pilot fluid, and the pressure of the pilot fluid may be referred to as pilot pressure.

The travel drive mechanism 34 is a mechanism for driving the first traveling motor mechanism 31L and the second traveling motor mechanism 31R. The travel drive mechanism 34 includes a drive circuit (left drive circuit) 34L for driving the first traveling motor mechanism 31L, and a drive circuit (right drive circuit) 34R for driving the second traveling motor mechanism 31R.

The drive circuit 34L includes a hydrostatic transmission (HST) pump (traveling pump) 52L, a transmission fluid passage 57*h*, and a second charge fluid passage 42. The drive circuit 34R includes an HST pump (traveling pump) 52R, a transmission fluid passage 57*i*, and a second charge fluid passage 42. The transmission fluid passage 57*h* is a fluid passage that connects the HST pump 52L and an HST motor 36 of the first traveling motor mechanism 31L. The transmission fluid passage 57*i* is a fluid passage that connects the HST pump 52R and an HST motor 36 of the second traveling motor mechanism 31R. The second charge fluid passages 42 are fluid passages, each of which is connected to a corresponding one of the transmission fluid passages 57*h* and 57*i* to replenish the corresponding one of the transmission fluid passages 57*h* and 57*i* with the hydraulic fluid from the first hydraulic pump P1.

The HST pumps 52L and 52R are swash-plate variable displacement axial pumps to be driven by the power of the prime mover 32. Each of the HST pumps 52L and 52R includes a forward-traveling pressure receiver 52*a* and a rearward-traveling pressure receiver 52*b* on which pilot pressures act. The angle of a swash plate of each of the HST pumps 52L and 52R is changed in accordance with the pilot pressure acting on the pressure receiver 52*a* or 52*b*. The angles of the swash plates are changed to change the outputs of the HST pumps 52L and 52R (the amounts of the delivered hydraulic fluid) and the directions of delivering the hydraulic fluid. In other words, each of the HST pumps 52L and 52R changes a driving force to be output to a corresponding one of the traveling devices 5 in response to a change in the angle of the swash plate thereof.

The first traveling motor mechanism 31L is a mechanism that transmits power to a drive shaft of the traveling device 5 disposed on the left side of the machine body 2. The second traveling motor mechanism 31R is a mechanism that transmits power to a drive shaft of the traveling device 5 disposed on the right side of the machine body 2. The first traveling motor mechanism 31L includes the HST motor 36 (traveling motor 36) and a transmission mechanism.

The HST motor 36 is a swash-plate variable displacement axial motor capable of changing a vehicle speed (rotation) to a first speed stage or a second speed stage. In other words, the HST motor 36 is a motor capable of changing the propelling force of the working machine 1.

The transmission mechanism includes a swash-plate switching cylinder 38*a* and a travel switching valve 38*b*. The swash-plate switching cylinder 38*a* is a cylinder that extends or contracts to change the angle of the swash plate of the HST motor 36. The travel switching valve 38*b* is a two-position switching valve that extends or contracts the swash-plate switching cylinder 38*a* to either side and that is switchable between a first position 39*a* and a second position 39*b*. Switching of the travel switching valve 38*b* is performed by a transmission switching valve 81*a*.

The transmission switching valve 81*a* is connected to the delivery fluid passage 40 and is also connected to the travel switching valve 38*b* of the first traveling motor mechanism 31L and the travel switching valve 38*b* of the second traveling motor mechanism 31R. The transmission switching valve 81*a* is a two-position switching valve that is switchable between a first position 81*a*1 and a second position 81*a*2.

When the transmission switching valve 81*a* is set to the first position 81*a*1, the transmission switching valve 81*a* sets the pressure of the hydraulic fluid that is to act on the travel switching valve 38*b* of the transmission mechanism to a pressure corresponding to a predetermined speed (for example, the first speed stage). When the transmission switching valve 81*a* is set to the second position 81*a*2, the transmission switching valve 81*a* sets the pressure of the hydraulic fluid that is to act on the travel switching valve 38*b* to a pressure corresponding to a speed (the second speed stage) higher than the predetermined speed (the first speed stage).

Accordingly, when the transmission switching valve 81*a* is in the first position 81*a*1, the travel switching valve 38*b* is in the first position 39*a*. As a result, the swash-plate switching cylinder 38*a* contracts, and the HST motor 36 can be set to the first speed stage. When the transmission switching valve 81*a* is in the second position 81*a*2, the travel switching valve 38*b* is in the second position 39*b*. As a result, the swash-plate switching cylinder 38*a* extends, and the HST motor 36 can be set to the second speed stage.

Control for shifting the HST motor 36 to the first speed stage or the second speed stage is performed by a controller 90. For example, the controller 90 has an operation member 58 such as a switch (transmission switch). When the operation member 58 is switched to the first speed stage, the controller 90 outputs a control signal for deenergizing the solenoid of the transmission switching valve 81*a* to set the transmission switching valve 81*a* to the first position 81*a*1. When the operation member 58 is switched to the second speed stage, the controller 90 outputs a control signal for energizing the solenoid of the transmission switching valve 81*a* to set the transmission switching valve 81*a* to the second position 81*a*2.

The first traveling motor mechanism 31L further includes a brake mechanism 30. The brake mechanism 30 is capable of braking the traveling device 5 on the left side of the machine body 2, and is capable of stopping the rotation of the HST motor 36 or the rotation of an output shaft that rotates with the rotation of the HST motor 36. The brake mechanism 30 is changed to an operation state for braking the first traveling motor mechanism 31L or an operation state for releasing braking of the first traveling motor mechanism 31L, based on the pilot fluid (hydraulic fluid) delivered from the first hydraulic pump P1.

For example, the brake mechanism 30 includes a first disk disposed on an output shaft of the first traveling motor mechanism 31L, a second disk that is movable, and a spring that urges the second disk such that the second disk comes into contact with the first disk. The brake mechanism 30 further includes a housing (housing case) 59 that houses the first disk, the second disk, and the spring. A portion of the housing 59 where the second disk is located is connected to a brake switching valve 80*a* through a fluid passage as described below.

The brake switching valve 80*a* is a solenoid valve that allows the brake mechanism 30 to perform braking and release of the braking (brake release), and is a two-position switching valve that is switchable between a first position 80*a*1 and a second position 80*a*2. When the brake switching valve 80*a* is in the first position 80*a*1, the brake switching valve 80*a* sets the pressure of the hydraulic fluid that is to act on the brake mechanism 30 (the pressure acting on the housing 59) to a pressure at which the brake mechanism 30 executes braking. When the brake switching valve 80*a* is in the second position 80*a*2, the brake switching valve 80*a* sets the pressure of the hydraulic fluid to a pressure at which the brake mechanism 30 executes the brake release.

Switching of the brake switching valve 80*a* is performed under the control of the controller 90. For example, the controller 90 outputs a control signal for deenergizing the solenoid of the brake switching valve 80*a* to set the brake switching valve 80*a* to the first position 80*a*1. The controller 90 outputs a control signal for energizing the solenoid of the brake switching valve 80*a* to set the brake switching valve 80*a* to the second position 80*a*2. The control signal may be output from the controller 90 to the brake switching valve 80*a*, for example, manually by operation of a switch disposed in the controller 90 or automatically when the controller 90 determines that the working machine 1 enters a predetermined operation state.

Accordingly, when the brake switching valve 80*a* is in the first position 80*a*1, the pilot fluid in a reservoir of the housing 59 is discharged, and the second disk moves in a direction for braking. As a result, the brake mechanism 30 can perform braking. When the brake switching valve 80*a* is in the second position 80*a*2, the pilot fluid is supplied to the reservoir of the housing 59, and the second disk moves in a direction opposite to the direction for braking (a direction opposite to the urging direction of the spring). As a result, the brake mechanism 30 can perform the brake release.

The second traveling motor mechanism 31R has a configuration similar to that of the first traveling motor mechanism 31L, and the configuration presented for the first traveling motor mechanism 31L may be read as that of the second traveling motor mechanism 31R, which will not be described herein.

As illustrated in FIG. 1, the working machine 1 includes an operation device 53. The operation device 53 is a device that operates the traveling devices 5, that is, the first traveling motor mechanism 31L, the second traveling motor mechanism 31R, and the travel drive mechanism 34. The operation device 53 includes a first operation member 54 and a plurality of operation valves 55 (55*a*, 55*b*, 55*c*, and 55*d*).

The first operation member 54 is an operation member supported by the operation valves 55 and swingable in the left-right direction (machine-body width direction) or the front-rear direction. The plurality of operation valves 55 are operated by the common first operation member 54, that is, one first operation member 54. The plurality of operation valves 55 are activated in response to swinging of the first operation member 54. The plurality of operation valves 55 can be supplied with the hydraulic fluid (pilot fluid) from the first hydraulic pump P1 through the delivery fluid passage 40. The plurality of operation valves 55 include an operation valve 55*a*, an operation valve 55*b*, an operation valve 55*c*, and an operation valve 55*d*.

The plurality of operation valves 55 are connected to the travel drive mechanism 34 (the traveling pumps 52L and 52R) for the traveling system by a travel fluid passage 45. The travel fluid passage 45 includes a first travel fluid passage 45*a*, a second travel fluid passage 45*b*, a third travel fluid passage 45*c*, a fourth travel fluid passage 45*d*, and a fifth travel fluid passage 45*e*.

The first travel fluid passage 45*a* is a fluid passage connected to the forward-traveling pressure receiver 52*a* of the traveling pump 52L. The second travel fluid passage 45*b* is a fluid passage connected to the rearward-traveling pressure receiver 52*b* of the traveling pump 52L. The third travel fluid passage 45*c* is a fluid passage connected to the forward-traveling pressure receiver 52*a* of the traveling pump 52R. The fourth travel fluid passage 45*d* is a fluid passage connected to the rearward-traveling pressure receiver 52*b* of the traveling pump 52R.

The fifth travel fluid passage 45*e* is a fluid passage that connects the operation valves 55, the first travel fluid passage 45*a*, the second travel fluid passage 45*b*, the third travel fluid passage 45*c*, and the fourth travel fluid passage 45*d*. The fifth travel fluid passage 45*e* further connects a plurality of shuttle valves 46 and the plurality of operation valves 55 (55*a*, 55*b*, 55*c*, and 55*d*).

When the first operation member 54 is swung to the front (in a direction indicated by an arrow A1 in FIG. 1), the operation valve 55*a* is operated to output a pilot pressure from the operation valve 55*a*, and an output shaft of the traveling motor 36 of the first traveling motor mechanism 31L (hereinafter referred to as the left traveling motor 36) and an output shaft of the traveling motor 36 of the second traveling motor mechanism 31R (hereinafter referred to as the right traveling motor 36) rotate forward (forward rotation) at a speed proportional to the amount of swing of the first operation member 54. As a result, the working machine 1 moves straight forward.

When the first operation member 54 is swung to the rear (in a direction indicated by an arrow A2 in FIG. 1), the operation valve 55*b* is operated to output a pilot pressure from the operation valve 55*b*, and the output shafts of the right and left traveling motors 36 rotate in reverse (rearward rotation) at a speed proportional to the amount of swing of the first operation member 54. As a result, the working machine 1 moves straight rearward.

When the first operation member 54 is swung to the right (in a direction indicated by an arrow A3 in FIG. 1), the operation valve 55*c* is operated to output a pilot pressure from the operation valve 55*c*, and the output shaft of the left traveling motor 36 rotates forward while the output shaft of the right traveling motor 36 rotates in reverse. As a result, the working machine 1 turns to the right. When the first operation member 54 is swung to the left (in a direction indicated by an arrow A4 in FIG. 1), the operation valve 55*d* is operated to output a pilot pressure from the operation valve 55*d*, and the output shaft of the left traveling motor 36 rotates in reverse while the output shaft of the right traveling motor 36 rotates forward. As a result, the working machine 1 turns to the left.

When the first operation member 54 is swung in a diagonal direction, the rotation directions and rotational speeds of the output shafts of the left traveling motor 36 and the right traveling motor 36 are determined by the differential pressures between the pilot pressures acting on the pressure receivers 52*a* and the pilot pressures acting on the pressure receivers 52*b*, and the working machine 1 turns to the right or left while moving straight forward or rearward.

Next, the hydraulic system for the working system will be described.

Figure 2:
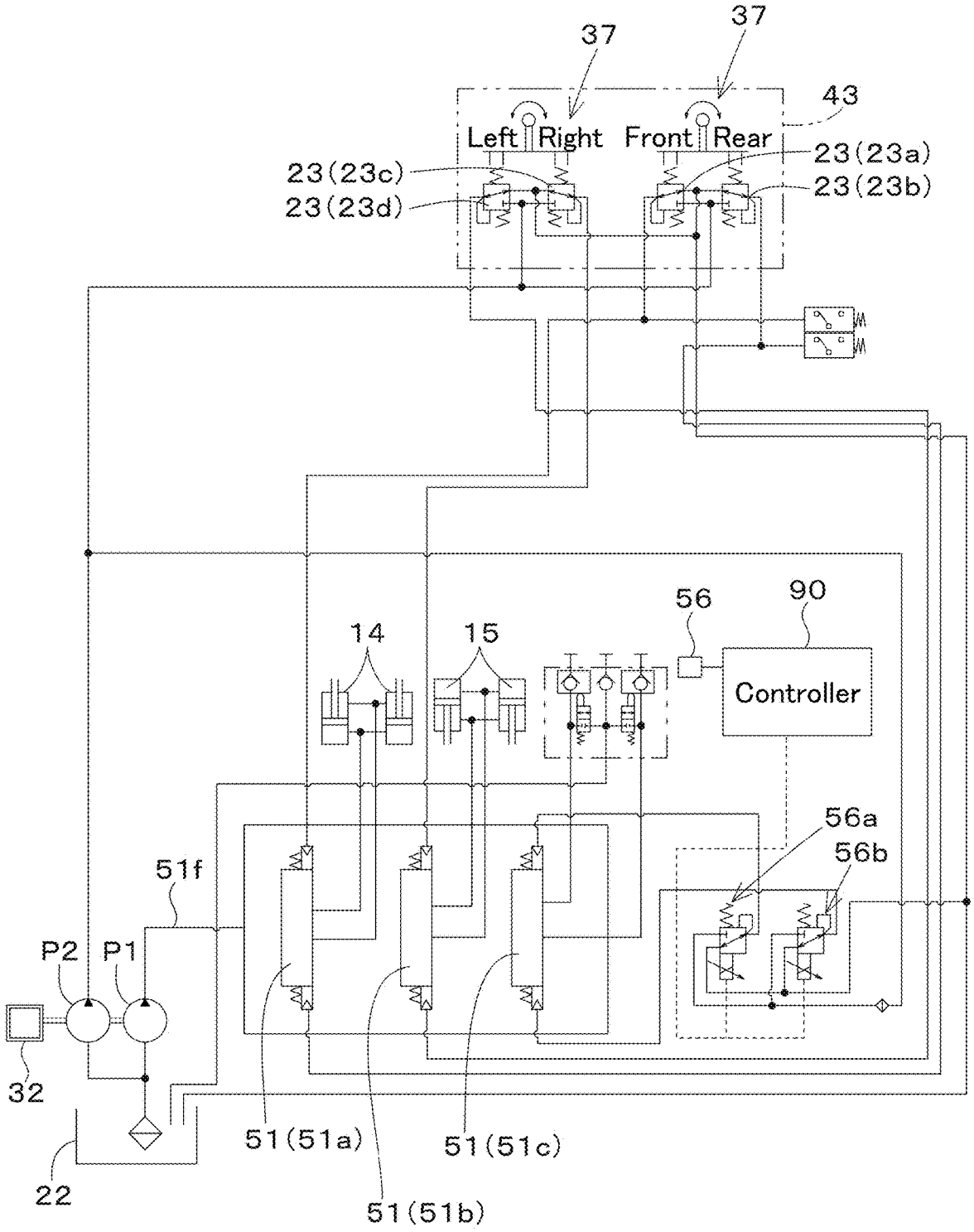
FIG. 2 is a diagram illustrating a hydraulic system (hydraulic fluid passage) for a working system of the working machine according to the first preferred embodiment of the present invention.

FIG. 2 illustrates a hydraulic system (hydraulic fluid passage) for the working system of the working machine 1. As illustrated in FIG. 2, the hydraulic system for the working system is a system for activating the booms 10, the bucket 11, an auxiliary attachment, and the like, and includes a plurality of control valves 51 and a working system hydraulic pump (second hydraulic pump P2).

The second hydraulic pump P2 is disposed at a position different from the first hydraulic pump P1 and includes a low-capacity gear pump. The second hydraulic pump P2 is capable of delivering hydraulic fluid stored in the hydraulic fluid tank 22. In particular, the second hydraulic pump P2 delivers hydraulic fluid for mainly activating hydraulic actuators.

A working fluid passage 51*f* is extended from a delivery port of the second hydraulic pump P2. The plurality of control valves 51 are connected to the working fluid passage 51*f*. A boom control valve 51*a* is a valve that controls the boom cylinders 14. A bucket control valve 51*b* is a valve that controls the bucket cylinders 15. An auxiliary control valve 51*c* is a valve that controls a hydraulic actuator of the auxiliary attachment.

The booms 10 and the bucket 11 are operable with a second operation member 37 included in an operation device 43. The second operation member 37 is an operation member supported by operation valves 23 and swingable in the left-right direction (machine-body width direction) or the front-rear direction. In response to a tilt of the second operation member 37, one of the operation valves 23 disposed in a lower portion of the second operation member 37 can be operated.

A cavity of each boom cylinder 14 is divided by its piston into a bottom-side chamber in which a piston rod is not disposed and a rod-side chamber in which the piston rod is disposed. When the second operation member 37 is tilted to the front, a lowering operation valve 23*a* is operated to output a pilot pressure from the lowering operation valve 23*a*. The pilot pressure acts on a pressure receiver of the boom control valve 51*a*. When the hydraulic fluid entering the boom control valve 51*a* is supplied to the rod-side chambers of the boom cylinders 14, the booms 10 are lowered.

When the second operation member 37 is tilted to the rear, a raising operation valve 23*b* is operated to output a pilot pressure from the raising operation valve 23*b*. The pilot pressure acts on a pressure receiver of the boom control valve 51*a*. When the hydraulic fluid entering the boom control valve 51*a* is supplied to the bottom-side chambers of the boom cylinders 14, the booms 10 are raised.

That is, the boom control valve 51*a* is capable of controlling the flow rate of the hydraulic fluid that is to flow to the boom cylinders 14 in accordance with a pressure of the hydraulic fluid that is set by operation of the second operation member 37 (a pilot pressure set using the lowering operation valve 23*a* or a pilot pressure set using the raising operation valve 23*b*).

When the second operation member 37 is tilted to the right, a bucket-dumping operation valve 23*c* is operated, and a pilot pressure acts on a pressure receiver of the bucket control valve 51*b*. As a result, the bucket control valve 51*b* is activated in a direction to extend the bucket cylinders 15, and the bucket 11 performs a dumping operation at a speed proportional to the amount of tilt of the second operation member 37.

When the second operation member 37 is tilted to the left, a bucket-shoveling operation valve 23*d* is operated, and a pilot pressure acts on a pressure receiver of the bucket control valve 51*b*. As a result, the bucket control valve 51*b* is activated in a direction to contract the bucket cylinders 15, and the bucket 11 performs a shoveling operation at a speed proportional to the amount of tilt of the second operation member 37.

That is, the bucket control valve 51*b* is capable of controlling the flow rate of the hydraulic fluid that is to flow to the bucket cylinders 15 in accordance with a pressure of the hydraulic fluid that is set by operation of the second operation member 37 (a pilot pressure set using the bucket-dumping operation valve 23*c* or a pilot pressure set using the bucket-shoveling operation valve 23*d*). In other words, the operation valves 23*a*, 23*b*, 23*c*, and 23*d* change the pressure of the hydraulic fluid in accordance with the operation of the second operation member 37, and supply the hydraulic fluid whose pressure has been changed to control valves such as the boom control valve 51*a*, the bucket control valve 51*b*, and the auxiliary control valve 51*c*.

The auxiliary attachment is operable with a switch 56 disposed around the operator's seat 8. The switch 56 includes, for example, a swingable seesaw switch, a slidable slide switch, or a depressible push switch. The operation of the switch 56 is input to the controller 90. A first solenoid valve 56*a* and a second solenoid valve 56*b* are opened in accordance with the amount of operation of the switch 56.

As a result, the pilot fluid is supplied to the auxiliary control valve 51*c* connected to the first solenoid valve 56*a* and the second solenoid valve 56*b*, and the auxiliary actuator of the auxiliary attachment is activated by the hydraulic fluid supplied from the auxiliary control valve 51*c*.

In the hydraulic system for the working machine 1 described above, a first fluid passage connected to a first hydraulic device and a second fluid passage connected to a second hydraulic device are connected by a third fluid passage. This configuration facilitates warm-up.

Figure 3:
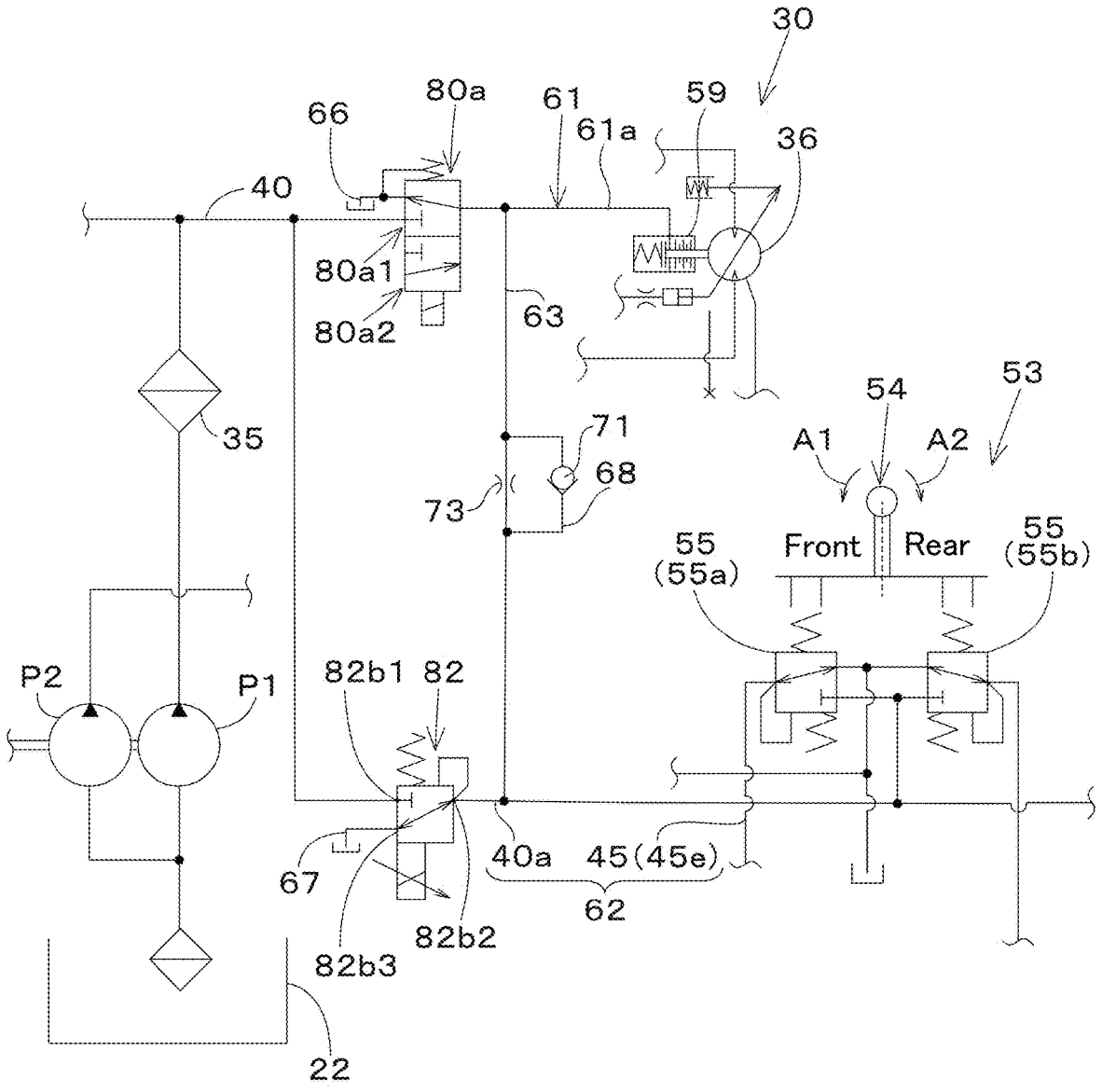
FIG. 3 is a partially enlarged view of the hydraulic system for the traveling system of the working machine according to the first preferred embodiment of the present invention.

The hydraulic system for the traveling system according to this preferred embodiment will be described in more detail with reference to FIGS. 1 and 3. FIG. 3 is a partially enlarged view of the hydraulic system for the traveling system of the working machine 1 according to this preferred embodiment. In this preferred embodiment, the first hydraulic device is the brake mechanism 30, and the second hydraulic device is the HST pumps 52L and 52R. Based on this assumption, the first fluid passage, the second fluid passage, and the third fluid passage will be described.

As illustrated in FIGS. 1 and 3, a first fluid passage 61 is a fluid passage that connects the brake mechanism 30, which is a first hydraulic device, and the brake switching valve 80*a*, which is a first activation valve that controls the hydraulic fluid to be supplied to the brake mechanism 30 (first hydraulic device). In this preferred embodiment, the first fluid passage 61 includes a first brake fluid passage 61*a* and a second brake fluid passage 61*b*.

The first brake fluid passage 61*a* is a fluid passage that connects the brake mechanism 30 of the first traveling motor mechanism 31L and the brake switching valve 80*a*, which is a first activation valve. The second brake fluid passage 61*b* is a fluid passage that connects the brake mechanism 30 of the second traveling motor mechanism 31R and the brake switching valve 80*a*, which is a first activation valve. The first brake fluid passage 61*a* and the second brake fluid passage 61*b* merge into a combined fluid passage 61*c* (a fluid passage serving as both the first brake fluid passage 61*a* and the second brake fluid passage 61*b*), and the combined fluid passage 61*c* is connected to the brake switching valve 80*a*.

The combined fluid passage 61*c* is provided with a throttle 74 for reducing the flow rate of the hydraulic fluid. In other words, the throttle 74 is disposed in a section of the first fluid passage 61 between a node (a merging point 64 described below) at which the first brake fluid passage 61*a* and the second brake fluid passage 61*b* are connected to each other and a node at which the first fluid passage 61 is connected to the third fluid passage 63. The node at which the first passage 61 is connected to the third fluid passage 63 is disposed on the first fluid passage 61 between the throttle 74 and the brake switching valve 80*a*.

The brake switching valve 80*a* has a discharge port, which is connected to a discharge fluid passage 66 through which the hydraulic fluid in the first fluid passage 61 (the first brake fluid passage 61*a* and the second brake fluid passage 61*b*) can be discharged. The discharge fluid passage 66 is connected to a suction portion of a hydraulic pump, the hydraulic fluid tank 22, or the like.

A second fluid passage 62 is a fluid passage that connects the HST pumps 52L and 52R, which are second hydraulic devices, and an anti-stall proportional valve 82. The anti-stall proportional valve 82 is a second activation valve that controls the hydraulic fluid to be supplied to the HST pumps 52L and 52R (second hydraulic devices). In this preferred embodiment, the second fluid passage 62 is a fluid passage that connects the HST pumps 52L and 52R, the operation device 53, and the anti-stall proportional valve 82. The second fluid passage 62 includes a section 40*a* of the delivery fluid passage 40, and the travel fluid passage 45. In FIG. 3, part of the travel fluid passage 45 is illustrated, for convenience of description.

As illustrated in FIG. 3, the anti-stall proportional valve 82 has a primary port (pump port) 82*b*1 and a secondary port 82*b*2. The primary port 82*b*1 of the anti-stall proportional valve 82 is connected to an intermediate portion of the delivery fluid passage 40. The secondary port 82*b*2 of the anti-stall proportional valve 82 is connected to the section (40*a*) of the delivery fluid passage 40 extending from the intermediate portion to the operation valves 55 of the operation device 53. The anti-stall proportional valve 82 has a discharge port 82*b*3, which is connected to a discharge fluid passage 67 through which the hydraulic fluid in the second fluid passage 62 (the section 40*a* of the delivery fluid passage 40 and the travel fluid passage 45) can be discharged. The discharge fluid passage 67 is connected to a suction portion of a hydraulic pump, the hydraulic fluid tank 22, or the like.

The anti-stall proportional valve 82 in the second fluid passage 62 is disposed in the section 40*a* of the delivery fluid passage 40 leading to the operation device 53. The controller 90 controls the anti-stall proportional valve 82 (second activation valve) to perform anti-stall control.

The third fluid passage 63 is a fluid passage that connects the first fluid passage 61 and the second fluid passage 62. The third fluid passage 63 has a first end connected to an intermediate portion of the combined fluid passage 61*c* of the first brake fluid passage 61*a* and the second brake fluid passage 61*b*, and a second end connected to an intermediate portion of the section 40*a* of the delivery fluid passage 40. The third fluid passage 63 is provided with a throttle 73 for reducing the flow rate of the hydraulic fluid.

A first bypass fluid passage 68 is connected to the third fluid passage 63. The first bypass fluid passage 68 is provided with a first check valve 71. The first check valve 71 is a valve that allows the flow of the hydraulic fluid from the second fluid passage 62 to the first fluid passage 61 and prevents the flow of the hydraulic fluid from the first fluid passage 61 to the second fluid passage 62.

Figure 4:
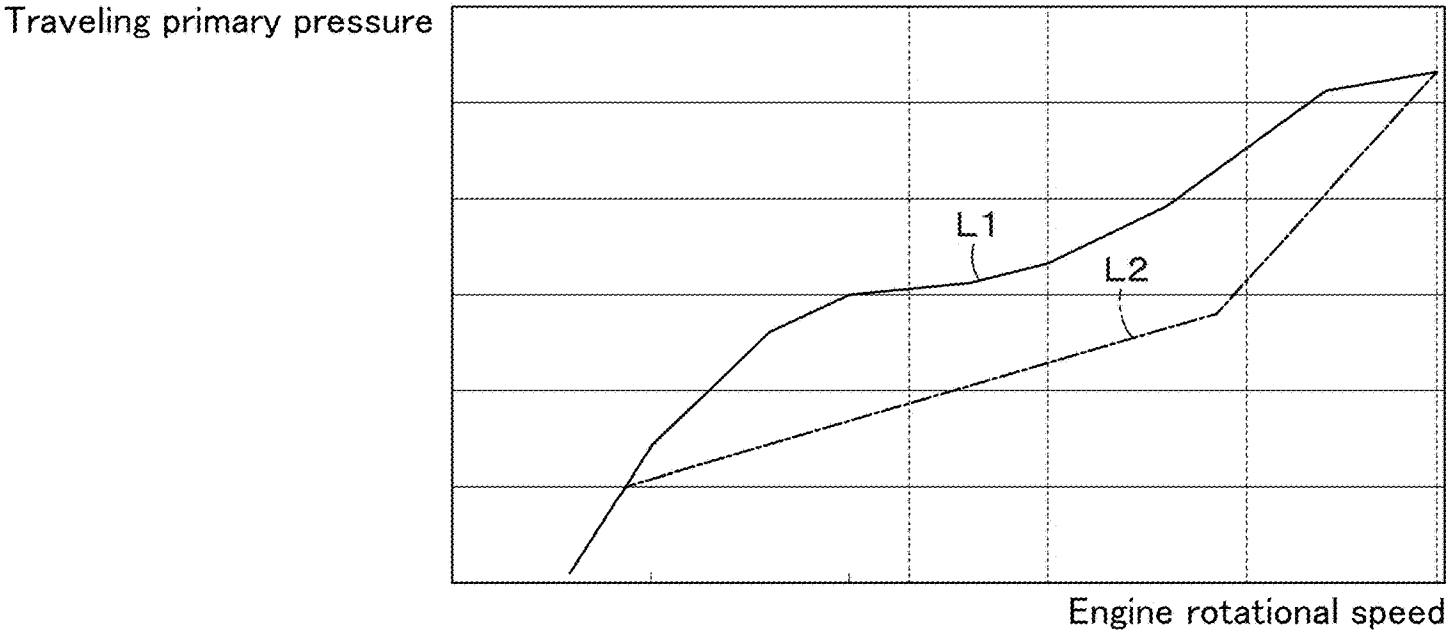
FIG. 4 is a diagram illustrating a relationship between an engine rotational speed and a traveling primary pressure according to the first preferred embodiment of the present invention.

The anti-stall control will now be described. FIG. 4 illustrates control lines L1 and L2 representing the relationship between an engine rotational speed and a traveling primary pressure. The traveling primary pressure is a pressure (pilot pressure) of the hydraulic fluid in a section of the delivery fluid passage 40 from the anti-stall proportional valve 82 to the operation valves 55 (the operation valve 55*a*, the operation valve 55*b*, the operation valve 55*c*, and the operation valve 55*d*). That is, the traveling primary pressure is the primary pressure of the hydraulic fluid entering the operation valves 55 disposed in the first operation member 54. The control line L1 indicates a relationship between the engine rotational speed and the traveling primary pressure when a drop amount is less than a predetermined value. The control line L2 indicates a relationship between the engine rotational speed and the traveling primary pressure when a drop amount is equal to or greater than the predetermined value. The drop amount is a difference between an actual rotational speed of the engine of the prime mover 32 and a target rotational speed.

When the drop amount is less than the predetermined value, the controller 90 adjusts the opening of the anti-stall proportional valve 82 so that the relationship between the actual rotational speed of the engine and the traveling primary pressure matches the control line L1. When the drop amount is equal to or greater than the predetermined value, the controller 90 adjusts the opening of the anti-stall proportional valve 82 so that the relationship between the actual rotational speed of the engine and the traveling primary pressure matches the control line L2.

At a given engine rotational speed, the traveling primary pressure obtained based on the control line L2 is lower than the traveling primary pressure obtained based on the control line L1. That is, at the same engine rotational speed, the traveling primary pressure obtained based on the control line L2 is lower than the traveling primary pressure obtained based on the control line L1.

Accordingly, with control based on the control line L2, the pressure (pilot pressure) of the hydraulic fluid entering the operation valves 55 is kept low. As a result, the angles of the swash plates of the HST pumps (traveling pumps) 52L and 52R are adjusted, and the load acting on the engine is reduced. Thus, the stall of the engine can be prevented.

In FIG. 4, one control line L2 is illustrated. Alternatively, a plurality of control lines may be used as the control line L2. For example, the control line L2 may be set for each drop amount. Preferably, the controller 90 includes data indicating the control line L1 and the control line L2, control parameters such as functions, or the like.

In the hydraulic system described with reference to FIGS. 1 and 3, for example, when the anti-stall proportional valve 82 (second activation valve) is closed and the brake switching valve 80*a* (first activation valve) is set to the second position 80*a*2, the hydraulic fluid in the first fluid passage 61 flows to the second fluid passage 62 through the third fluid passage 63 and is discharged from the discharge port 82*b*3 of the anti-stall proportional valve 82 to the discharge fluid passage 67. The flow of the hydraulic fluid allows warm-up of the first fluid passage (brake fluid passage) and the second fluid passage (travel fluid passage).

That is, the first fluid passage 61, which connects the brake switching valve 80*a* and the brake mechanism 30, and the second fluid passage 62, which connects the HST pumps 52L and 52R and the anti-stall proportional valve 82, are connected by the third fluid passage 63, and the discharge fluid passages 66 and 67 are disposed to discharge the hydraulic fluid in either the first fluid passage 61 or the second fluid passage 62. This facilitates warm-up of the first fluid passage 61 and the second fluid passage 62.

In particular, the brake switching valve 80*a* is configured as a switching valve that is switchable between the first position 80*a*1 and the second position 80*a*2, and the anti-stall proportional valve 82 is configured as a proportional valve (solenoid proportional valve) having an adjustable opening. With this configuration, switching of the brake switching valve 80*a* and the anti-stall proportional valve 82 facilitates warm-up of the first fluid passage 61 and the second fluid passage 62.

For example, the controller 90 controls the brake switching valve 80*a* (first activation valve) and the anti-stall proportional valve 82 (second activation valve) to guide the hydraulic fluid in the first fluid passage 61 or the second fluid passage 62 to the discharge fluid passage 66 or 67 through the third fluid passage 63 to warm up the hydraulic fluid.

To warm up the first fluid passage 61 and the second fluid passage 62, the controller 90 closes the anti-stall proportional valve 82 (second activation valve) and switches the brake switching valve 80*a* (first activation valve) to the second position 80*a*2. Accordingly, the hydraulic fluid in the first fluid passage 61 flows to the second fluid passage 62 through the third fluid passage 63 and is discharged from the discharge port 82*b*3 of the anti-stall proportional valve 82 to the discharge fluid passage 67. This makes it possible to warm up the hydraulic fluid while causing the working machine 1 to travel at the first speed stage.

Conversely, when the brake switching valve 80*a* is set to the first position 80*a*1 and the anti-stall proportional valve 82 is opened, the hydraulic fluid in the second fluid passage 62 flows to the first fluid passage 61 through the third fluid passage 63 and is discharged from the discharge port of the brake switching valve 80*a* to the discharge fluid passage 66. This flow of the hydraulic fluid also allows warm-up of the first fluid passage (brake fluid passage) 61 and the second fluid passage (travel fluid passage) 62.

Setting the relationship between the switching of the brake switching valve 80*a* and the opening (pressure) of the anti-stall proportional valve 82 in the manner described above enables the hydraulic fluid in the first fluid passage 61 or the second fluid passage 62 to flow to the discharge port of the brake switching valve 80*a* or the discharge port 82*b*3 of the anti-stall proportional valve 82, and facilitates warm-up.

In a hydraulic circuit as illustrated in FIG. 3, which is formed by using the anti-stall proportional valve 82, which is a proportional valve, and the brake switching valve 80*a*, which is a switching valve, the controller 90 performs the warm-up control described above, which is referred to as a warm-up mode. Upon exiting the warm-up mode, the controller 90 makes a transition to control for normal operation in which the working machine 1 travels and performs work, which is referred to as a normal mode. In the normal mode, the controller 90 controls the hydraulic system for the traveling system and the hydraulic system for the working system of the working machine 1 so that the working machine 1 can travel and perform work. Hereinafter, the anti-stall proportional valve 82 and the brake switching valve 80*a* may be each referred to "activation valve".

Figure 5:
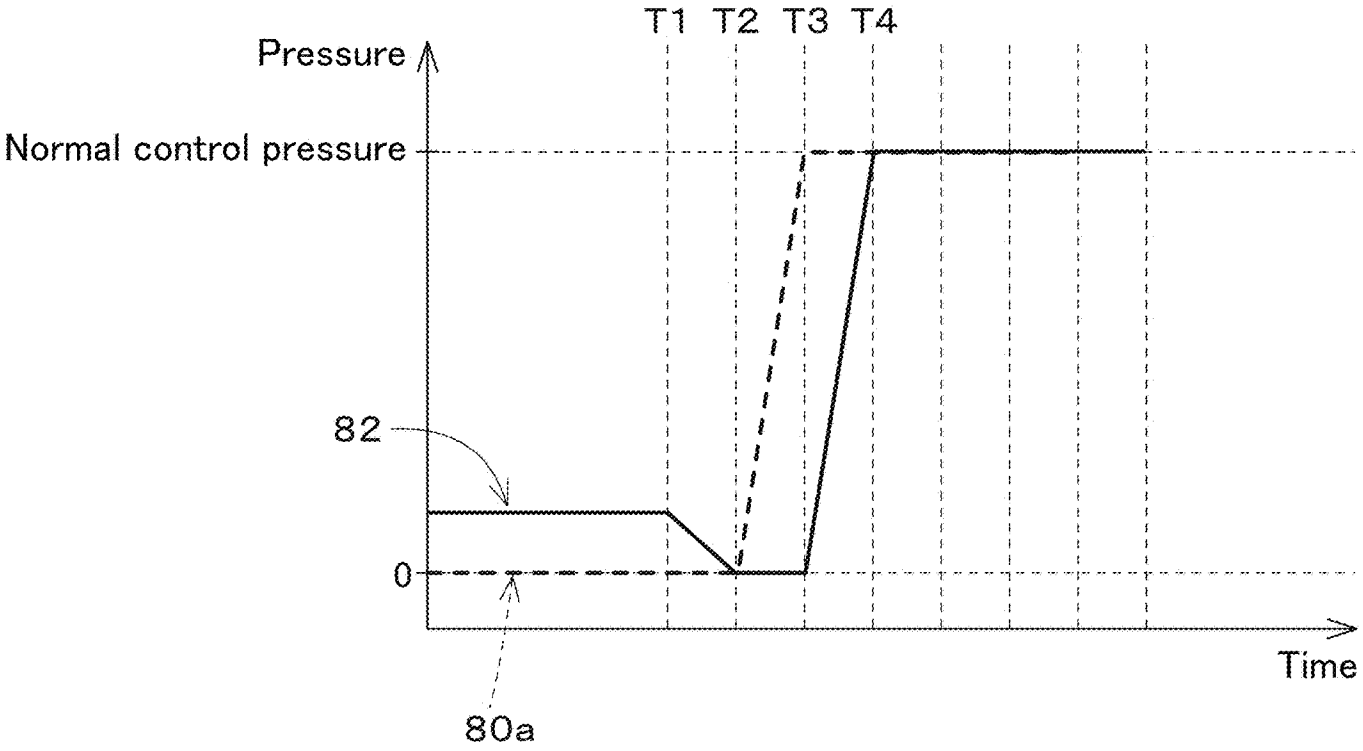
FIG. 5 is a timing chart illustrating a change in pressure across a proportional valve and a change in pressure across a switching valve according to the first preferred embodiment of the present invention.

The control of the brake switching valve 80*a* (first activation valve) and the anti-stall proportional valve 82 (second activation valve), which is performed by the controller 90 in response to a transition from the warm-up mode to the normal mode, will be described with reference to FIGS. 3 and 5. FIG. 5 is a timing chart illustrating a change in pressure across the anti-stall proportional valve 82, which is a proportional valve, and a change in pressure across the brake switching valve 80*a*, which is a switching valve.

In FIG. 3, upon start of the warm-up mode, the controller 90 slightly opens the secondary port 82*b*2, which is an output port (also referred to as an A port), of the anti-stall proportional valve 82, which is a second third activation valve. As a result, the controller 90 increases the pressure of hydraulic fluid at the output port of the anti-stall proportional valve 82 until the pressure becomes equal to a pressure (referred to as a preloading pressure in this preferred embodiment) at which the control target of the anti-stall proportional valve 82 does not operate.

At the same time, the controller 90 switches the brake switching valve 80*a*, which is a first activation valve, to the first position 80*a*1. As a result, the pressure of hydraulic fluid at the output port (also referred to as an A port) of the brake switching valve 80*a* becomes a value lower than the pressure of hydraulic fluid at the output port of the anti-stall proportional valve 82 (that is, the preloading pressure) or becomes zero (0). Hereinafter, the pressure of hydraulic fluid at the output port of the activation valve, which is either the brake switching valve 80*a* or the anti-stall proportional valve 82, is referred to as "output-port pressure".

That is, when the controller 90 starts the warm-up mode, the hydraulic fluid flows from the output port of the anti-stall proportional valve 82, at which the pressure (output-port pressure) has been increased to the preloading pressure, toward the output port of the brake switching valve 80*a*, at which the pressure (output-port pressure) is lower than the preloading pressure, through the fluid passage 63. As illustrated in FIG. 3, the hydraulic fluid, which has reached the output port of the brake switching valve 80*a*, flows into the brake switching valve 80*a* from the output port thereof and is discharged to the discharge fluid passage 66 through the discharge port (also referred to as a tank port) of the brake switching valve 80*a*.

In the warm-up mode, the brake switching valve 80*a*, which is a first activation valve configured as a switching valve, and the anti-stall proportional valve 82, which is a second activation valve configured as a proportional valve, are caused to operate in the way described above, thereby enabling the hydraulic fluid to flow without operating the respective control targets of the activation valves 80*a* and 82. The flow of the hydraulic fluid can increase the temperature of the hydraulic fluid and ensure the maintenance of the fluidity thereof.

Thereafter, to cause the respective control targets of the activation valves 80*a* and 82 to operate, that is, to perform normal operation in which the working machine 1 travels and performs work, it is desirable that the warm-up mode be exited and switched to the normal operation mode. That is, it is desirable that the output-port pressure of the anti-stall proportional valve 82, which has been increased to the preloading pressure, be further increased to a normal control pressure (also simply referred to as a normal pressure) for performing normal operation and that the output-port pressure of the brake switching valve 80*a*, which is lower than the preloading pressure, be also increased to the normal control pressure. In an actual implementation, the opening of the anti-stall proportional valve 82, which is a proportional valve, is increased, and the brake switching valve 80*a*, which is a switching valve, is switched to the second position 80*a*2.

However, if the opening of the anti-stall proportional valve 82 is increased and the brake switching valve 80*a* is switched to the second position 80*a*2 at the same time, a difference occurs between the pressure increase speed of the anti-stall proportional valve 82 and the pressure increase speed of the brake switching valve 80*a*. The difference between the pressure increase speeds makes the pressure between the anti-stall proportional valve 82 and the brake switching valve 80*a* unstable mainly through the fluid passage 63, and consequently makes the pressure of the entire hydraulic circuit unstable. The unstable pressure makes it difficult to correctly control the hydraulic circuit and is desirably prevented.

Accordingly, to appropriately perform switching from the warm-up mode to the normal mode for normal operation, the controller 90 of the hydraulic system according to this preferred embodiment controls the anti-stall proportional valve 82 and the brake switching valve 80*a* so as to achieve the change in pressure as illustrated in FIG. 5.

FIG. 5 is a timing chart illustrating a change in output-port pressure of the anti-stall proportional valve 82 and a change in output-port pressure of the brake switching valve 80*a*. In FIG. 5, a solid line indicates the change in output-port pressure of the anti-stall proportional valve 82, and a broken line indicates the change in output-port pressure of the brake switching valve 80*a*.

Referring to FIG. 5, at time T1, the controller 90 first controls the opening of the anti-stall proportional valve 82 so that the output-port pressure of the anti-stall proportional valve 82 becomes lower than the preloading pressure (for example, the opening of the anti-stall proportional valve 82 is fully closed so that the output-port pressure thereof becomes zero (0)). Immediately thereafter, at time T2 after time T1, the controller 90 switches the brake switching valve 80*a* to the second position 80*a*2. As a result, the output-port pressure of the brake switching valve 80*a* rapidly increases to the normal control pressure at time T3 after time T2.

At time T3, the controller 90 controls the opening of the anti-stall proportional valve 82 (to fully open the opening of the anti-stall proportional valve 82, for example) so that the output-port pressure of the anti-stall proportional valve 82 becomes the normal control pressure. As a result, the output-port pressure of the anti-stall proportional valve 82 also rapidly increases to the normal control pressure at time T4 after time T3. At time T4, both the output-port pressure of the brake switching valve 80*a* and the output-port pressure of the anti-stall proportional valve 82 are equal to the normal control pressure.

In the foregoing description, time T1 and time T2 may be almost simultaneous. Even if time T1 and time T2 are simultaneous, the output-port pressure of the brake switching valve 80*a* starts to increase when the output-port pressure of the anti-stall proportional valve 82 starts to decrease, and thus no moment occurs when the pressures at both output ports simultaneously increase. That is, both the output-port pressures do not compete or interfere with each other, and accordingly time T1 and time T2 may be almost simultaneous.

Further, in FIG. 5, the time at which the output-port pressure of the brake switching valve 80*a* reaches the normal control pressure and the time at which the controller 90 starts to control the opening of the anti-stall proportional valve 82 are both time T3. However, both times need not be matched with time T3 and may be determined as desired. As described above, the control start time is determined such that no moment occurs when the pressures at both the output port of the anti-stall proportional valve 82 and the output port of the brake switching valve 80*a* increase at the same time.

Figure 6:
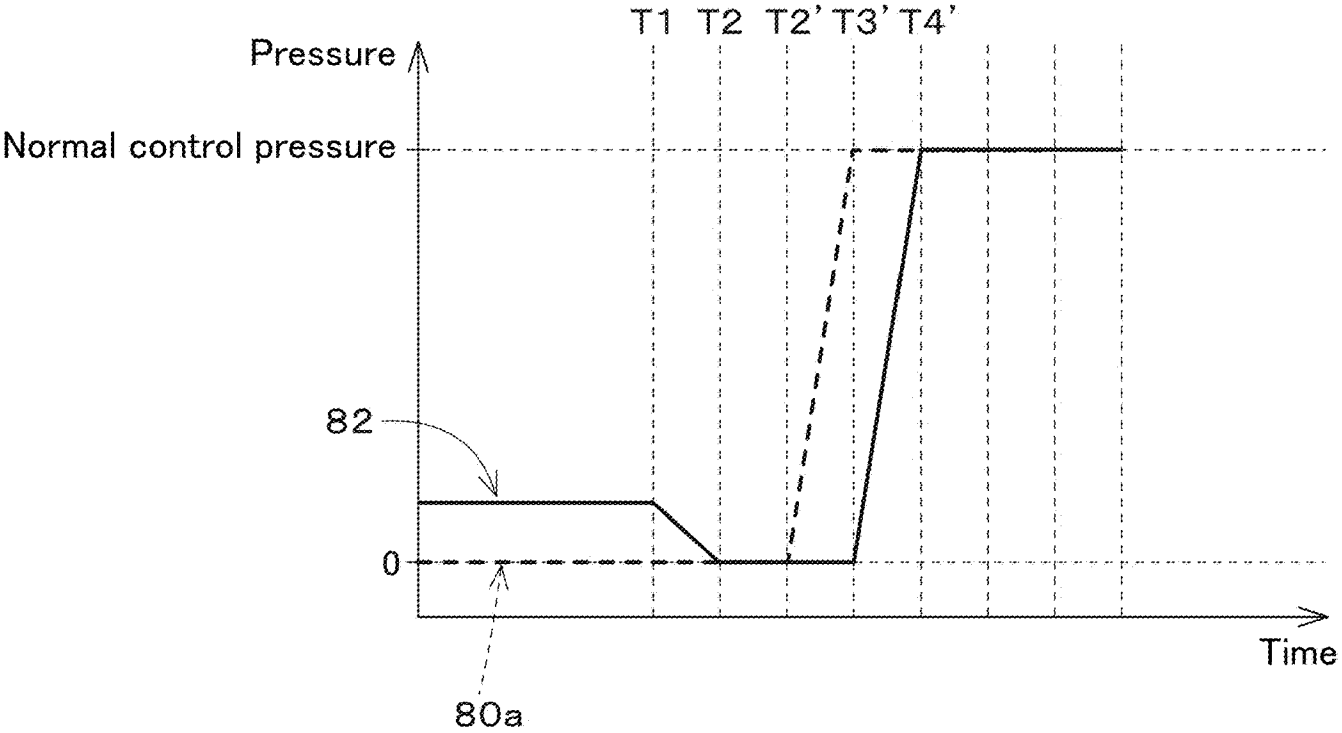
FIG. 6 is a timing chart illustrating a change in pressure across the proportional valve and a change in pressure across the switching valve according to the first preferred embodiment of the present invention.

The controller 90 may control the anti-stall proportional valve 82 and the brake switching valve 80*a* in a manner as illustrated in FIG. 6. Like FIG. 5, FIG. 6 is a timing chart illustrating a change in output-port pressure of the anti-stall proportional valve 82 and a change in output-port pressure of the brake switching valve 80*a*.

Referring to FIG. 6, at time T1, the controller 90 performs control similar to that at time T1 illustrated in FIG. 5. The controller 90 does not switch the brake switching valve 80*a* even at time T2 after time T1, and switches the brake switching valve 80*a* to the second position 80*a*2 at time T2', which is a predetermined time after time T2. As a result, the output-port pressure of the brake switching valve 80*a* rapidly increases to the normal control pressure at time T3' after time T2'.

At time T3', the controller 90 controls the opening of the anti-stall proportional valve 82 so that the output-port pressure of the anti-stall proportional valve 82 becomes the normal control pressure. As a result, the output-port pressure of the anti-stall proportional valve 82 also rapidly increases to the normal control pressure at time T4' after time T3'. At time T4', both the output-port pressure of the brake switching valve 80*a* and the output-port pressure of the anti-stall proportional valve 82 are equal to the normal control pressure.

The control illustrated in FIG. 6 can also achieve the same effect as that of the control illustrated in FIG. 5 for the same reason. In the control illustrated in FIG. 6, the output-port pressure of the brake switching valve 80*a* starts to increase from time T2' at which the output-port pressure of the anti-stall proportional valve 82 has been reduced with certainty. This ensures that no moment occurs when the output-port pressure of the anti-stall proportional valve 82 and the output-port pressure of the brake switching valve 80*a* increase at the same time. In other words, this ensures that both the output-port pressures are prevented from competing or interfering with each other.

The first preferred embodiment of the present invention describes a hydraulic system in which, as illustrated in FIG. 3, a warm-up circuit includes a combination of the anti-stall proportional valve 82 and the brake switching valve 80*a*, that is, a combination of a proportional valve and a switching valve. In a hydraulic system having a warm-up circuit that includes a combination of a proportional valve and a switching valve, the configuration described in this preferred embodiment can prevent the pressure between the proportional valve and the switching valve from becoming unstable in response to switching from the warm-up mode to the normal mode, and consequently prevent the pressure of the entire hydraulic circuit from becoming unstable.

This preferred embodiment is characterized in that the output-port pressure of the anti-stall proportional valve 82, which is a proportional valve, is higher in the normal mode than the preloading pressure in the warm-up mode. The configuration according to this preferred embodiment provides smooth switching from the warm-up mode to the normal mode in the hydraulic circuit having the warm-up circuit that includes a proportional valve having an output port at which the pressure is higher in the normal mode than the preloading pressure in the warm-up mode.

As described above, to control one of activation valves, which are the anti-stall proportional valve 82 and the brake switching valve 80*a*, so that the output-port pressure of the one activation valve becomes lower than the preloading pressure, for example, the controller 90 performs control so as to increase the amount of the hydraulic fluid delivered from the hydraulic pump P1. With this control, the output-port pressure of the other activation valve among the anti-stall proportional valve 82 and the brake switching valve 80*a* is increased. This configuration allows the hydraulic fluid to flow from one of the anti-stall proportional valve 82 and the brake switching valve 80*a* to the other, and allows warm-up of the hydraulic fluid and the hydraulic circuit. At this time, the controller 90 may increase the rotational speed of the prime mover 32, which drives the hydraulic pump P1, to increase the amount of the hydraulic fluid delivered from the hydraulic pump P1.

First Modification

Figure 7:
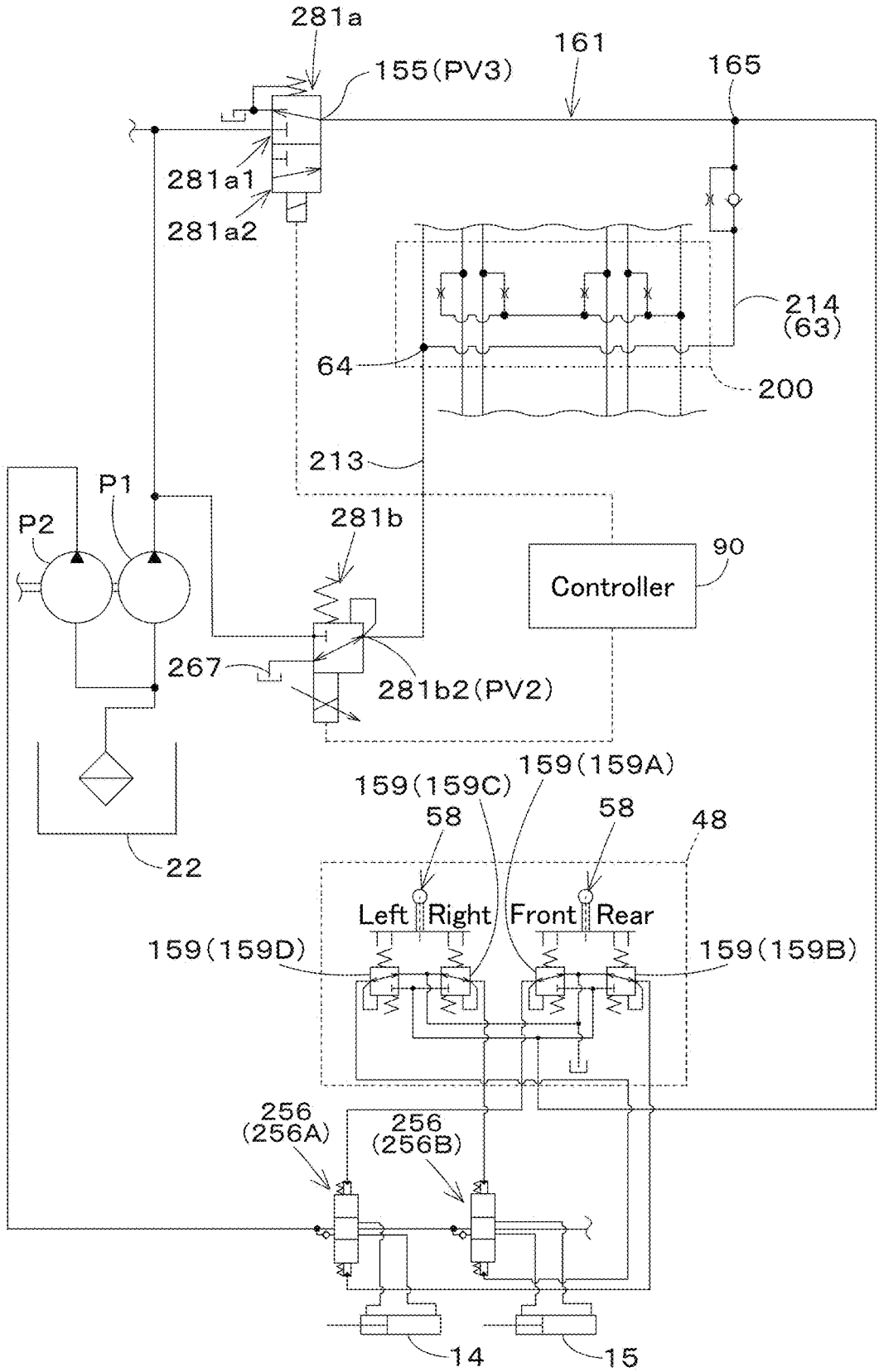
FIG. 7 is a diagram illustrating a hydraulic system (hydraulic fluid passage) for a working system according to a first modification of the first preferred embodiment of the present invention.

A first modification of the first preferred embodiment will be described with reference to FIG. 7. FIG. 7 illustrates a hydraulic system for a working machine according to the first modification of the first preferred embodiment. In the hydraulic system illustrated in FIG. 7, a plurality of control valves 256, including a boom control valve 256A and a bucket control valve 256B, are each referred to as a first hydraulic device, a hydraulic lock switching valve 281*a* is referred to as a first activation valve, the HST pumps (traveling pumps) 52L and 52R are referred to as second hydraulic devices, a plurality of working operation valves 159 (159A, 159B, 159C, and 159D) are each referred to as a third activation valve, and an anti-stall proportional valve 281*b* is referred to as a second activation valve.

The working operation valves 159 and the hydraulic lock switching valve 281*a* are connected by a hydraulic fluid passage 161. The hydraulic fluid passage 161 is provided with a branch point 165, and a branch pipe member 214 is connected to the branch point 165. The branch pipe member 214 is part of a branch fluid passage 63.

The hydraulic lock switching valve 281*a* is a valve capable of stopping supply of the pilot fluid to the working operation valves 159A, 159B, 159C, and 159D. The working operation valves 159A, 159B, 159C, and 159D are included in an operation device 48. The hydraulic lock switching valve 281*a* is a two-position switching valve having a first position 281*a*1 and a second position 281*a*2 and is switchable to either the first position 281*a*1 or the second position 281*a*2.

When the hydraulic lock switching valve 281*a* is switched to the first position 281*a*1, the pilot fluid from the first hydraulic pump P1 is not supplied to the working operation valve 159A, 159B, 159C, or 159D. As a result, the pressures of the hydraulic fluid, which are generated by the working operation valves 159A, 159B, 159C, and 159D, do not act on pressure receivers of a plurality of control valves 256 even if the operation member 58 is operated. This is referred to as a locked state.

When the hydraulic lock switching valve 281*a* is switched to the second position 281*a*2, the pilot fluid from the first hydraulic pump P1 is supplied to the working operation valves 159A, 159B, 159C, and 159D. As a result, the pressures of the pilot fluid, which are generated by the working operation valves 159A, 159B, 159C, and 159D, act on the pressure receivers of the plurality of control valves 256 in accordance with the operation of the operation member 58. This is referred to as an unlocked state. The configuration of the working operation valves 159A, 159B, 159C, and 159D is similar to the configuration of the operation valves (travel operation valves) 55*a*, 55*b*, 55*c*, and 55*d* described above, and thus the description thereof will be omitted.

The plurality of control valves 256 include a boom control valve 256A and a bucket control valve 256B. The boom control valve 256A is a valve that controls the hydraulic cylinders (boom cylinders) 14 that control the booms 10. The bucket control valve 256B is a valve that controls the hydraulic cylinders (bucket cylinders) 15 that control the bucket 11.

The boom control valve 256A and the bucket control valve 256B are each a pilot-type direct-acting spool three-position switching valve. The boom control valve 256A and the bucket control valve 256B are each switched to any one of a neutral position, a first position different from the neutral position, and a second position different from the neutral position and the first position in accordance with the pilot pressure. The boom cylinders 14 are connected to the boom control valve 256A through a fluid passage, and the bucket cylinders 15 are connected to the bucket control valve 256B through a fluid passage.

When the operation member 58 is tilted to the front, the lowering pilot valve (working operation valve) 159A is operated, and a pilot pressure of the pilot fluid to be output from the lowering working operation valve 159A is set. The pilot pressure acts on a pressure receiver of the boom control valve 256A, and the boom cylinders 14 contract. As a result, the booms 10 are lowered.

When the operation member 58 is tilted to the rear, the raising pilot valve (working operation valve) 159B is operated, and a pilot pressure of the pilot fluid to be output from the raising working operation valve 159B is set. The pilot pressure acts on a pressure receiver of the boom control valve 256A, and the boom cylinders 14 extend. As a result, the booms 10 are raised.

When the operation member 58 is tilted to the right, the pilot valve (working operation valve) 159C for bucket dumping is operated, and a pilot pressure of the pilot fluid to be output from the working operation valve 159C is set. The pilot pressure acts on a pressure receiver of the bucket control valve 256B, and the bucket cylinders 15 extend. As a result, the bucket 11 performs a dumping operation.

When the operation member 58 is tilted to the left, the pilot valve (working operation valve) 159D for bucket shoveling is operated, and a pilot pressure of the pilot fluid to be output from the working operation valve 159D is set. The pilot pressure acts on a pressure receiver of the bucket control valve 256B, and the bucket cylinders 15 contract. As a result, the bucket 11 performs a shoveling operation.

In the warm-up mode, the controller 90 controls the hydraulic lock switching valve 281*a* and the anti-stall proportional valve 281*b* to warm up the pilot fluid. In a mode other than the warm-up mode, as described above, when the hydraulic lock switching valve 281*a* is in the second position (application position) 281*a*2, the controller 90 performs anti-stall control based on the engine rotational speed (FIG. 4).

When the warm-up mode is set, the controller 90 sets a differential pressure that is a difference between a hydraulic lock set pressure (first set pressure) PV3 set by the hydraulic lock switching valve 281*a* and a set pressure (second set pressure at an output port 281*b*2 of the anti-stall proportional valve 281*b*) PV2 set by the anti-stall proportional valve 281*b*. The hydraulic lock set pressure (first set pressure) PV3 is, for example, the pressure at an output port 155 of the hydraulic lock switching valve 281*a*. In other words, the first set pressure PV3 is a pressure acting on the hydraulic fluid passage 161.

The controller 90 controls the hydraulic lock switching valve 281*a* and the anti-stall proportional valve 281*b* so as to generate a differential pressure that is a difference between the first set pressure PV3 and the second set pressure PV2. For example, in the warm-up mode for performing warm-up, the controller 90 sets the first set pressure PV3 of the hydraulic lock switching valve 281*a* to be lower than the second set pressure PV2 of the anti-stall proportional valve 281*b*. In other words, in the warm-up mode, the controller 90 sets the second set pressure PV2 of the anti-stall proportional valve 281*b* to be higher than the first set pressure PV3 of the hydraulic lock switching valve 281*a*.

More specifically, in the warm-up mode, the controller 90 sets the hydraulic lock switching valve 281*a* to the first position (pressure-reducing position) 281*a*1 to set the first set pressure PV3 to a pressure at which hydraulic locking can be performed. In the warm-up mode, furthermore, the controller 90 sets the anti-stall proportional valve 281*b* to the maximum opening to set the second set pressure PV2 to be higher than the first set pressure PV3.

That is, when the hydraulic lock switching valve 281*a* is in a braking state and the anti-stall proportional valve 281*b* is at the maximum opening, the first set pressure PV3 is less than the second set pressure PV2, and the second set pressure PV2 set by the anti-stall proportional valve 281*b* is higher than the first set pressure PV3 set by the hydraulic lock switching valve 281*a*.

In other words, when the hydraulic lock switching valve 281*a* is in the first position (pressure-reducing position) 281*a*1, the anti-stall proportional valve 281*b* sets the pressure of the pilot fluid to be applied to a main pipe member 213 included in a relay member 200, which is to be connected to the operation valves 55 (55*a*, 55*b*, 55*c*, and 55*d*), to be higher than the pressure to be applied to the hydraulic fluid passage 161 when the hydraulic lock switching valve 281*a* is in the first position (pressure-reducing position) 281*a*1. With the operation described above, the hydraulic fluid can be circulated by operation of the hydraulic lock switching valve 281*a* and the anti-stall proportional valve 281*b*.

For example, to warm up the hydraulic fluid passage 161 and the main pipe member 213, the controller 90 closes the anti-stall proportional valve 281*b* (second activation valve) and switches the hydraulic lock switching valve 281*a* (first activation valve) to the second position 281*a*2. Accordingly, the hydraulic fluid in the hydraulic fluid passage (first fluid passage) 161 is caused to flow to the main pipe member 213, which is a second fluid passage, through the branch pipe member 214, which is a third fluid passage, and is discharged from the discharge port of the anti-stall proportional valve 281*b* to a discharge fluid passage 267. This makes it possible to warm up the hydraulic fluid while causing the working machine 1 to travel at the first speed stage.

Conversely, when the hydraulic lock switching valve 281*a* is set to the first position 281*a*1 and the anti-stall proportional valve 281*b* is opened, the hydraulic fluid in the main pipe member 213, which is a second fluid passage, can be caused to flow to the hydraulic fluid passage 161, which is a first fluid passage, through the branch pipe member 214, which is a third fluid passage, and can be discharged from the discharge port of the hydraulic lock switching valve 281*a* to the discharge fluid passage. This flow of the hydraulic fluid also allows warm-up of the first fluid passage (hydraulic fluid passage) and the second fluid passage (travel fluid passage).

Setting the relationship between the switching of the hydraulic lock switching valve 281*a* and the opening (pressure) of the anti-stall proportional valve 281*b* in the manner described above enables the hydraulic fluid in the hydraulic fluid passage (first fluid passage) 161 or the main pipe member 213, which is a second fluid passage, to flow to the discharge port of the hydraulic lock switching valve 281*a* or the discharge port of the anti-stall proportional valve 281*b*, and facilitates warm-up.

In a hydraulic circuit as illustrated in FIG. 7, which is formed by using the anti-stall proportional valve 281*b*, which is a proportional valve, and the hydraulic lock switching valve 281*a*, which is a switching valve, the controller 90 performs the warm-up control described above, which is referred to as a warm-up mode. Upon exiting the warm-up mode, the controller 90 makes a transition to control for normal operation in which the working machine 1 travels and performs work, which is referred to as a normal mode.

The control of the hydraulic lock switching valve 281*a* (first activation valve) and the anti-stall proportional valve 281*b* (second activation valve), which is performed by the controller 90 in response to a transition from the warm-up mode to the normal mode, is similar to the control according to the first preferred embodiment described above with reference to FIGS. 3 and 5. That is, in the switching control to the normal mode according to the first preferred embodiment, the brake switching valve 80*a* is read as the hydraulic lock switching valve 281*a*, and the anti-stall proportional valve 82 is read as the anti-stall proportional valve 281*b*, thereby achieving, also in the first modification, switching control to the normal mode in a way similar to that in the first preferred embodiment.

Second Modification

Figure 8:
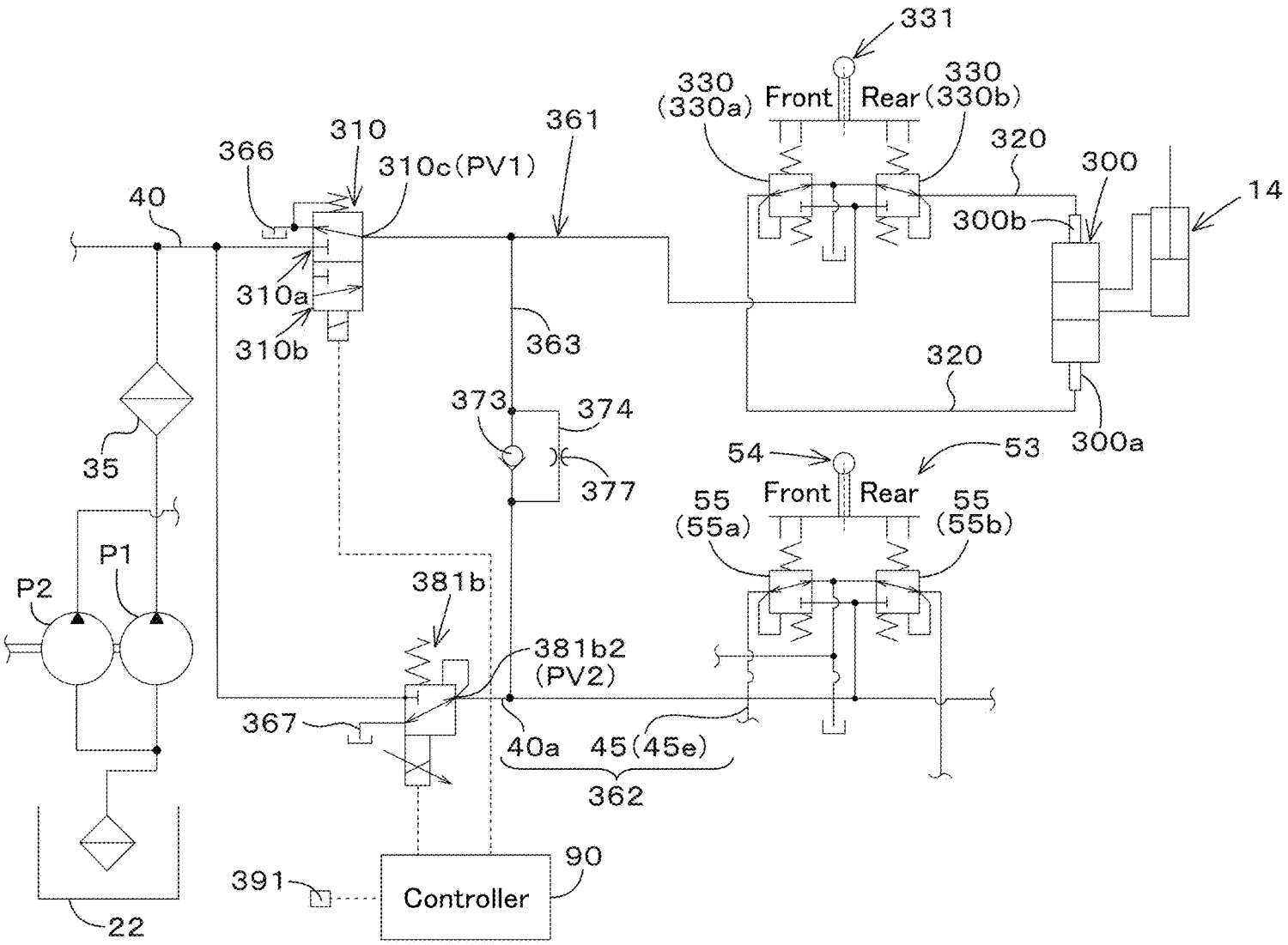
FIG. 8 is a diagram illustrating a hydraulic system (hydraulic fluid passage) for a working system according to a second modification of the first preferred embodiment of the present invention.

A second modification of the first preferred embodiment will be described with reference to FIG. 8. FIG. 8 illustrates a hydraulic system for a working machine according to the second modification of the first preferred embodiment. In the second modification, as illustrated in FIG. 8, a work control valve 300 is referred to as a first hydraulic device, a hydraulic lock switching valve 310 is referred to as a first activation valve, the travel drive mechanism 34 illustrated in FIG. 1 is referred to as a second hydraulic device, and an anti-stall proportional valve 381*b* is referred to as a second activation valve.

The first fluid passage is a fluid passage 361 that connects the first hydraulic device (the work control valve 300) and the first activation valve (the hydraulic lock switching valve 310) that controls the hydraulic fluid to be supplied to the first hydraulic device (the work control valve 300). The second fluid passage is a fluid passage 362 that connects the second hydraulic device (the traveling pumps 52L and 52R of the travel drive mechanism 34 illustrated in FIG. 1) and the second activation valve (the anti-stall proportional valve 381*b*) that controls the hydraulic fluid to be supplied to the second hydraulic device (the traveling pumps 52L and 52R of the travel drive mechanism 34 illustrated in FIG. 1). As in the first preferred embodiment, the second fluid passage 362 includes the section (fluid passage) 40*a* and the travel fluid passage 45. The third fluid passage is a fluid passage 363 that connects the first fluid passage 361 and the second fluid passage 362.

The work control valve 300 is a valve that controls the hydraulic fluid to be supplied to a hydraulic cylinder (work hydraulic actuator) or the like of the working system. The work control valve 300 is, for example, a boom control valve that controls the hydraulic fluid to be supplied to the boom cylinders 14, a bucket control valve that controls the hydraulic fluid to be supplied to the bucket cylinders 15, or the like. While the work control valve 300 will be described as a boom control valve in this preferred embodiment, the work control valve 300 may be a bucket control valve. For convenience of description, the work control valve 300 is referred to as "boom control valve 300".

The boom control valve 300 is, for example, a three-position switching valve. When the boom control valve 300 is operated from the neutral position to one side, the boom control valve 300 supplies the hydraulic fluid to the bottoms of the boom cylinders 14 and discharges the hydraulic fluid discharged from the portions of the boom cylinders 14 where the rods are located to a hydraulic fluid tank or the like to extend the boom cylinders 14.

When the boom control valve 300 is operated from the neutral position to the other side, the boom control valve 300 supplies the hydraulic fluid to the portions of the boom cylinders 14 where the rods are located and discharges the hydraulic fluid discharged from the bottoms of the boom cylinders 14 to a hydraulic fluid tank or the like to contract the boom cylinders 14.

The boom control valve 300 is switched in accordance with the pressure of the pilot fluid (pilot pressure) applied to a pressure receiver 300*a* or 300*b* of the boom control valve 300.

The pressure receivers 300*a* and 300*b* of the boom control valve 300 are each connected to a working fluid passage 320. The working fluid passages 320 are fluid passages that are part of the first fluid passage 361. A plurality of operation valves (working operation valves) 330 (330*a* and 330*b*) are connected to the working fluid passages 320. The plurality of operation valves 330 (330*a* and 330*b*) are valves that apply a predetermined pilot pressure to the plurality of working fluid passages 320, and change the pilot pressure in accordance with the amount of operation of an operation member 331.

For example, when the operation member 331 is swung in one direction, the operation valve 330*a* is operated to output a pilot pressure from the operation valve 330*a*, and the pilot pressure acts on the pressure receiver 300*a* of the boom control valve 300. When the operation member 331 is swung in the other direction, the operation valve 330*b* is operated to output a pilot pressure from the operation valve 330*b*, and the pilot pressure acts on the pressure receiver 300*b* of the boom control valve 300.

That is, in response to an operation of the operation member 331, the pilot pressure output from either of the operation valves 330 is changed, and the boom control valve 300, that is, the boom cylinders 14, can be operated.

The hydraulic lock switching valve 310 is a valve capable of stopping supply of the hydraulic fluid to the operation valves 330*a* and 330*b*. The hydraulic lock switching valve 310 is a two-position switching valve having a first position 310*a* and a second position 310*b* and is switchable to either the first position 310*a* or the second position 310*b*.

When the hydraulic lock switching valve 310 is set to the first position 310*a*, the pilot fluid delivered from the first hydraulic pump P1 does not flow to the first fluid passage 361, and the first fluid passage 361 is connected to a first discharge fluid passage 366.

That is, when the hydraulic lock switching valve 310 is set to the first position 310*a*, the pilot fluid delivered from the first hydraulic pump P1 is not supplied to the operation valve 330*a* or 330*b*, and a pilot pressure generated by the operation valve 330*a* or 330*b* even in response to an operation of the operation member 331 does not act on the boom control valve 300. This is referred to as a locked state.

When the hydraulic lock switching valve 310 is set to the second position 310*b*, the pilot fluid from the first hydraulic pump P1 is supplied to the operation valves 330*a* and 330*b*, and a pilot pressure acts on the boom control valve 300 in response to an operation of either of the operation valve 330*a* or 330*b*. This is referred to as an unlocked state.

A third check valve 373 is connected to the third fluid passage 363. The third check valve 373 allows the flow of the hydraulic fluid from the second fluid passage 362 to the first fluid passage 361 and prevents the flow of the hydraulic fluid from the first fluid passage 361 to the second fluid passage 362. A bypass fluid passage 374 is disposed so as to bypass the third check valve 373. The bypass fluid passage 374 is provided with a throttle 377 for reducing the flow rate of the hydraulic fluid.

In this modification, the controller 90 can make a transition to the warm-up mode when the first operation member 54 of the traveling system is not in operation (when none of the operation valves 55*a* and 55*b* is in operation). The controller 90 increases the opening of the anti-stall proportional valve 381*b* to set the set pressure PV2 of the anti-stall proportional valve 381*b* to be higher than the pressure (set pressure PV1) at an output port 310*c* of the hydraulic lock switching valve 310.

As described above, since the controller 90 increases the opening of the anti-stall proportional valve 381*b* at least when the travel drive mechanism 34 is not in operation, the hydraulic fluid (pilot fluid) in the second fluid passage 362 can be caused to pass through the third fluid passage 363, the bypass fluid passage 374, and the hydraulic lock switching valve 310, and can be discharged from the discharge port of the hydraulic lock switching valve 310 to the first discharge fluid passage 366, which is in communication with the hydraulic fluid tank 22 or the like. That is, in this modification, the hydraulic lock switching valve 310 of the working system can be made to communicate with the anti-stall proportional valve 381*b* by the third fluid passage 363, whereby warm-up can be implemented.

In a case where traveling and working of the working machine 1 are prohibited, that is, in a hydraulic lock mode, the warm-up mode may be set in response to the temperature of the pilot fluid (the hydraulic fluid) detected by a temperature detector 391 becoming equal to or lower than a predetermined temperature. In this case, the hydraulic lock switching valve 310 is switched to the first position 310*a*, and the anti-stall proportional valve 381*b* sets the set pressure PV2, which is determined in advance, to be higher than the set pressure PV1. In a mode other than the warm-up mode, the hydraulic lock switching valve 310 is held in the first position 310*a*, and the anti-stall proportional valve 381*b* is brought into a stop state (a state in which a second discharge fluid passage 367 and the fluid passage 40*a* are in communication).

Also in a situation other than the state where the set pressure PV2 is higher than the set pressure PV1, that is, when the set pressure PV2 of the anti-stall proportional valve 381*b* becomes lower than the pressure (PV1) at the output port 310*c* of the hydraulic lock switching valve 310, the pilot fluid (hydraulic fluid) at an output port (secondary port) 381*b*2 may be discharged to the second discharge fluid passage 367 through the anti-stall proportional valve 381*b*.

Specifically, in a case where only traveling is prohibited among traveling and working of the working machine 1, that is, in a parking mode, the hydraulic lock switching valve 310 is held in the second position 310*b*, and the anti-stall proportional valve 381*b* is in the stop state. As a result, the pilot fluid in the first fluid passage 361 passes through the bypass fluid passage 374 and the fluid passage 40*a* and flows from the anti-stall proportional valve 381*b* to the second discharge fluid passage 367.

In a mode where traveling and working of the working machine 1 are enabled, that is, in a normal operation mode (i.e., the normal mode), the warm-up mode is set in response to the temperature of the pilot fluid detected by the temperature detector 391 becoming equal to or lower than a predetermined temperature. The hydraulic lock switching valve 310 is held in the second position 310*b*, and the set pressure PV2 of the anti-stall proportional valve 381*b* is set to be lower than the pressure (set pressure PV1) at the output port 310*c* of the hydraulic lock switching valve 310. As a result, the pilot fluid in the first fluid passage 361 passes through the bypass fluid passage 374 and the second fluid passage 362 and flows from the anti-stall proportional valve 381*b* to the second discharge fluid passage 367.

The hydraulic system for the working machine 1 includes a work hydraulic actuator, the working control valve 300 that controls hydraulic fluid to be supplied to the working hydraulic actuator, the hydraulic lock switching valve 310 capable of shutting off supply of the hydraulic fluid to the working control valve 300, the traveling pumps 52L and 52R that drive the traveling devices 5 in accordance with the pressure of the hydraulic fluid, the anti-stall proportional valve 381*b* capable of controlling the hydraulic fluid to be supplied to the traveling pumps 52L and 52R, the first fluid passage 361 that connects the working control valve 300 and the hydraulic lock switching valve 310, the second fluid passage 362 that connects the traveling pumps 52L and 52R and the anti-stall proportional valve 381*b*, and the third fluid passage 363 that connects the first fluid passage 361 and the second fluid passage 362. The anti-stall proportional valve 381*b* sets the output-port pressure at an output port 381*b*2 (the set pressure PV2) to a pressure higher than the pressure (the set pressure PV1) set by the hydraulic lock switching valve 310. With this configuration, the anti-stall proportional valve 381*b* enables the hydraulic fluid in the second fluid passage 362 to flow through the third fluid passage 363 and the first fluid passage 361, and warm-up can be implemented.

For example, to warm up the third fluid passage 363 and the first fluid passage 361, the controller 90 closes the anti-stall proportional valve 381*b* (second activation valve) and switches the hydraulic lock switching valve 310 (first activation valve) to the second position 310*b*. Accordingly, the hydraulic fluid in the first fluid passage 361 flows to the second fluid passage 362 through the third fluid passage 363 and is discharged from the discharge port of the anti-stall proportional valve 381*b* to the second discharge fluid passage 367. This makes it possible to warm up the hydraulic fluid while causing the working machine 1 to travel at the first speed stage.

Conversely, when the hydraulic lock switching valve 310 is set to the first position 310*a* and the anti-stall proportional valve 381*b* is opened, the hydraulic fluid in the second fluid passage 362 can be caused to flow to the first fluid passage 361 through the section 40*a* of the delivery fluid passage 40, and can be discharged from the discharge port of the hydraulic lock switching valve 310 to the first discharge fluid passage 366. This flow of the hydraulic fluid also allows warm-up of the first fluid passage (hydraulic fluid passage) and the second fluid passage (travel fluid passage).

Setting the relationship between the switching of the hydraulic lock switching valve 310 and the opening (pressure) of the anti-stall proportional valve 381*b* in the manner described above enables the hydraulic fluid in the first fluid passage 361 or the second fluid passage 362 to flow to the discharge port of the hydraulic lock switching valve 310 or the discharge port of the anti-stall proportional valve 381*b*, and facilitates warm-up.

In a hydraulic circuit as illustrated in FIG. 8, which is formed by using the anti-stall proportional valve 381*b*, which is a proportional valve, and the hydraulic lock switching valve 310, which is a switching valve, the controller 90 performs the warm-up control described above, which is referred to as a warm-up mode. Upon exiting the warm-up mode, the controller 90 makes a transition to control for normal operation in which the working machine 1 travels and performs work, which is referred to as a normal mode.

The control of the hydraulic lock switching valve 310 (first activation valve) and the anti-stall proportional valve 381*b* (second activation valve), which is performed by the controller 90 in response to a transition from the warm-up mode to the normal mode, is similar to the control according to the first preferred embodiment described above with reference to FIGS. 3 and 5. That is, in the switching control to the normal mode according to the first preferred embodiment, the brake switching valve 80*a* is read as the hydraulic lock switching valve 310, and the anti-stall proportional valve 82 is read as the anti-stall proportional valve 381*b*, thereby achieving, also in the second modification, switching control to the normal mode in a way similar to that in the first preferred embodiment.

Third Modification

Figure 9:
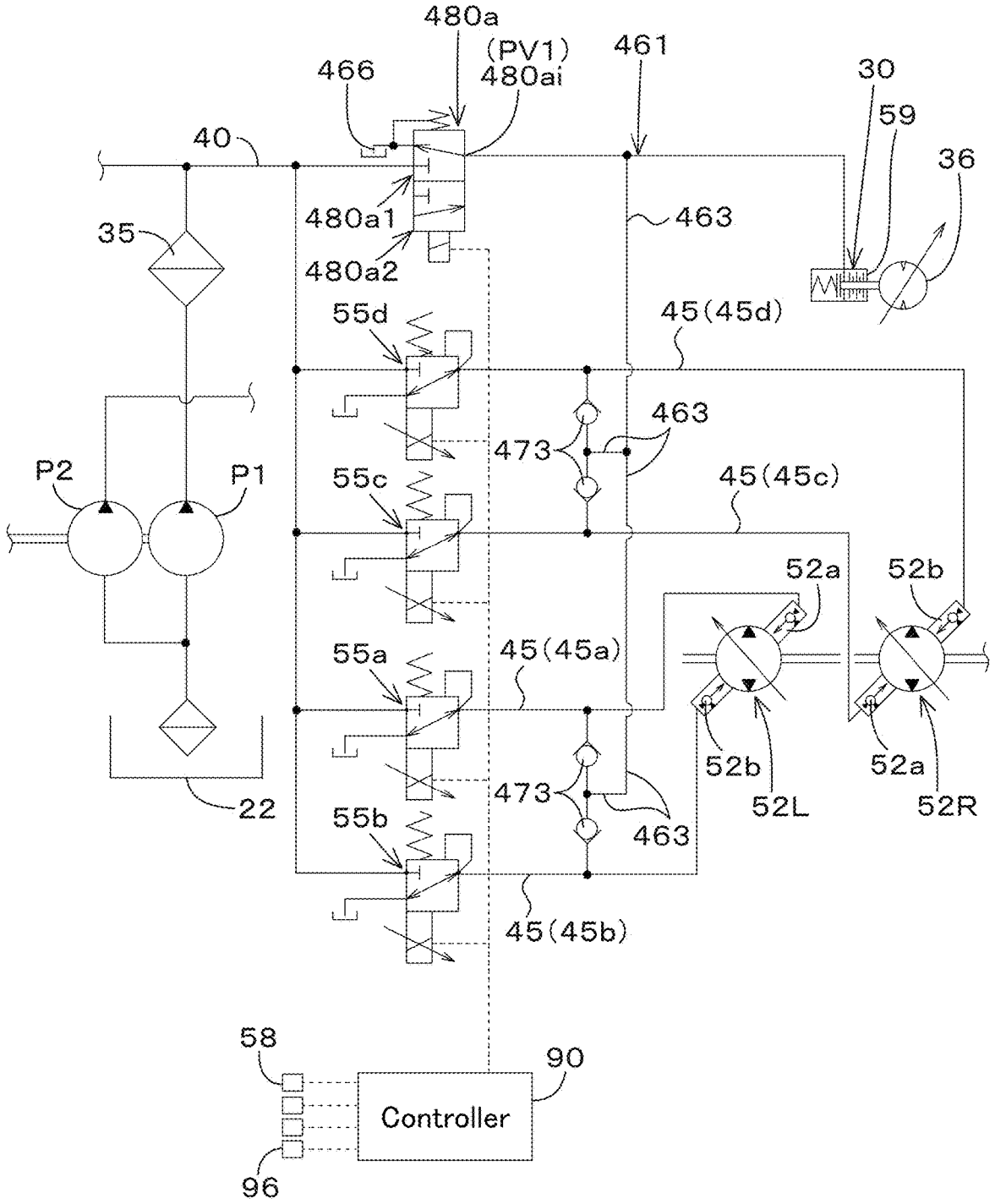
FIG. 9 is a diagram illustrating a hydraulic system (hydraulic fluid passage) for a traveling system according to a third modification of the first preferred embodiment of the present invention.

A third modification of the first preferred embodiment will be described with reference to FIG. 9. FIG. 9 illustrates a hydraulic system for a working machine according to this modification. In this modification, as illustrated in FIG. 9, the brake mechanism 30, which is also illustrated in FIG. 1, is referred to as a first hydraulic device, a brake switching valve 480*a* is referred to as a first activation valve, the traveling pumps 52L and 52R of the travel drive mechanism 34 illustrated in FIG. 1 are referred to as second hydraulic devices, and the plurality of operation valves 55 (55*a*, 55*b*, 55*c*, and 55*d*) are each referred to as a second activation valve. The plurality of operation valves 55 (55*a*, 55*b*, 55*c*, and 55*d*), which are second activation valves, are travel activation valves that control the hydraulic fluid to be supplied to the traveling pumps 52L and 52R.

The first fluid passage is a fluid passage 461 that connects the first hydraulic device (the brake mechanism 30) and the first activation valve (the brake switching valve 480*a*) that controls the hydraulic fluid to be supplied to the first hydraulic device (the brake mechanism 30). The second fluid passage is a travel fluid passage 45 that connects the second hydraulic devices (the traveling pumps 52L and 52R of the travel drive mechanism 34) and the second activation valves (the operation valves 55*a*, 55*b*, 55*c*, and 55*d*) that control the hydraulic fluid to be supplied to the second hydraulic devices (the traveling pumps 52L and 52R of the travel drive mechanism 34). As in FIG. 1, the travel fluid passage 45 includes the first travel fluid passage 45*a*, the second travel fluid passage 45*b*, the third travel fluid passage 45*c*, and the fourth travel fluid passage 45*d*.

The third fluid passage is a fluid passage 463 that connects the first fluid passage 461 and the second fluid passage 45. Check valves 473 are connected to the third fluid passage 463. The check valves 473 allow the flow of the hydraulic fluid from the second fluid passage 45 to the first fluid passage 461 and prevent the flow of the hydraulic fluid from the first fluid passage 461 to the second fluid passage 45.

The operation valves 55*a*, 55*b*, 55*c*, and 55*d* are proportional solenoid valves, and have openings that can be changed in accordance with a control signal from the controller 90. The controller 90 is connected to a swingable operation member 96. When the operation member 96 is operated in a direction corresponding to forward movement, the operation valves 55*a* and 55*c* are opened in accordance with the amount of operation of the operation member 96, and the swash plates of the traveling pumps 52L and 52R are rotated forward. When the operation member 96 is operated in a direction corresponding to rearward movement, the operation valves 55*b* and 55*d* are opened in accordance with the amount of operation of the operation member 96, and the swash plates of the traveling pumps 52L and 52R are rotated in reverse.

When the operation member 96 is operated in a direction corresponding to left turning, the operation valves 55*b* and 55*c* are opened in accordance with the amount of operation of the operation member 96, and the swash plate of the traveling pump 52L is rotated in reverse while the swash plate of the traveling pump 52R is rotated forward. When the operation member 96 is operated in a direction corresponding to right turning, the operation valves 55*a* and 55*d* are opened in accordance with the amount of operation of the operation member 96, and the swash plate of the traveling pump 52L is rotated forward while the swash plate of the traveling pump 52R is rotated in reverse. As described above, the operation valves 55*a*, 55*b*, 55*c*, and 55*d* can be operated in accordance with the operation of the operation member 96.

For example, in the warm-up mode, the controller 90 sets set pressures (set pressures PV2) of the operation valves 55*a*, 55*b*, 55*c*, and 55*d* to be higher than a brake set pressure PV1 of an input port 480*ai* of the brake switching valve 480*a* regardless of the operation of the operation member 96. More specifically, in the warm-up mode, the controller 90 sets the brake switching valve 480*a* to a first position 480*a*1, and increases the openings of the operation valves 55*a*, 55*b*, 55*c*, and 55*d* to set the set pressures (the set pressures PV2) of the operation valves 55*a*, 55*b*, 55*c*, and 55*d* to be higher than the brake set pressure PV1.

That is, when the brake switching valve 480*a* is in the braking state, the set pressures (PV2) corresponding to the openings of the operation valves 55*a*, 55*b*, 55*c* and 55*d* are increased. This enables the hydraulic fluid (pilot fluid) in the travel fluid passage 45 to flow to a first discharge fluid passage 466 through the check valves 473, the third fluid passage 463, the first fluid passage 461, and the brake switching valve 480*a*, whereby the hydraulic fluid can be warmed up.

The set pressures (PV2) of the operation valves 55*a*, 55*b*, 55*c*, and 55*d* may be the same or different. Further, the set pressures (PV2) of the operation valves 55*a*, 55*b*, 55*c*, and 55*d* may be increased to be higher than the brake set pressure PV1 in order instead of simultaneously.

The hydraulic system for the working machine includes the brake mechanism 30, the brake switching valve 480*a*, the traveling pumps 52L and 52R, the operation valves 55*a*, 55*b*, 55*c*, and 55*d*, the first fluid passage 461 that connects the brake mechanism 30 and the brake switching valve 480*a*, the second fluid passage 45 that connects the traveling pumps 52L and 52R and the operation valves 55*a*, 55*b*, 55*c*, and 55*d*, and the third fluid passage 463 that connects the first fluid passage 461 and the second fluid passage 45. With this configuration, the operation valves 55*a*, 55*b*, 55*c*, and 55*d* enable the hydraulic fluid in the second fluid passage 45 to flow to the brake switching valve 480*a* through the third fluid passage 463 and the first fluid passage 461, and warm-up can be implemented.

For example, to warm up the third fluid passage 463 and the first fluid passage 461, the controller 90 closes the operation valves 55*a*, 55*b*, 55*c*, and 55*d* (second activation valves) and switches the brake switching valve 480*a* (first activation valve) to a second position 480*a*2. As a result, the hydraulic fluid in the first fluid passage 461 can be discharged to discharge fluid passages from discharge ports of the operation valves 55*a*, 55*b*, 55*c*, and 55*d* through the third fluid passage 463. This flow of the hydraulic fluid allows warm-up of the first fluid passage (hydraulic fluid passage) and the second fluid passage (travel fluid passage).

Conversely, when the brake switching valve 480*a* is switched to the first position 480*a*1 and the operation valves 55*a*, 55*b*, 55*c*, and 55*d* are opened, the hydraulic fluid flows to the travel fluid passage 45 through the delivery fluid passage 40 and the operation valves 55*a*, 55*b*, 55*c*, and 55*d*. The hydraulic fluid can further be caused to flow through the check valves 473 and the third fluid passage 463, and can be discharged to the first discharge fluid passage 466 from the discharge port of the brake switching valve 480*a*. This flow of the hydraulic fluid also allows warm-up of the first fluid passage (hydraulic fluid passage) and the second fluid passage (travel fluid passage).

Setting the relationship between the switching of the brake switching valve 480*a* and the openings (pressures) of the operation valves 55*a*, 55*b*, 55*c*, and 55*d* in the manner described above enables the hydraulic fluid in the first fluid passage 461 or the third fluid passage 463 to flow to the discharge port of the brake switching valve 480*a* or the discharge ports of the operation valves 55*a*, 55*b*, 55*c*, and 55*d*, and facilitates warm-up.

In a hydraulic circuit as illustrated in FIG. 9, which is formed by using the operation valves 55*a*, 55*b*, 55*c*, and 55*d*, which are proportional valves, and the brake switching valve 480*a*, which is a switching valve, the controller 90 performs the warm-up control described above, which is referred to as a warm-up mode. Upon exiting the warm-up mode, the controller 90 makes a transition to control for normal operation in which the working machine 1 travels and performs work, which is referred to as a normal mode.

The control of the brake switching valve 480*a* (first activation valve) and the operation valves 55*a*, 55*b*, 55*c*, and 55*d* (second activation valves), which is performed by the controller 90 in response to a transition from the warm-up mode to the normal mode, is similar to the control according to the first preferred embodiment described above with reference to FIGS. 3 and 5. That is, in the switching control to the normal mode according to the first preferred embodiment, the brake switching valve 80*a* is read as the brake switching valve 480*a* according to this modification, and the anti-stall proportional valve 82 is read as the operation valves 55*a*, 55*b*, 55*c*, and 55*d*, thereby achieving, also in the third modification, switching control to the normal mode in a way similar to that in the first preferred embodiment.

Fourth Modification

Figure 10:
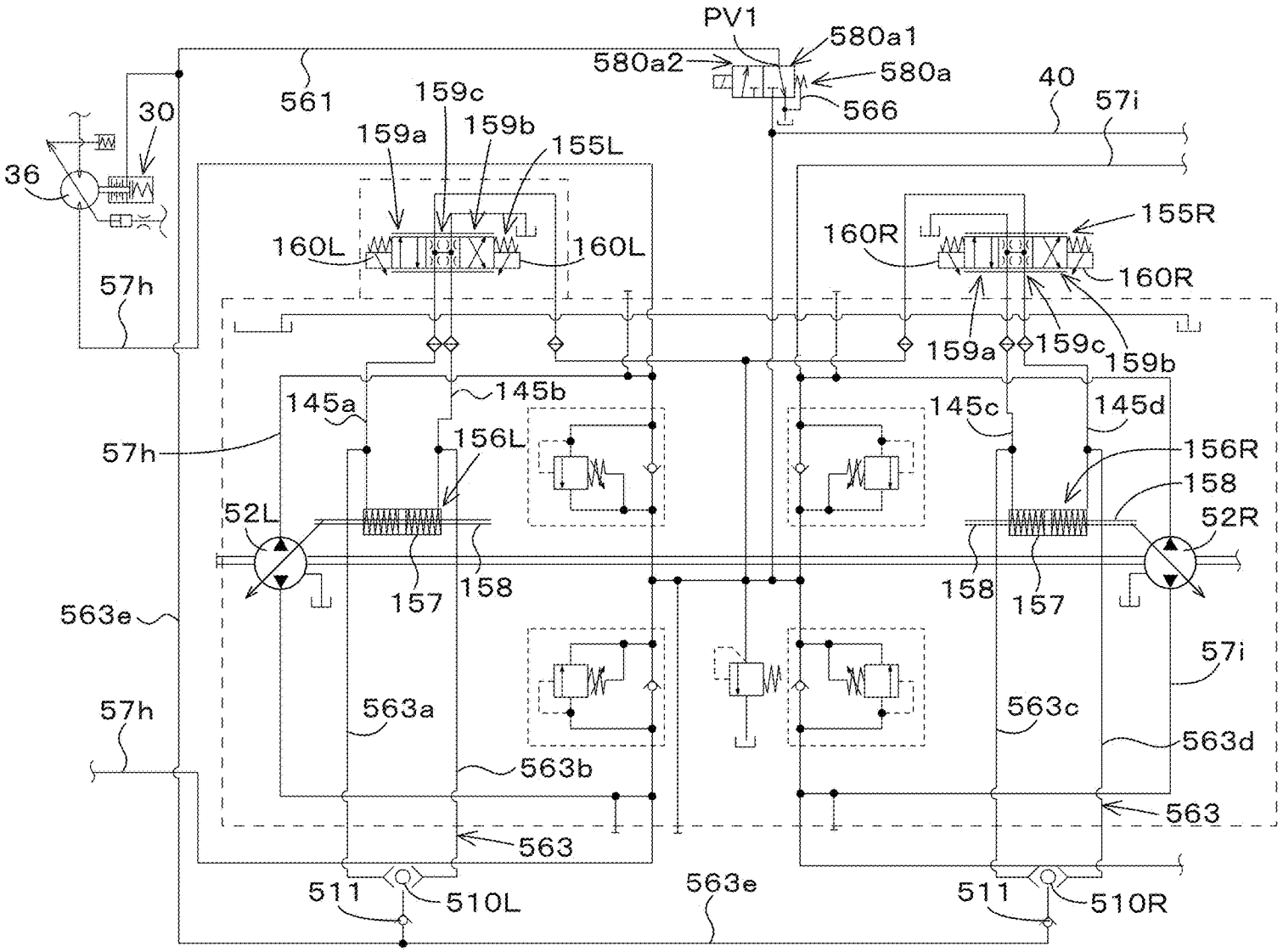
FIG. 10 is a diagram illustrating a hydraulic system (hydraulic fluid passage) for a traveling system according to a fourth modification of the first preferred embodiment of the present invention.

A fourth modification of the first preferred embodiment will be described with reference to FIG. 10. FIG. 10 illustrates a hydraulic system for a working machine according to this modification. The hydraulic system illustrated in FIG. 10 is a hydraulic system for a traveling system, and includes traveling pumps 52L and 52R and operation valves 155L and 155R.

The traveling pumps 52L and 52R include regulators 156L and 156R, respectively. The regulators 156L and 156R are capable of changing angles of swash plates (swash-plate angles) of the traveling pumps 52L and 52R, respectively. Each of the regulators 156L and 156R includes a supply chamber 157 to which the hydraulic fluid can be supplied, and a piston rod 158 disposed in the supply chamber 157. The piston rods 158 of the regulators 156L and 156R are coupled to the respective swash plates. In response to an activation of each of the piston rods 158, the swash-plate angle of the corresponding one of the traveling pumps 52L and 52R can be changed.

The operation valve 155L is a valve that operates the regulator 156L, that is, a valve that controls the hydraulic fluid to be supplied to the traveling pump 52L. The operation valve 155L is a solenoid valve configured such that, in accordance with a control signal given from the controller 90 to a solenoid 160L, a spool of the operation valve 155L is moved and the opening of the operation valve 155L is changed in response to the movement of the spool. The operation valve 155L is switchable to any one of a first position 159*a*, a second position 159*b*, and a neutral position 159*c*.

The operation valve 155L has a first port connected to the supply chamber 157 of the regulator 156L through a first travel fluid passage 145*a*. The operation valve 155L has a second port connected to the supply chamber 157 of the regulator 156L through a second travel fluid passage 145*b*.

The operation valve 155R is a valve that operates the regulator 156R, that is, a valve that controls the hydraulic fluid to be supplied to the traveling pump 52R. The operation valve 155R is a solenoid valve configured such that, in accordance with a control signal given from the controller 90 to a solenoid 160R, a spool of the operation valve 155R is moved and the opening of the operation valve 155R is changed in response to the movement of the spool. The operation valve 155R is switchable to any one of a first position 159*a*, a second position 159*b*, and a neutral position 159*c*.

The operation valve 155R has a first port connected to the supply chamber 157 of the hydraulic regulator 156R through a third travel fluid passage 145*c*. The operation valve 155R has a second port connected to the supply chamber 157 of the hydraulic regulator 156R through a fourth travel fluid passage 145*d*.

When the operation valve 155L and the operation valve 155R are switched to the first position 159*a*, the swash plates of the traveling pumps 52L and 52R rotate forward. When the operation valve 155L and the operation valve 155R are switched to the second position 159*b*, the swash plates of the traveling pumps 52L and 52R rotate in reverse. When the operation valve 155L is switched to the first position 159*a* and the operation valve 155R is switched to the second position 159*b*, the swash plate of the traveling pump 52L rotates forward while the swash plate of the traveling pump 52R rotates in reverse.

When the operation valve 155L is switched to the second position 159*b* and the operation valve 155R is switched to the first position 159*a*, the swash plate of the traveling pump 52L rotates in reverse while the swash plate of the traveling pump 52R rotates forward. Accordingly, the operation valve 155L and the operation valve 155R are each one of travel activation valves capable of switching the swash plates of the traveling pumps 52L and 52R to position for either forward rotation or reverse rotation.

The hydraulic system for the working machine according to this modification can implement warm-up in response to switching between a brake switching valve 580*a* and the operation valves 155L and 155R. As illustrated in FIG. 10, the brake mechanism 30 is referred to as a first hydraulic device, the brake switching valve 580*a* is referred to as a first activation valve, the traveling pumps 52L and 52R are referred to as second hydraulic devices, and the operation valve 155L and the operation valve 155R are referred to as second activation valves.

The first fluid passage is a fluid passage 561 that connects the first hydraulic device (the brake mechanism 30) and the first activation valve (the brake switching valve 580*a*) that controls the hydraulic fluid to be supplied to the first hydraulic device (the brake mechanism 30). The second fluid passage is a travel fluid passage (the first travel fluid passage 145*a*, the second travel fluid passage 145*b*, the third travel fluid passage 145*c*, and the fourth travel fluid passage 145*d*) that connects the second hydraulic devices (the traveling pumps 52L and 52R of the travel drive mechanism 34 illustrated in FIG. 1) and the second activation valves (the operation valves 155L and 155R) that control the hydraulic fluid to be supplied to the second hydraulic devices (the traveling pumps 52L and 52R of the travel drive mechanism 34 illustrated in FIG. 1).

The third fluid passage is a fluid passage 563 that connects the first fluid passage 561 and the second fluid passage (the first travel fluid passage 145*a*, the second travel fluid passage 145*b*, the third travel fluid passage 145*c*, and the fourth travel fluid passage 145*d*). The third fluid passage 563 includes a fluid passage 563*a* connected to the first travel fluid passage 145*a*, a fluid passage 563*b* connected to the second travel fluid passage 145*b*, a fluid passage 563*c* connected to the third travel fluid passage 145*c*, and a fluid passage 563*d* connected to the fourth travel fluid passage 145*d*. The third fluid passage 563 further includes a fluid passage 563*e* into which the fluid passages 563*a*, 563*b*, 563*c*, and 563*d* merge.

The fluid passage 563*a* and the fluid passage 563*b* merge at a merging point to which a high-pressure selection valve 510L is connected. The fluid passage 563*c* and the fluid passage 563*d* merge at a merging point to which a high-pressure selection valve 510R is connected. The fluid passage 563*e* has a first end portion that is branched into two portions, to each of which a corresponding one of the high-pressure selection valves 510L and 510R is connected, and a second end portion connected to the first fluid passage 561. Check valves 511 are connected to the two portions of the fluid passage 563*e* at positions closer to the first fluid passage 561 than the high-pressure selection valves 510L and 510R such that each of the check valves 511 corresponds to a corresponding one of the high-pressure selection valves 510L and 510R. The check valves 511 allow the flow of the hydraulic fluid from the high-pressure selection valve 510L and 510R to the first fluid passage 561 and prevent the flow of the hydraulic fluid from the first fluid passage 561 to the high-pressure selection valve 510L and 510R.

For example, in the warm-up mode, the controller 90 controls the operation valve 155L and the operation valve 155R such that set pressures (PV2) of the operation valve 155L and the operation valve 155R become higher than a brake set pressure PV1 of the brake switching valve 580*a*. More specifically, in the warm-up mode, the controller 90 sets the brake switching valve 580*a* to a first position 580*a*1 and switches the operation valve 155L and the operation valve 155R to the first position 159*a* to set the set pressures (PV2) of the operation valve 155L and the operation valve 155R to be higher than the brake set pressure PV1. That is, when the brake switching valves 580*a* are in the braking state, increasing the openings of the operation valves 155L and 155R enables the hydraulic fluid (pilot fluid) in the first travel fluid passage 145*a*, the second travel fluid passage 145*b*, the third travel fluid passage 145*c*, and the fourth travel fluid passage 145*d* to flow to a first discharge fluid passage 566 through the high-pressure selection valves 510L and 510R, the third fluid passage 563, the first fluid passage 561, and the brake switching valves 580*a*. As a result, the hydraulic fluid can be warmed up.

In the warm-up mode, as a non-limiting example of the switching of the operation valve 155L and the operation valve 155R, the controller 90 may switch the operation valve 155L and the operation valve 155R to the second position 159*b*, or switch one of the operation valve 155L and the operation valve 155R to the first position 159*a* and the other to the second position 159*b*.

For example, to warm up the third fluid passage 563 and the first fluid passage 561, the controller 90 closes the operation valves 155L and 155R (second activation valves) and switches the brake switching valve 580*a* (first activation valve) to a second position 580*a*2. Accordingly, the hydraulic fluid in the first fluid passage 561 is caused to flow through the third fluid passage 563 and is discharged from discharge ports of the operation valve 155L and the operation valve 155R to discharge fluid passages. This makes it possible to warm up the hydraulic fluid while causing the working machine 1 to travel at the first speed stage.

Conversely, when the brake switching valve 580*a* is switched to the first position 580*a*1 and the operation valve 155L and the operation valve 155R are opened, the hydraulic fluid flows from the delivery fluid passage 40 to the third fluid passage 563 through the operation valve 155L and the operation valve 155R. The hydraulic fluid can further be caused to flow through the high-pressure selection valves 510L and 510R and the check valves 511, and can be discharged to the first discharge fluid passage 566 from a discharge port of the brake switching valve 580*a*. This flow of the hydraulic fluid also allows warm-up of the first fluid passage (hydraulic fluid passage) and the second fluid passage (travel fluid passage).

Setting the relationship between the switching of the brake switching valve 580*a* and the openings (pressures) of the operation valves 155L and 155R in the manner described above enables the hydraulic fluid in the first fluid passage 561 or the third fluid passage 563 to flow to the discharge port of the brake switching valve 580*a* or the discharge ports of the operation valves 155L and 155R, and facilitates warm-up.

In a hydraulic circuit as illustrated in FIG. 10, which is formed by using the operation valves 155L and 155R, which are proportional valves, and the brake switching valve 580*a*, which is a switching valve, the controller 90 performs the warm-up control described above, which is referred to as a warm-up mode. Upon exiting the warm-up mode, the controller 90 makes a transition to control for normal operation in which the working machine 1 travels and performs work, which is referred to as a normal mode.

The control of the brake switching valve 580*a* (first activation valve) and the operation valves 155L and 155R (second activation valves), which is performed by the controller 90 in response to a transition from the warm-up mode to the normal mode, is similar to the control according to the first preferred embodiment described above with reference to FIGS. 3 and 5. That is, in the switching control to the normal mode according to the first preferred embodiment, the brake switching valve 80*a* is read as the brake switching valve 580*a* according to this modification, and the anti-stall proportional valve 82 is read as the operation valves 155L and 155R, thereby achieving, also in the fourth modification, switching control to the normal mode in a way similar to that in the first preferred embodiment.

Fifth Modification

Figure 11:
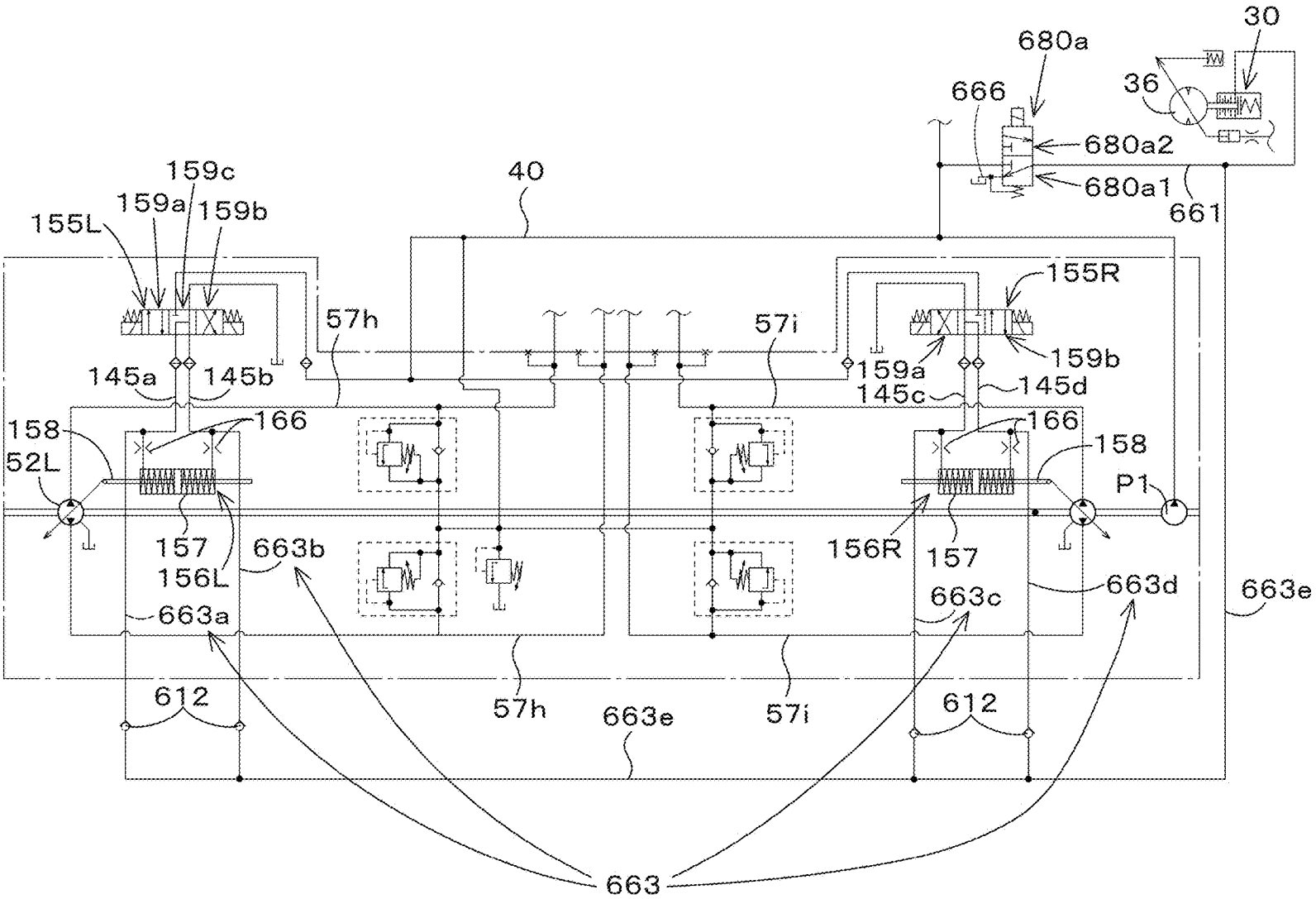
FIG. 11 is a diagram illustrating a hydraulic system (hydraulic fluid passage) for a traveling system according to a fifth modification of the first preferred embodiment of the present invention.

A fifth modification of the first preferred embodiment will be described with reference to FIG. 11. FIG. 11 illustrates a hydraulic system for a working machine according to this modification. In FIG. 11, a configuration similar to that of the preferred embodiment described above and the fourth modification will not be described.

As illustrated in FIG. 11, a third fluid passage 663 includes a fluid passage 663*a* connected to the first travel fluid passage 145*a*, a fluid passage 663*b* connected to the second travel fluid passage 145*b*, a fluid passage 663*c* connected to the third travel fluid passage 145*c*, and a fluid passage 663*d* connected to the fourth travel fluid passage 145*d*. The third fluid passage 663 further includes a fluid passage 663*e* into which the fluid passages 663*a*, 663*b*, 663*c*, and 663*d* merge. A check valve 612 is connected to each of the fluid passages 663*a*, 663*b*, 663*c*, and 663*d*. The check valves 612 allow the flow of the hydraulic fluid from the second fluid passage (the first travel fluid passage 145*a*, the second travel fluid passage 145*b*, the third travel fluid passage 145*c*, and the fourth travel fluid passage 145*d*) to a first fluid passage 661 and prevent the flow of the hydraulic fluid from the first fluid passage 661 to the second fluid passage.

Also in this modification illustrated in FIG. 11, in the warm-up mode, the controller 90 switches the operation valve 155L and the operation valve 155R to cause the hydraulic fluid in the second fluid passage to flow to the first fluid passage 661 through the third fluid passage 663, whereby warm-up can be implemented.

In a hydraulic circuit according to this modification illustrated in FIG. 11, each of the first travel fluid passage 145*a*, the second travel fluid passage 145*b*, the third travel fluid passage 145*c*, and the fourth travel fluid passage 145*d* is provided with a throttle 166 for reducing the flow rate of the hydraulic fluid. Since the throttles 166 reduce the flow rate of the hydraulic fluid to be supplied to or discharged from the supply chambers 157, rapid acceleration and rapid deceleration can be suppressed. As a result, traveling performance (operability) can be improved.

To warm up the hydraulic fluid in the hydraulic circuit according to this modification, switching of the operation valve 155L between the first position 159*a* and the second position 159*b* and switching of the operation valve 155R between the first position 159*a* and the second position 159*b* may be performed not simultaneously but alternately. Since the pilot fluid acting on the travel fluid passages (the first travel fluid passage 145*a*, the second travel fluid passage 145*b*, the third travel fluid passage 145*c*, and the fourth travel fluid passage 145*d*) is discharged from a first discharge fluid passage 666 of a brake switching valve 680*a* through the fluid passage 663*e*, the swash plates of the HST pumps (traveling pumps) 52L and 52R are held in the neutral position without being tilted.

For example, to warm up the third fluid passage 663 and the first fluid passage 661, the controller 90 closes the operation valves 155L and 155R (second activation valves) and switches the brake switching valve 680*a* (first activation valve) to a second position 680*a*2. Accordingly, the hydraulic fluid in the first fluid passage 661 is caused to flow through the third fluid passage 663 and is discharged from discharge ports of the operation valve 155L and the operation valve 155R to discharge fluid passages. This makes it possible to warm up the hydraulic fluid while causing the working machine 1 to travel at the first speed stage.

Conversely, when the brake switching valve 680*a* is switched to a first position 680*a*1 and the operation valve 155L and the operation valve 155R are opened, the hydraulic fluid flows from the delivery fluid passage 40 to the third fluid passage 663 through the operation valve 155L and the operation valve 155R. The hydraulic fluid can be discharged to the first discharge fluid passage 666 from the discharge port of the brake switching valve 680*a* through the check valves 612. This flow of the hydraulic fluid also allows warm-up of the first fluid passage (hydraulic fluid passage) and the second fluid passage (travel fluid passage).

Setting the relationship between the switching of the brake switching valve 680*a* and the openings (pressures) of the operation valves 155L and 155R in the manner described above enables the hydraulic fluid in the first fluid passage 661 or the third fluid passage 663 to flow to the discharge port of the brake switching valve 680*a* or the discharge ports of the operation valves 155L and 155R, and facilitates warm-up.

In a hydraulic circuit as illustrated in FIG. 11, which is formed by using the operation valves 155L and 155R, which are proportional valves, and the brake switching valve 680*a*, which is a switching valve, the controller 90 performs the warm-up control described above, which is referred to as a warm-up mode. Upon exiting the warm-up mode, the controller 90 makes a transition to control for normal operation in which the working machine 1 travels and performs work, which is referred to as a normal mode.

The control of the brake switching valve 680*a* (first activation valve) and the operation valves 155L and 155R (second activation valves), which is performed by the controller 90 in response to a transition from the warm-up mode to the normal mode, is similar to the control according to the first preferred embodiment described above with reference to FIGS. 3 and 5. That is, in the switching control to the normal mode according to the first preferred embodiment, the brake switching valve 80*a* is read as the brake switching valve 680*a* according to this modification, and the anti-stall proportional valve 82 is read as the operation valves 155L and 155R, thereby achieving, also in the fifth modification, switching control to the normal mode in a way similar to that in the first preferred embodiment.

Second Preferred Embodiment

A second preferred embodiment of the present invention will be described with reference to FIGS. 1 and 12. This preferred embodiment describes a configuration in which, in the hydraulic system illustrated in FIG. 1 described in the first preferred embodiment, the transmission switching valve (second activation valve) 81*a* is replaced with a transmission proportional valve 81*b* configured as a solenoid proportional valve. In this preferred embodiment, components described in the first preferred embodiment are denoted by the same reference numerals, and detailed description thereof will be omitted.

Figure 12:
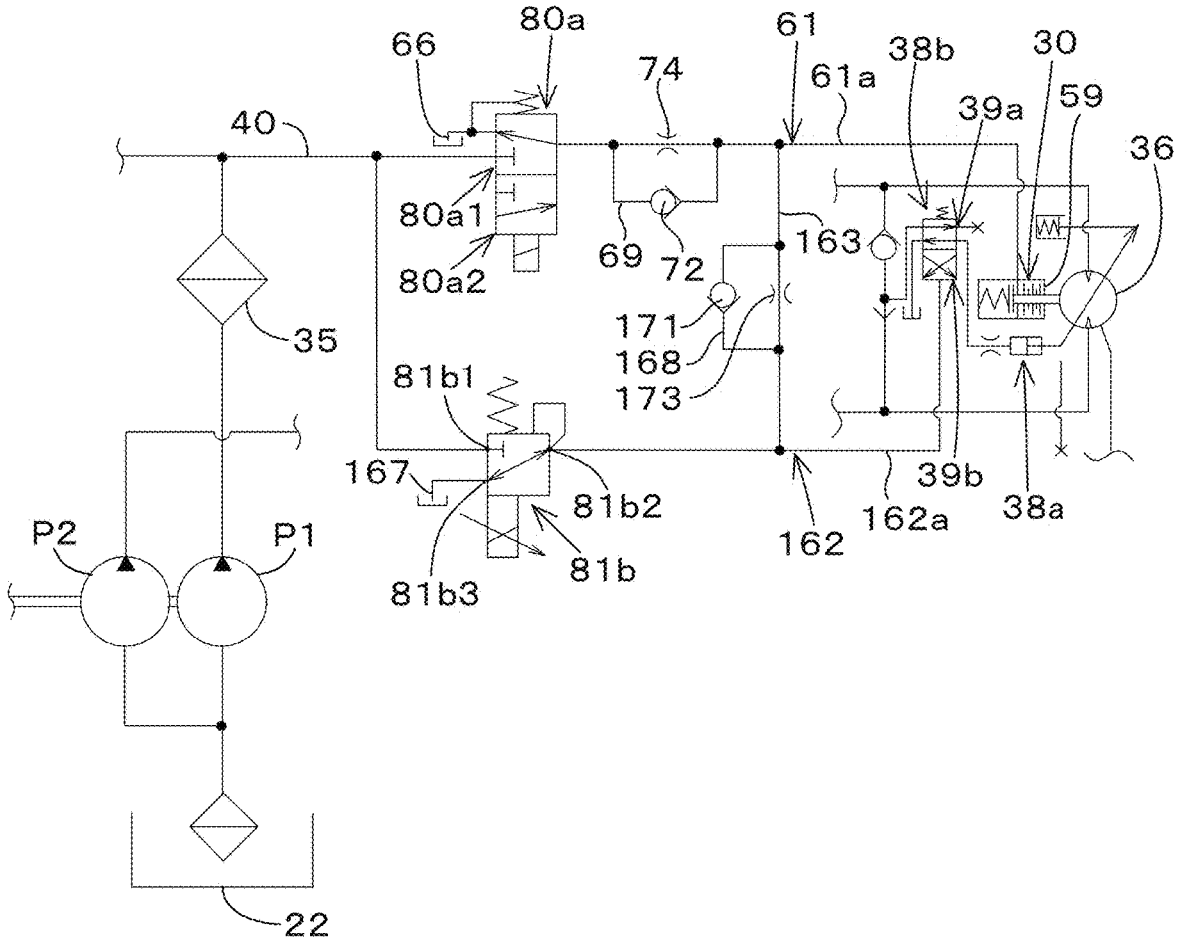
FIG. 12 is a partially enlarged view of a hydraulic system for a traveling system of a working machine according to a second preferred embodiment of the present invention.

FIG. 12 illustrates a hydraulic circuit including a brake switching valve 80*a* (first activation valve) configured as a switching valve and the transmission proportional valve 81*b* (second activation valve) configured as a proportional valve. In the hydraulic circuit illustrated in FIG. 12, a warm-up circuit is provided between the brake switching valve 80*a* and the transmission proportional valve 81*b*. The warm-up circuit will be described hereinafter.

In FIG. 12, for convenience of description, fluid passages adjacent to the first traveling motor mechanism 31L, namely, the first brake fluid passage 61*a* and a first transmission fluid passage 162*a*, are illustrated, whereas fluid passages adjacent to the second traveling motor mechanism 31R, namely, the second brake fluid passage 61*b* and a second transmission fluid passage 162*b*, are not illustrated. The configuration illustrated in FIG. 12 is also applicable to the fluid passages adjacent to the second traveling motor mechanism 31R.

In the preferred embodiment illustrated in FIG. 12, the transmission switching valve (second activation valve) 81*a*, which is a switching valve described in the first preferred embodiment (FIG. 1), is replaced with the transmission proportional valve 81*b* configured as a solenoid proportional valve. The transmission proportional valve 81*b* is controlled under the control of the controller 90. For example, when the operation member 58 is operated to a position corresponding to the first speed stage, the controller 90 outputs a control signal to the transmission proportional valve 81*b* to set the opening of the transmission proportional valve 81*b* to an opening corresponding to the first speed stage. That is, the transmission proportional valve 81*b* is controlled by the controller 90 to have an opening such that the pressure of the hydraulic fluid acting on the travel switching valve 38*b* (the pressure acting on a pressure receiver of the travel switching valve 38*b*) becomes a pressure at which the travel switching valve 38*b* is held in the first position 39*a*.

When the operation member 58 is operated to a position corresponding to the second speed stage, the controller 90 outputs a control signal to the transmission proportional valve 81*b* to set the opening of the transmission proportional valve 81*b* to be larger than the opening corresponding to the first speed stage. That is, the transmission proportional valve 81*b* is controlled by the controller 90 to have an opening such that the pressure of the hydraulic fluid acting on the travel switching valve 38*b* (the pressure acting on a pressure receiver of the travel switching valve 38*b*) becomes a pressure at which the travel switching valve 38*b* is held in the second position 39*b*. That is, the transmission proportional valve 81*b* changes the pressure of the hydraulic fluid to be supplied to the travel switching valve 38*b* of the transmission mechanism to a pressure corresponding to the speed of the transmission mechanism, that is, the speed of the travel switching valve 38*b*.

The transmission proportional valve 81*b* has a primary port (referred to as a pump port or a P port) 81*b*1 and a secondary port (referred to as an A port) 81*b*2. The primary port 81*b*1 of the transmission proportional valve 81*b* is connected to the delivery fluid passage 40. The secondary port 81*b*2 of the transmission proportional valve 81*b* is connected to a second fluid passage 162 (the first transmission fluid passage 162*a* and the second transmission fluid passage 162*b*). The transmission proportional valve 81*b* also has a discharge port (also referred to as a tank port or a T port) 81*b*3 connected to the hydraulic fluid tank 22 through a discharge fluid passage 167.

A first bypass fluid passage 168 is connected to a third fluid passage 163. The first bypass fluid passage 168 is provided with a first check valve 171. The first check valve 171 is a valve that allows the flow of the hydraulic fluid from the second fluid passage 162 to the first fluid passage 61 and prevents the flow of the hydraulic fluid from the first fluid passage 61 to the second fluid passage 162.

A second bypass fluid passage 69 is connected to the first fluid passage 61 between the brake switching valve 80*a* and the third fluid passage 163. The second bypass fluid passage 69 is provided with a second check valve 72. The second check valve 72 is a valve that allows the flow of the hydraulic fluid from a node between the first fluid passage 61 and the third fluid passage 163 to the brake switching valve 80*a* and prevents the flow of the hydraulic fluid from the brake switching valve 80*a* to the node.

While the third fluid passage 163 is provided with the first bypass fluid passage 168 and the first check valve 171, the first bypass fluid passage 168 and the first check valve 171 may be omitted. In addition, while the first fluid passage 61 is provided with the second bypass fluid passage 69 and the second check valve 72, the second bypass fluid passage 69 and the second check valve 72 may be omitted. Alternatively, the hydraulic system for the working machine may include either a set of the first bypass fluid passage 168 and the first check valve 171 or a set of the second bypass fluid passage 69 and the second check valve 72.

In the hydraulic circuit as illustrated in FIG. 12, which is formed by using the transmission proportional valve 81*b*, which is a proportional valve, and the brake switching valve 80*a*, which is a switching valve, the controller 90 performs warm-up control, which is referred to as a warm-up mode, as in the first preferred embodiment. Upon exiting the warm-up mode, the controller 90 makes a transition to control for normal operation in which the working machine 1 travels and performs work, which is referred to as a normal mode.

In the warm-up mode, the pressure at which the travel switching valve 38*b* is switched to the second position 39*b* is referred to as a second-speed setting pressure, which is a pressure corresponding to the second speed stage. In this case, when the brake switching valve 80*a* is in the first position 80*a*1 and the brake mechanism 30 is performing braking, the controller 90 sets the opening of the transmission proportional valve 81*b* so that the pressure to be applied to the travel switching valve 38*b* becomes a pressure (referred to as a preloading pressure) less than the second-speed setting pressure.

As a result, the hydraulic fluid in the second fluid passage 162 can be caused to flow through the first bypass fluid passage 168 and the second bypass fluid passage 69, and can be discharged from the discharge fluid passage 66 connected to the brake switching valve 80*a*. For example, to warm up the hydraulic fluid, the controller 90 switches the brake switching valve 80*a* to the first position 80*a*1 and controls the opening of the transmission proportional valve 81*b* to such an extent that the travel switching valve 38*b* is not switched to the second position 39*b*. That is, the controller 90 controls the opening of the transmission proportional valve 81*b* so that the pressure to be applied to the travel switching valve 38*b* becomes a pressure (referred to as a preloading pressure) less than the second-speed setting pressure.

In the warm-up mode, the brake switching valve 80*a*, which is a first activation valve configured as a switching valve, and the transmission proportional valve 81*b*, which is a second activation valve configured as a proportional valve, are caused to operate in the way described above, thereby enabling the hydraulic fluid to flow without operating the respective control targets of the activation valves 80*a* and 81*b*. The flow of the hydraulic fluid can increase the temperature of the hydraulic fluid and ensure the maintenance of the fluidity thereof.

Thereafter, to cause the control targets of the activation valves 80*a* and 81*b* to operate, that is, to perform normal operation in which the working machine 1 travels and performs work, it is desirable that the warm-up mode be exited and switched to the normal operation mode. That is, it is desirable that the output-port pressure of the transmission proportional valve 81*b*, which has been increased to the preloading pressure, be reduced, and, in addition, the output-port pressure of the brake switching valve 80*a* be increased to the normal control pressure to release braking performed by the brake mechanism 30. In an actual implementation, the controller 90 reduces the opening of the transmission proportional valve 81*b*, which is a proportional valve, and switches the brake switching valve 80*a*, which is a switching valve, to the second position 80*a*2.

However, if the opening of the transmission proportional valve 81*b* is reduced and the brake switching valve 80*a* is switched to the second position 80*a*2 at the same time, the output-port pressure of the brake switching valve 80*a*, which rapidly rises, and the preloading pressure at the output port of the transmission proportional valve 81*b* interfere with each other. The pressure interference makes the pressure between the transmission proportional valve 81*b* and the brake switching valve 80*a* unstable mainly through the third fluid passage 163, and consequently makes the pressure of the entire hydraulic circuit unstable. The unstable pressure makes it difficult to correctly control the hydraulic circuit and is desirably prevented.

Figure 13:
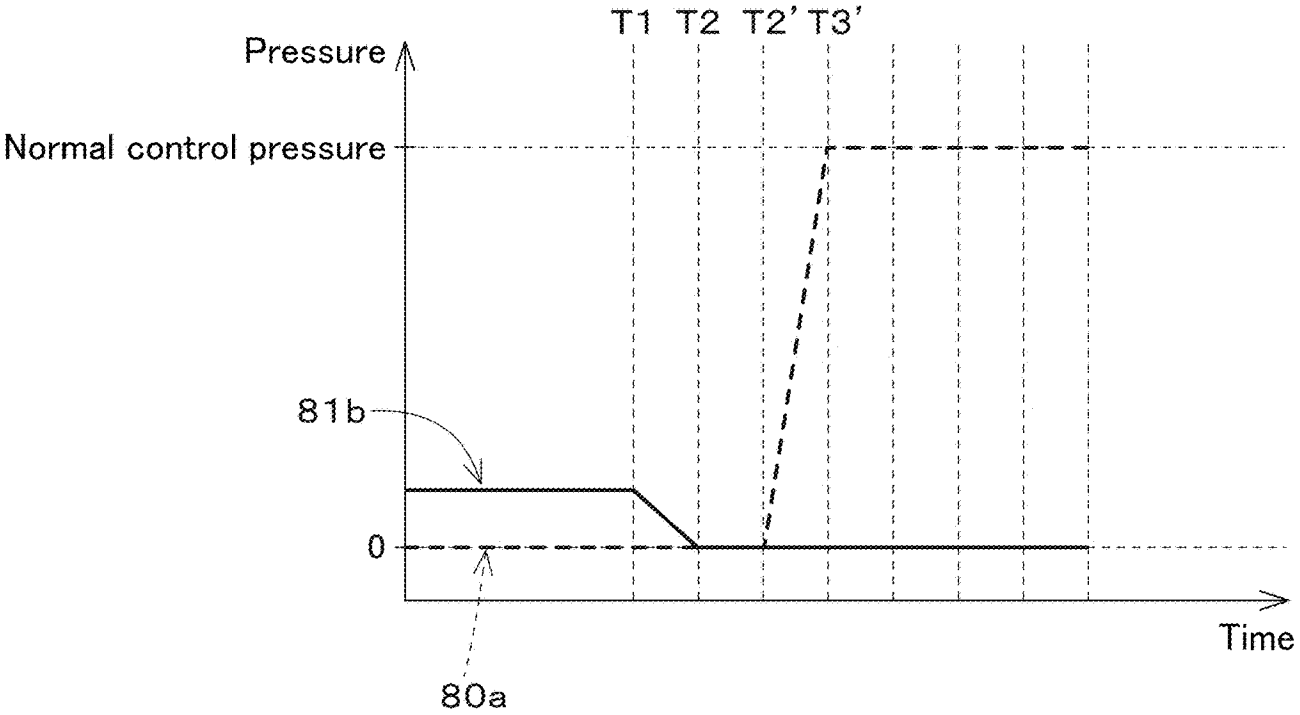
FIG. 13 is a timing chart illustrating a change in pressure across a proportional valve and a change in pressure across a switching valve according to the second preferred embodiment of the present invention.

Accordingly, to appropriately perform switching from the warm-up mode to the normal mode for normal operation, the controller 90 of the hydraulic system according to this preferred embodiment controls the transmission proportional valve 81*b* and the brake switching valve 80*a* so as to achieve the change in pressure as illustrated in FIG. 13.

FIG. 13 is a timing chart illustrating a change in output-port pressure of the transmission proportional valve 81*b* and a change in output-port pressure of the brake switching valve 80*a*. In FIG. 13, a solid line indicates the change in output-port pressure of the transmission proportional valve 81*b*, and a broken line indicates the change in output-port pressure of the brake switching valve 80*a*.

As illustrated in FIG. 13, at time T1, the controller 90 first controls the opening of the transmission proportional valve 81*b* so that the output-port pressure of the transmission proportional valve 81*b* becomes lower than the preloading pressure (for example, the opening of the transmission proportional valve 81*b* is fully closed so that the output-port pressure becomes zero (0) (time T2)). At this time, the controller 90 does not switch the brake switching valve 80*a* even at time T2 after time T1, and switches the brake switching valve 80*a* to the second position 80*a*2 at time T2', which is a predetermined time after time T2. As a result, the output-port pressure of the brake switching valve 80*a* rapidly increases to the normal control pressure at time T3' after time T2'.

After time T2', the controller 90 maintains the opening of the transmission proportional valve 81*b* such that the output-port pressure of the transmission proportional valve 81*b* becomes lower than the preloading pressure, for example, the pressure becomes zero. Through the operation described above, switching from the warm-up mode to the normal mode is completed. In the normal mode, the controller 90 controls the opening of the transmission proportional valve 81*b* so that the output-port pressure of the transmission proportional valve 81*b* becomes equal to or higher than the second-speed setting pressure, if necessary.

In the control illustrated in FIG. 13, the output-port pressure of the brake switching valve 80*a* starts to increase from time T2' at which a predetermined time elapses after time T2 at which the output-port pressure of the transmission proportional valve 81*b* has been reduced with certainty. This ensures that no moment occurs when the output-port pressure of the brake switching valve 80*a* starts to increase while pressure is applied to the output port of the transmission proportional valve 81*b*. In other words, this ensures that the pressures at both output ports are prevented from competing or interfering with each other.

The second preferred embodiment of the present invention describes a hydraulic system in which, as illustrated in FIG. 12, a warm-up circuit includes a combination of the transmission proportional valve 81*b* and the brake switching valve 80*a*, that is, a combination of a proportional valve and a switching valve. In a hydraulic system having a warm-up circuit that includes a combination of a proportional valve and a switching valve, the configuration described in this preferred embodiment can prevent the pressure between the proportional valve and the switching valve from becoming unstable in response to switching from the warm-up mode to the normal mode, and consequently prevent the pressure of the entire hydraulic circuit from becoming unstable.

This preferred embodiment is characterized in that the travel switching valve 38*b*, which is a switching valve, is operated by the transmission proportional valve 81*b*, which is a proportional valve. The configuration according to this preferred embodiment provides smooth switching from the warm-up mode to the normal mode in the hydraulic circuit having the warm-up circuit including the proportional valve that operates the switching valve.

Sixth Modification

Figure 14:
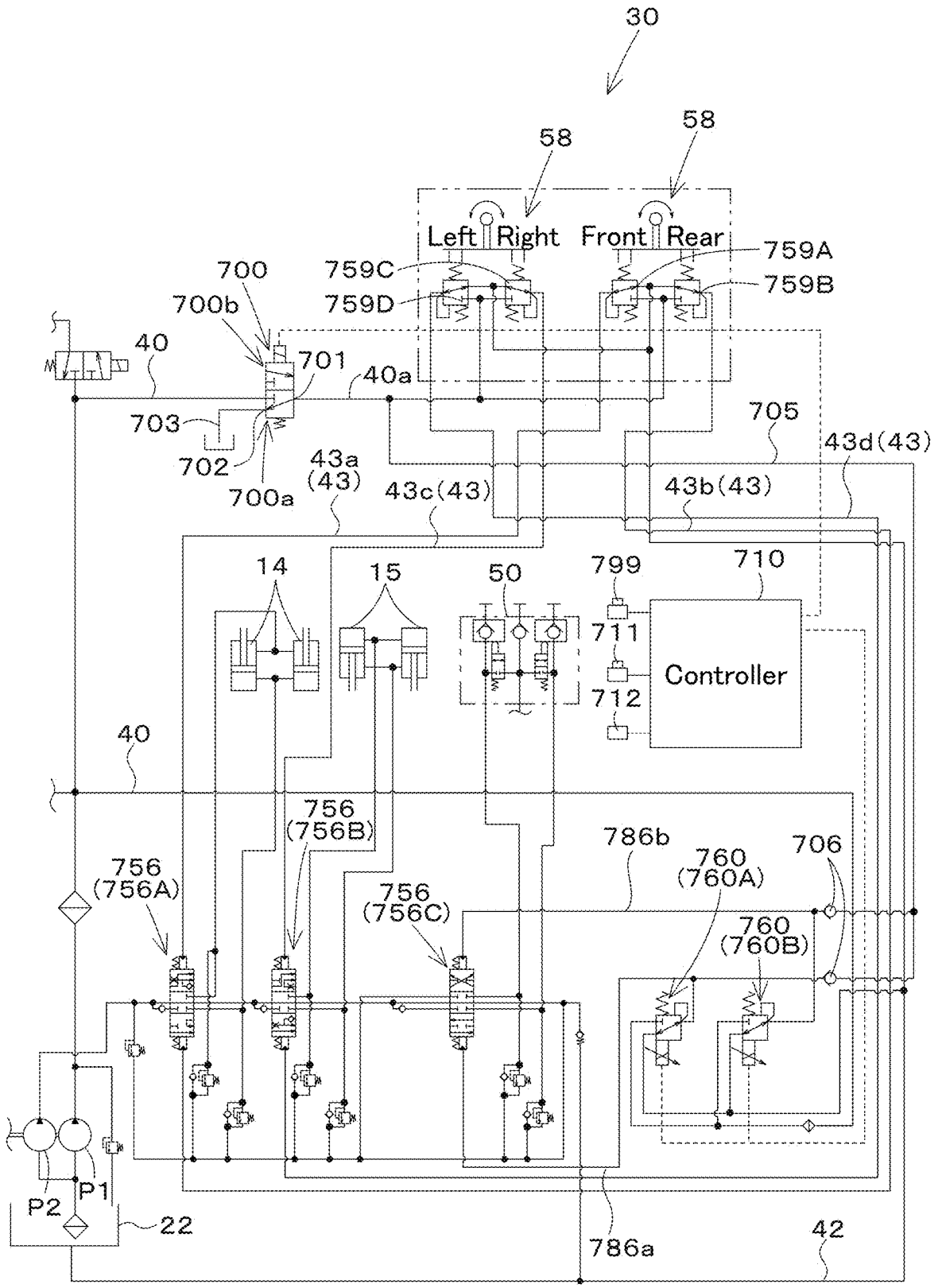
FIG. 14 is a diagram illustrating a hydraulic system (hydraulic fluid passage) for a working system according to a modification of the second preferred embodiment of the present invention.

FIG. 14 illustrates a hydraulic system (hydraulic circuit) according to a sixth modification of the second preferred embodiment of the present invention. The hydraulic system according to this modification is applicable to the hydraulic system for the working machine illustrated in FIGS. 1 and 2.

As illustrated in FIG. 14, an unload switching valve 700 is connected to the delivery fluid passage 40 at a position upstream of a plurality of pilot valves (operation valves) 759A, 759B, 759C, and 759D. The unload switching valve 700 is a valve that switches between supply and stop of the hydraulic fluid (pilot fluid) to an operating system. For example, the unload switching valve 700 is a two-position switching valve having a first position (stop position) 700*a* and a second position (supply position) 700*b* and is switchable to either the first position 700*a* or the second position 700*b*. When the unload switching valve 700 is in the first position 700*a*, the unload switching valve 700 stops the flow of the hydraulic fluid from the delivery fluid passage 40 to the plurality of pilot valves (operation valves) 759A, 759B, 759C, and 759D in the operating system, that is, stops the supply of the hydraulic fluid to the operation valves 759A, 759B, 759C, and 759D.

When the unload switching valve 700 is in the second position 700*b*, the hydraulic fluid flowing from the delivery fluid passage 40 toward the plurality of pilot valves 759A, 759B, 759C, and 759D passes through the unload switching valve 700 and is supplied to the plurality of pilot valves (operation valves) 759A, 759B, 759C, and 759D.

The delivery fluid passage 40 has a section 40*a* between the unload switching valve 700 and the plurality of pilot valves (operation valves) 759A, 759B, 759C, and 759D, and a warm-up fluid passage 705 is connected to the section 40*a*. The warm-up fluid passage 705 is a fluid passage through which the hydraulic fluid in a pilot fluid passage to be connected to pressure receivers of control valves 756 (756A, 756B, and 756C) is circulated to the unload switching valve 700. Specifically, the warm-up fluid passage 705 is connected to a first control fluid passage 786*a* and a second control fluid passage 786*b*, each of which is one of such pilot fluid passages.

Check valves 706 are connected to the warm-up fluid passage 705. The check valves 706 prevent the hydraulic fluid (pilot fluid) in the section 40*a* from flowing to the first control fluid passage 786*a* and the second control fluid passage 786*b* and allow the hydraulic fluid (pilot fluid) in the first control fluid passage 786*a* and the second control fluid passage 786*b* to flow to the section 40*a*.

In response to an operation of either a first proportional valve 760A or a second proportional valve 760B when the unload switching valve 700 remains in the first position 700*a*, the pilot fluid in the first control fluid passage 786*a* and the second control fluid passage 786*b* flows toward the unload switching valve 700 through the warm-up fluid passage 705, and is discharged to a discharge fluid passage 703 connected to the hydraulic fluid tank 22 or the like through an output port 701 and a discharge port 702 of the unload switching valve 700. That is, when the unload switching valve 700 is in the first position 700*a* and the opening of one of the first proportional valve 760A and the second proportional valve 760B is set to be higher than zero (0), the system of the third control valve 756C can be warmed up by circulation of the pilot fluid in one of the first control fluid passage 786*a* and the second control fluid passage 786*b*. In addition, warm-up can also be implemented in the section 40*a* of the delivery fluid passage 40.

The activation of the unload switching valve 700 and the activation of the first proportional valve 760A and the second proportional valve 760B are performed by a controller 710. The controller 710 is connected to an unload switch 711 and a fluid temperature detector 712. The unload switch 711 is a switch that is switchable between on and off states.

When the unload switch 711 is in the off state, the controller 710 outputs a control signal to the unload switching valve 700 to switch the unload switching valve 700 to the first position 700*a*. When the unload switch 711 is in the on state, the controller 710 outputs a control signal to the unload switching valve 700 to switch the unload switching valve 700 to the second position 700*b*.

The fluid temperature detector 712 is a device that detects the temperature (fluid temperature) of hydraulic fluid such as pilot fluid. When the fluid temperature (detected fluid temperature) detected by the fluid temperature detector 712 is lower than a predetermined temperature (determination fluid temperature) and the unload switch 711 is in the off state, the controller 710 switches from the normal mode to the warm-up mode and sets the openings of the first proportional valve 760A and the second proportional valve 760B to be higher than zero (0). For example, in the warm-up mode, the controller 710 changes both the first proportional valve 760A and the second proportional valve 760B from the closed state to the open state, or alternately opens and closes the first proportional valve 760A and the second proportional valve 760B in a repeated manner.

The pressures set by the first proportional valve 760A and the second proportional valve 760B may be the same or different. The determination fluid temperature is a temperature at which the temperature of the hydraulic fluid is low and the viscosity (viscosity coefficient) of the hydraulic fluid is high, and is set to 0° C. or less, for example. The temperature described above is an example, and the present invention is not limited to this example. The controller 710 may activate either or one of the first proportional valve 760A and the second proportional valve 760B.

When the detected fluid temperature becomes higher than the determination fluid temperature, the controller 710 exits the warm-up mode and returns to the normal mode. In the normal mode, the control valve 756C (auxiliary attachment) can be operated with a first operation member 799. The controller 710 presented in this modification and the controller 90 presented in other preferred embodiments or modifications may be combined into a single unit.

In this modification, at the time when the detected fluid temperature becomes higher than the determination fluid temperature, the controller 710 returns from the warm-up mode to the normal mode, and the control valve 756C (auxiliary attachment) is operable with the first operation member 799. Alternatively, the control valve 756C (auxiliary attachment) may be operated by switching to the normal mode or the warm-up mode as desired without being restricted by the controller 710 or the detected fluid temperature.

In this case, for example, the warm-up may be performed in response to an operator operating the first operation member 799 after turning off the unload switch 711. Alternatively, even when the detected temperature is equal to or lower than the determination fluid temperature and the unload switch 711 is in the on state, the operator may operate the first operation member 799 to move the control valve 756C (auxiliary attachment).

In this modification, furthermore, the warm-up fluid passage 705 is connected to both the first control fluid passage 786*a* and the second control fluid passage 786*b*. Alternatively, the warm-up fluid passage 705 may be connected to only one of the first control fluid passage 786*a* and the second control fluid passage 786*b*.

For example, to warm up the warm-up fluid passage 705, the controller 710 opens the first proportional valve 760A and the second proportional valve 760B (second activation valve) and switches the unload switching valve 700 (first activation valve) to the first position 700*a*. As a result, the hydraulic fluid in the warm-up fluid passage 705, which has passed through the first proportional valve 760A and the second proportional valve 760B, can be discharged from the discharge port 702 of the unload switching valve 700 to the discharge fluid passage 703 to warm up the hydraulic fluid.

Setting the relationship between the switching of the unload switching valve 700 and the openings (pressures) of the first proportional valve 760A and the second proportional valve 760B in the manner described above enables the hydraulic fluid to flow from the first proportional valve 760A and the second proportional valve 760B to the unload switching valve 700 through the warm-up fluid passage 705, and facilitates warm-up.

In the warm-up fluid passage 705 as illustrated in FIG. 14, which is formed by using the first proportional valve 760A and the second proportional valve 760B, which are proportional valves, and the unload switching valve 700, which is a switching valve, the controller 710 performs the warm-up control described above, which is referred to as a warm-up mode. Upon exiting the warm-up mode, the controller 710 makes a transition to control for normal operation in which the working machine 1 travels and performs work, which is referred to as a normal mode. In the normal mode, the controller 710 controls the hydraulic system for the traveling system and the hydraulic system for the working system of the working machine 1 so that the working machine 1 can travel and perform work.

The control of the unload switching valve 700 (first activation valve) and the first and second proportional valves 760A and 760B (second activation valves), which is performed by the controller 710 in response to a transition from the warm-up mode to the normal mode, is similar to the control according to the second preferred embodiment described above with reference to FIGS. 1, 6, and 12. That is, in the switching control to the normal mode according to the second preferred embodiment, the brake switching valve 80*a* is read as the unload switching valve 700 according to this modification, and the anti-stall proportional valve 82 is read as the first proportional valve 760A and the second proportional valve 760B, thereby achieving, also in the sixth modification, switching control to the normal mode in a way similar to that in the second preferred embodiment.

Third Preferred Embodiment

A third preferred embodiment of the present invention will be described with reference to FIGS. 1 and 15 to 17.

This preferred embodiment describes a warm-up circuit in the hydraulic system illustrated in FIG. 1 described in the first preferred embodiment. The warm-up circuit includes the brake switching valve (first activation valve) 80*a* and the transmission switching valve (second activation valve) 81*a*. In this preferred embodiment, components described in the first preferred embodiment are denoted by the same reference numerals, and detailed description thereof will be omitted.

In the hydraulic system for the working machine 1, the warm-up circuit is configured such that a first fluid passage connected to a first hydraulic device and a second fluid passage connected to a second hydraulic device are connected by a third fluid passage. In this preferred embodiment, the brake mechanism 30 is the first hydraulic device, and the transmission mechanism (the swash-plate switching cylinder 38*a* and the travel switching valves 38*b*) is the second hydraulic device. Based on this assumption, the first fluid passage, the second fluid passage, and the third fluid passage will be described.

Figure 15:
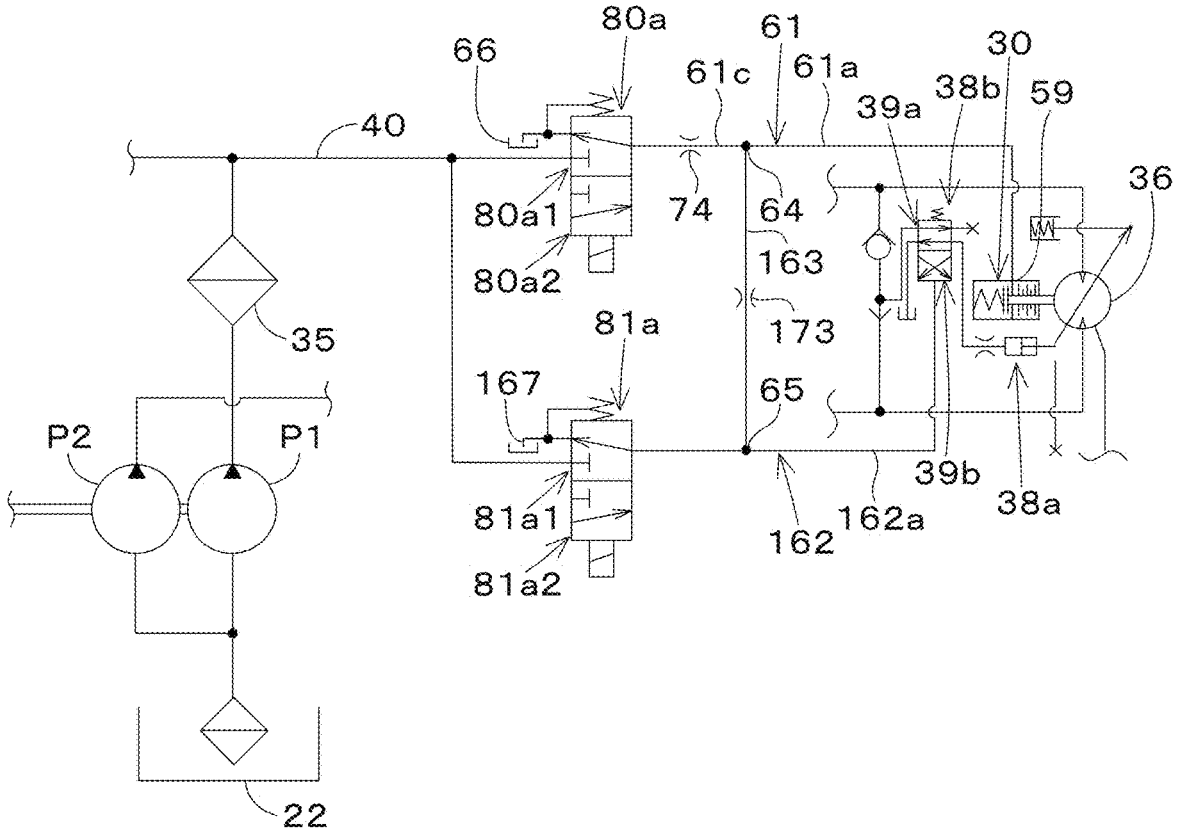
FIG. 15 is a partially enlarged view of a hydraulic system for a traveling system of a working machine according to a third preferred embodiment of the present invention.

As illustrated in FIGS. 1 and 15, the first fluid passage 61 is a fluid passage that connects the first hydraulic device (the brake mechanism 30) and the first activation valve (brake switching valve) 80*a* that controls the hydraulic fluid to be supplied to the first hydraulic device (the brake mechanism 30). In this preferred embodiment, the first fluid passage 61 includes a first brake fluid passage 61*a* and a second brake fluid passage 61*b*. The first brake fluid passage 61*a* is a fluid passage that connects the brake mechanism 30 of the first traveling motor mechanism 31L and the brake switching valve (first activation valve) 80*a*.

The second brake fluid passage 61*b* is a fluid passage that connects the brake mechanism 30 of the second traveling motor mechanism 31R and the brake switching valve (first activation valve) 80*a*. The first brake fluid passage 61*a* and the second brake fluid passage 61*b* merge into a combined fluid passage 61*c* (a fluid passage serving as both the first brake fluid passage 61*a* and the second brake fluid passage 61*b*), and the combined fluid passage 61*c* is connected to the brake switching valve 80*a*. The combined fluid passage 61*c* is provided with a throttle 74 for reducing the flow rate of the hydraulic fluid. In other words, the throttle 74 is disposed in a section of the first fluid passage 61 between a node (a merging point 64 described below) at which a third fluid passage 63 is connected to the first fluid passage 61 and a node at which the third fluid passage 63 is connected to the brake switching valve 80*a*.

The brake switching valve 80*a* has a discharge port, which is connected to a discharge fluid passage 66 through which the hydraulic fluid in the first fluid passage 61 (the first brake fluid passage 61*a* and the second brake fluid passage 61*b*) can be discharged. The discharge fluid passage 66 is connected to a suction portion of a hydraulic pump, the hydraulic fluid tank 22, or the like.

The second fluid passage 162 is a fluid passage that connects the second hydraulic device (the transmission mechanism, namely, the swash-plate switching cylinder 38*a* and the travel switching valves 38*b*) and the second activation valve (transmission switching valve) 81*a* that controls the hydraulic fluid to be supplied to the second hydraulic device (the transmission mechanism). In this preferred embodiment, the second fluid passage 162 includes a first transmission fluid passage 162*a* and a second transmission fluid passage 162*b*. The first transmission fluid passage 162*a* is a fluid passage that connects the travel switching valve 38*b* of the transmission mechanism in the first traveling motor mechanism 31L and the transmission switching valve (second activation valve) 81*a*. The second transmission fluid passage 162*b* is a fluid passage that connects the travel switching valve 38*b* of the transmission mechanism in the second traveling motor mechanism 31R and the transmission switching valve (second activation valve) 81*a*.

The first transmission fluid passage 162*a* and the second transmission fluid passage 162*b* merge into a combined fluid passage, and the combined fluid passage is connected to the transmission switching valve 81*a*. The transmission switching valve 81*a* has a discharge port, which is connected to a discharge fluid passage 167 through which the hydraulic fluid in the second fluid passage 162 (the first transmission fluid passage 162*a* and the second transmission fluid passage 162*b*) can be discharged. The discharge fluid passage 167 is connected to a suction portion of a hydraulic pump, the hydraulic fluid tank 22, or the like.

The third fluid passage 163 is a fluid passage that connects the first fluid passage 61 and the second fluid passage 162. The third fluid passage 163 connects a merging point 64 at which the first brake fluid passage 61*a* and the second brake fluid passage 61*b* merge and a merging point 65 at which the first transmission fluid passage 162*a* and the second transmission fluid passage 162*b* merge. The third fluid passage 163 is provided with a throttle 173 for reducing the flow rate of the hydraulic fluid.

With the configuration described above, for example, when the transmission switching valve (second activation valve) 81*a* is set to the first speed stage and the brake switching valve 80*a* is set to the second position 80*a*2, the hydraulic fluid in the first fluid passage 61 can be caused to flow to the second fluid passage 162 through the third fluid passage 163, and can be discharged from the discharge port of the transmission switching valve 81*a* to the discharge fluid passage 167. This allows warm-up of the first fluid passage (brake fluid passage) 61 and the second fluid passage (transmission fluid passage) 162.

That is, the first fluid passage 61, which connects the brake switching valve 80*a* and the brake mechanism 30, and the second fluid passage 162, which connects the transmission switching valve 81*a* and the transmission mechanism (the travel switching valve 38*b*), are connected by the third fluid passage 163, and the discharge fluid passages 66 and 167 are disposed such that the hydraulic fluid in either the first fluid passage 61 or the second fluid passage 162 can be discharged. This facilitates warm-up of the first fluid passage 61 and the second fluid passage 162. In particular, the brake switching valve 80*a* is configured as a switching valve that is switchable between the first position 80*a*1 and the second position 80*a*2, and the transmission switching valve 81*a* is configured as a switching valve that is switchable between the first position 81*a*1 and the second position 81*a*2. With this configuration, switching of both switching valves facilitates warm-up.

For example, the controller 90 controls the brake switching valve 80*a* (first activation valve) and the transmission switching valve 81*a* (second activation valve) to guide the hydraulic fluid in the first fluid passage 61 or the second fluid passage 162 to the discharge fluid passage 66 or 167 through the third fluid passage 163 to warm up the hydraulic fluid. To warm up the hydraulic fluid, the controller 90 switches the transmission switching valve (second activation valve) 81*a* to the first position 81*a*1 and switches the brake switching valve (first activation valve) 80*a* to the second position 80*a*2. Accordingly, the hydraulic fluid in the first fluid passage 61 flows to the second fluid passage 162 through the third fluid passage 163 and is discharged from the discharge port of the transmission switching valve 81*a* to the discharge fluid passage 167. This makes it possible to warm up the hydraulic fluid while causing the working machine 1 to travel at the first speed stage.

Figure 16:
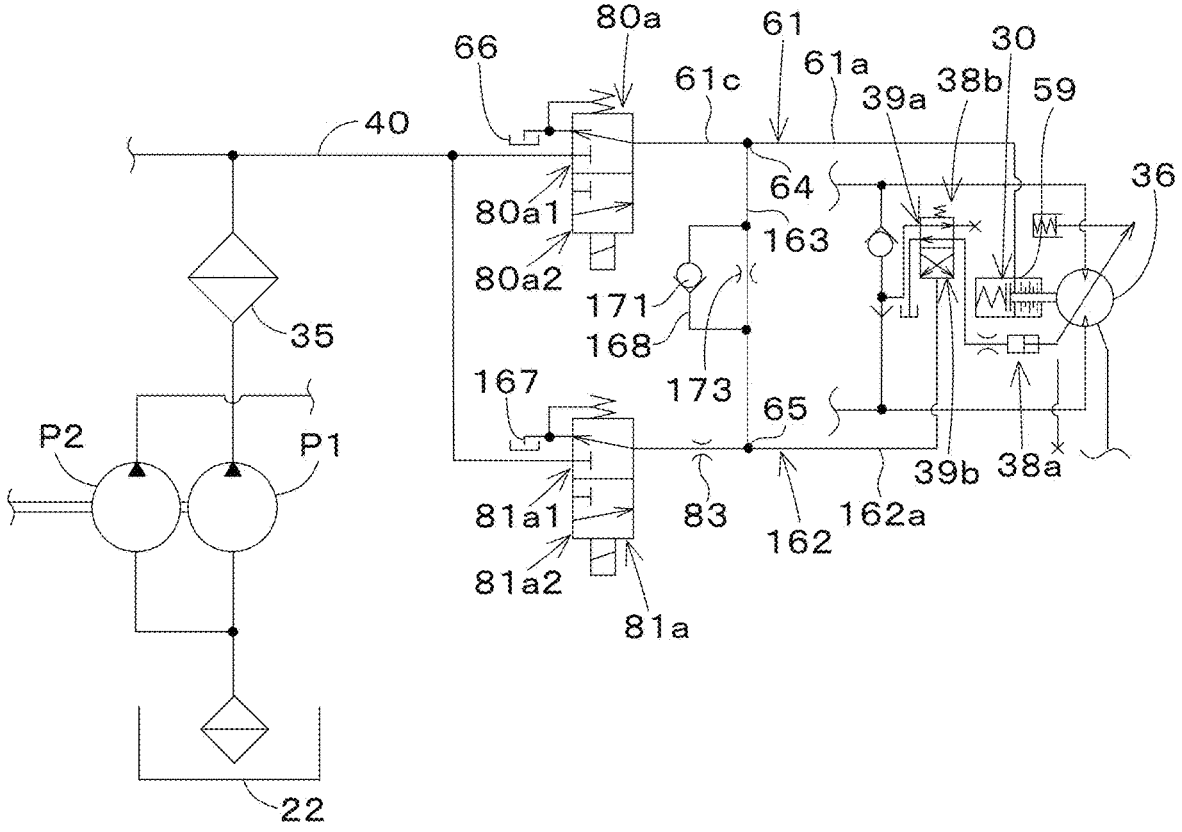
FIG. 16 is a diagram illustrating a hydraulic system for a traveling system according to a modification of the third preferred embodiment of the present invention.

FIG. 16 illustrates a modification of the warm-up circuit illustrated in FIG. 15. In this modification, in the hydraulic circuit including the brake switching valve 80*a* and the transmission switching valve 81*a*, the third fluid passage 163 is provided with the throttle 173, the first bypass fluid passage 168 is disposed so as to bypass the throttle 173, and the first check valve 171 is disposed in the first bypass fluid passage 168. Further, the second fluid passage 162 is provided with a throttle 83 in a section between the transmission switching valve 81*a* and the merging point 65. In this configuration, the controller 90 causes the brake mechanism 30 to perform braking and switches the transmission switching valve 81*a* to the second position 81*a*2. As a result, the hydraulic fluid in the second fluid passage 162 can be discharged to the discharge fluid passage 66 of the brake switching valve 80*a* through the first check valve 171 of the first bypass fluid passage 168, and the hydraulic fluid can be warmed up.

In the hydraulic circuit having the warm-up circuit illustrated in FIG. 16, thereafter, to cause the control targets of the activation valves 80*a* and 81*a* to operate, that is, to perform normal operation in which the working machine 1 travels and performs work, it is desirable that the warm-up mode for performing warm-up of the hydraulic fluid described above be exited and switched to the normal operation mode. That is, it is desirable that the output-port pressure of the transmission switching valve 81*a* be reduced, and, in addition, the output-port pressure of the brake switching valve 80*a* be increased to the normal control pressure to release braking performed by the brake mechanism 30. In an actual implementation, the controller 90 switches the transmission switching valve 81*a*, which is a switching valve, from the second position 81*a*2 to the first position 81*a*1 and switches the brake switching valve 80*a*, which is a switching valve, from the first position 80*a*1 to the second position 80*a*2.

However, if the transmission switching valve 81*a* is switched to the first position 81*a*1 and the brake switching valve 80*a* is switched to the second position 80*a*2 at the same time, the output-port pressure of the brake switching valve 80*a*, which rapidly rises, and the preloading pressure at the output port of the transmission switching valve 81*a* interfere with each other. The pressure interference makes the pressure between the transmission switching valve 81*a* and the brake switching valve 80*a* unstable mainly through the third fluid passage 163, and consequently makes the pressure of the entire hydraulic circuit unstable. The unstable pressure makes it difficult to correctly control the hydraulic circuit and is desirably prevented.

Figure 17:
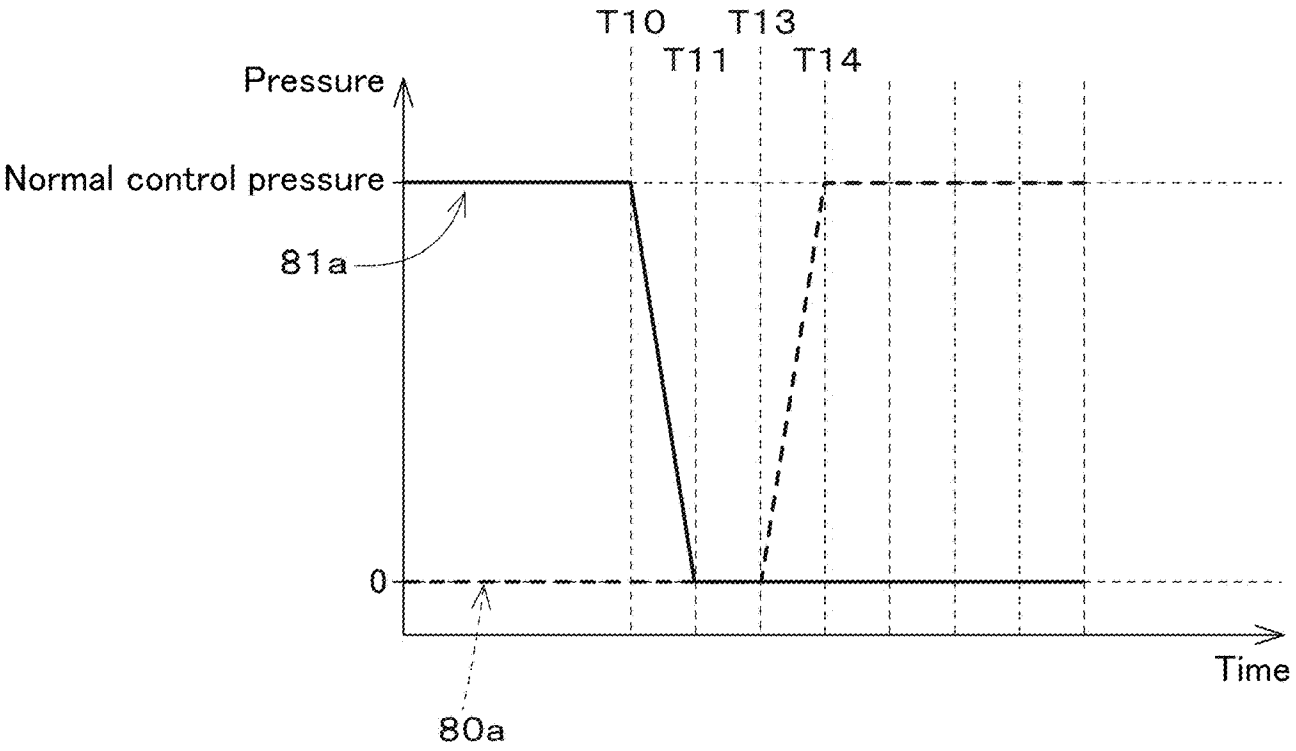
FIG. 17 is a timing chart illustrating a change in pressure across a switching valve and a change in pressure across another switching valve according to the third preferred embodiment of the present invention.

Accordingly, to appropriately perform switching from the warm-up mode to the normal mode for normal operation, the controller 90 of the hydraulic system according to this preferred embodiment controls the transmission switching valve 81*a* and the brake switching valve 80*a* so as to achieve the change in pressure as illustrated in FIG. 17.

FIG. 17 is a timing chart illustrating a change in output-port pressure of the transmission switching valve 81*a* and a change in output-port pressure of the brake switching valve 80*a*. In FIG. 17, a solid line indicates the change in output-port pressure of the transmission switching valve 81*a*, and a broken line indicates the change in output-port pressure of the brake switching valve 80*a*.

As illustrated in FIG. 17, at time T10, the controller 90 first switches the transmission switching valve 81*a* from the second position 81*a*2 to the first position 81*a*1 to reduce the output-port pressure of the transmission switching valve 81*a* (to zero (0), for example) (time T11). At this time, the controller 90 does not switch the brake switching valve 80*a* even at time T11 after time T10, and switches the brake switching valve 80*a* to the second position 80*a*2 at time T13, which is a predetermined time after time T11. As a result, the output-port pressure of the brake switching valve 80*a* rapidly increases to the normal control pressure at time T14 after time T13. At time T14, braking performed by the brake mechanism 30 is released.

After time T14, the controller 90 maintains the brake switching valve 80*a* in the second position 80*a*2 to maintain the release of braking performed by the brake mechanism 30. Through the operation described above, switching from the warm-up mode to the normal mode is completed. In the normal mode, the controller 90 performs control to switch the transmission switching valve 81*a* to the second position 81*a*2, if necessary.

In the control illustrated in FIG. 17, the output-port pressure of the brake switching valve 80*a* starts to increase from time T13 at which a predetermined time elapses after time T11 at which the output-port pressure of the transmission switching valve 81*a* has been reduced with certainty. This ensures that no moment occurs when the output-port pressure of the brake switching valve 80*a* starts to increase while pressure is applied to the output port of the transmission switching valve 81*a*. In other words, this ensures that the pressures at both output ports are prevented from competing or interfering with each other.

The third preferred embodiment of the present invention describes a hydraulic system in which, as illustrated in FIGS. 15 and 16, a warm-up circuit includes a combination of the transmission switching valve 81*a* and the brake switching valve 80*a*, that is, a combination of switching valves. In a hydraulic system having a warm-up circuit that includes a combination of switching valves, the configuration described in this preferred embodiment can prevent the pressure between the switching valves from becoming unstable in response to switching from the warm-up mode to the normal mode, and consequently prevent the pressure of the entire hydraulic circuit from becoming unstable.

The third preferred embodiment is characterized in that the travel switching valve 38*b*, which is a switching valve, is operated by the transmission switching valve 81*a*, which is a switching valve. The configuration according to this preferred embodiment provides smooth switching from the warm-up mode to the normal mode in a hydraulic circuit having a warm-up circuit including a switching valve that operates a switching valve.

For example, in the preferred embodiments described above, the controller 90 may store the openings of the first activation valve and the second activation valve, which are obtained at warm-up, in advance, and perform warm-up with the openings of the first activation valve and the second activation valve that are made to match the stored openings.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A hydraulic system for a working machine, comprising:

a hydraulic pump to deliver hydraulic fluid;

a first hydraulic device to be activated by the hydraulic fluid;

a second hydraulic device to be activated by the hydraulic fluid separately from the first hydraulic device;

a first activation valve to control the hydraulic fluid to be supplied to the first hydraulic device;

a second activation valve to control the hydraulic fluid to be supplied to the second hydraulic device;

a first fluid passage connecting the first activation valve and the first hydraulic device;

a second fluid passage connecting the second activation valve and the second hydraulic device;

a third fluid passage connecting the first fluid passage and the second fluid passage;

a first discharge fluid passage connectable to the first fluid passage to discharge the hydraulic fluid;

a second discharge fluid passage connectable to the second fluid passage to discharge the hydraulic fluid; and a controller to control operation of the first activation valve and operation of the second activation valve; wherein the controller is configured or programmed to set an output-port pressure of one activation valve to a preloading pressure having a predetermined value, and set an output-port pressure of the other activation valve to a pressure lower than the preloading pressure to discharge the hydraulic fluid in any one of the first fluid passage and the second fluid passage to the first discharge fluid passage or the second discharge fluid passage, the one activation valve being one of the first activation valve and the second activation valve, the output-port pressure of the one activation valve being a pressure of the hydraulic fluid at an output port of the one activation valve, the other activation valve being the other of the first activation valve and the second activation valve, and the output-port pressure of the other activation valve being a pressure of the hydraulic fluid at an output port of the other activation valve;

the controller is configured or programmed to increase at least either one of the output-port pressure of the one activation valve or the output-port pressure of the other activation valve to a normal pressure higher than the preloading pressure from a state where the one activation valve is controlled such that the output-port pressure thereof is equal to the preloading pressure and the other activation valve is controlled such that the output-port pressure thereof is lower than the preloading pressure, by performing control on the one activation valve such that the output-port pressure of the one activation valve becomes lower than the preloading pressure and performing control on the other activation valve such that the output-port pressure of the other activation valve is increased to the normal pressure.

2. The hydraulic system for a working machine according to claim 1, wherein the controller is configured or programmed to perform control on the one activation valve such that the output-port pressure of the one activation valve becomes lower than the preloading pressure, and perform control on the other activation valve such that the output-port pressure of the other activation valve is increased to the normal pressure, the control on the one activation valve and the control on the other activation valve being performed simultaneously.

3. The hydraulic system for a working machine according to claim 2, wherein the controller is configured or programmed to perform control on the one activation valve such that the output-port pressure of the one activation valve is increased to the normal pressure after a second predetermined time elapses after the controller performs control on the other activation valve such that the output-port pressure of the other activation valve is increased to the normal pressure.

4. The hydraulic system for a working machine according to claim 3, wherein the third fluid passage includes a third check valve to allow a flow of the hydraulic fluid from the second fluid passage toward the first fluid passage and prevent a flow of the hydraulic fluid from the first fluid passage toward the second fluid passage.

5. The hydraulic system for a working machine according to claim 2, further comprising:

a first bypass fluid passage connected to the third fluid passage in parallel with the third fluid passage; wherein the first bypass fluid passage includes a first check valve to allow a flow of the hydraulic fluid from the second fluid passage toward the first fluid passage and prevent a flow of the hydraulic fluid from the first fluid passage toward the second fluid passage.

6. The hydraulic system for a working machine according to claim 5, further comprising:

a second bypass fluid passage connected to the first fluid passage between the first activation valve and the third fluid passage in parallel with the first fluid passage; wherein the second bypass fluid passage includes a second check valve to allow a flow of the hydraulic fluid from a node between the first fluid passage and the third fluid passage toward the first activation valve and prevent a flow of the hydraulic fluid from the first activation valve toward the node between the first fluid passage and the third fluid passage.

7. The hydraulic system for a working machine according to claim 2, wherein the third fluid passage includes a third check valve to allow a flow of the hydraulic fluid from the second fluid passage toward the first fluid passage and prevent a flow of the hydraulic fluid from the first fluid passage toward the second fluid passage.

8. The hydraulic system for a working machine according to claim 1, wherein the controller is configured or programmed to perform control on the other activation valve such that the output-port pressure of the other activation valve is increased to the normal pressure after a first predetermined time elapses after the controller performs control on the one activation valve such that the output-port pressure of the one activation valve becomes lower than the preloading pressure.

9. The hydraulic system for a working machine according to claim 8, wherein the controller is configured or programmed to perform control on the one activation valve such that the output-port pressure of the one activation valve is increased to the normal pressure after a second predetermined time elapses after the controller performs control on the other activation valve such that the output-port pressure of the other activation valve is increased to the normal pressure.

10. The hydraulic system for a working machine according to claim 8, further comprising:

a first bypass fluid passage connected to the third fluid passage in parallel with the third fluid passage; wherein the first bypass fluid passage includes a first check valve to allow a flow of the hydraulic fluid from the second fluid passage toward the first fluid passage and prevent a flow of the hydraulic fluid from the first fluid passage toward the second fluid passage.

11. The hydraulic system for a working machine according to claim 10, further comprising:

a second bypass fluid passage connected to the first fluid passage between the first activation valve and the third fluid passage in parallel with the first fluid passage; wherein the second bypass fluid passage includes a second check valve to allow a flow of the hydraulic fluid from a node between the first fluid passage and the third fluid passage toward the first activation valve and prevent a flow of the hydraulic fluid from the first activation valve toward the node between the first fluid passage and the third fluid passage.

12. The hydraulic system for a working machine according to claim 8, wherein the third fluid passage includes a third check valve to allow a flow of the hydraulic fluid from the second fluid passage toward the first fluid passage and prevent a flow of the hydraulic fluid from the first fluid passage toward the second fluid passage.

13. The hydraulic system for a working machine according to claim 1, wherein the controller is configured or programmed to, in response to performing control on the one activation valve such that the output-port pressure of the one activation valve becomes lower than the preloading pressure, perform control such that an amount of the hydraulic fluid delivered from the hydraulic pump increases to increase a pressure of the hydraulic fluid to be applied to the first activation valve and the second activation valve.

14. The hydraulic system for a working machine according to claim 13, wherein the controller is configured or programmed to increase a rotational speed of a prime mover to increase the amount of the hydraulic fluid delivered from the hydraulic pump, the prime mover being operable to drive the hydraulic pump.

15. The hydraulic system for a working machine according to claim 14, further comprising:

a first bypass fluid passage connected to the third fluid passage in parallel with the third fluid passage; wherein the first bypass fluid passage includes a first check valve to allow a flow of the hydraulic fluid from the second fluid passage toward the first fluid passage and prevent a flow of the hydraulic fluid from the first fluid passage toward the second fluid passage.

16. The hydraulic system for a working machine according to claim 1, wherein the third fluid passage includes a throttle.

17. The hydraulic system for a working machine according to claim 1, further comprising:

a first bypass fluid passage connected to the third fluid passage in parallel with the third fluid passage; wherein the first bypass fluid passage includes a first check valve to allow a flow of the hydraulic fluid from the second fluid passage toward the first fluid passage and prevent a flow of the hydraulic fluid from the first fluid passage toward the second fluid passage.

18. The hydraulic system for a working machine according to claim 17, further comprising:

a second bypass fluid passage connected to the first fluid passage between the first activation valve and the third fluid passage in parallel with the first fluid passage; wherein the second bypass fluid passage includes a second check valve to allow a flow of the hydraulic fluid from a node between the first fluid passage and the third fluid passage toward the first activation valve and prevent a flow of the hydraulic fluid from the first activation valve toward the node between the first fluid passage and the third fluid passage.

19. The hydraulic system for a working machine according to claim 1, further comprising:

a second bypass fluid passage connected to the first fluid passage between the first activation valve and the third fluid passage in parallel with the first fluid passage; wherein the second bypass fluid passage includes a second check valve to allow a flow of the hydraulic fluid from a node between the first fluid passage and the third fluid passage toward the first activation valve and prevent a flow of the hydraulic fluid from the first activation valve toward the node between the first fluid passage and the third fluid passage.

20. The hydraulic system for a working machine according to claim 1, wherein the third fluid passage includes a third check valve to allow a flow of the hydraulic fluid from the second fluid passage toward the first fluid passage and prevent a flow of the hydraulic fluid from the first fluid passage toward the second fluid passage.

* * * * *